US007167657B2

(12) United States Patent
Inoue et al.

(10) Patent No.: US 7,167,657 B2
(45) Date of Patent: Jan. 23, 2007

(54) IMAGE FORMING APPARATUS THAT CONTROLS IMAGE FORMING PROCESS BASED ON TEMPERATURE OF CONVEYING BELT

(75) Inventors: Hiroyuki Inoue, Tokyo (JP); Takemasa Ishikuro, Tokyo (JP); Takeshi Asaba, Tokyo (JP)

(73) Assignee: Oki Data Corporation, Tokyo (JP)

( * ) Notice: Subject to any disclaimer, the term of this patent is extended or adjusted under 35 U.S.C. 154(b) by 111 days.

(21) Appl. No.: 10/736,044

(22) Filed: Dec. 15, 2003

(65) Prior Publication Data

US 2004/0126124 A1 Jul. 1, 2004

(30) Foreign Application Priority Data

Dec. 16, 2002 (JP) ..... 2002-363683
Dec. 11, 2003 (JP) ..... 2003-413644

(51) Int. Cl.
*G03G 15/00* (2006.01)

(52) U.S. Cl. ..... 399/44; 399/94

(58) Field of Classification Search ..... None
See application file for complete search history.

(56) References Cited

U.S. PATENT DOCUMENTS 5,832,332 A * 11/1998 Sugiura ..... 399/44
5,844,694 A * 12/1998 Miura ..... 358/468
5,893,009 A * 4/1999 Yamada ..... 399/44
5,907,741 A * 5/1999 Matsuzawa et al. ..... 399/44
6,542,703 B1 * 4/2003 Jung ..... 399/44
6,560,417 B1 * 5/2003 Rodriguez ..... 399/27
6,694,108 B1 * 2/2004 Hirose et al. ..... 399/44

FOREIGN PATENT DOCUMENTS

JP 04021870 A * 1/1992
JP 09171275 A * 6/1997
JP 09281871 A * 10/1997
JP 10133517 A * 5/1998
JP 2000347531 A * 12/2000
JP 2001027833 A * 1/2001
JP 2001034030 A * 2/2001
JP 2002055538 A * 2/2002
JP 2002072833 A * 3/2002

* cited by examiner

*Primary Examiner*—Robert Beatty
(74) *Attorney, Agent, or Firm*—Akin Gump Strauss Hauer & Feld, LLP

(57) ABSTRACT

An image forming apparatus such as a printer has: an image forming unit which forms an electrostatic latent image onto a charged photosensitive drum, deposits toner onto the image, and forms a visible image; a belt arranged so as to run freely in contact with the image forming unit; a temperature sensor which detects a temperature of the belt; and a controller which controls an image forming process on the basis of the detected temperature. Since the belt temperature is detected and the printing process is controlled on the basis of the detected temperature, an increase in temperature of the drum and an increase in temperature in the printer can be suppressed. Thus, the flowability of the toner in each image forming unit does not deteriorates and image quality can be improved.

35 Claims, 32 Drawing Sheets

| TEMPERATURE [C] | DETECTION VOLTAGE [V] | RESISTANCE VALUE [KΩ] |
|---|---|---|
| 0 | 0.791 | 27.1 |
| 1 | 0.821 | 26.0 |
| . | . | . |
| . | . | . |
| 10 | 1.113 | 17.8 |
| . | . | . |
| . | . | . |
| 20 | 1.487 | 12.0 |
| . | . | . |
| . | . | . |
| . | . | . |
| 50 | 2.712 | 4.30 |
| 60 | 3.079 | 3.18 |

IMAGE FORMING APPARATUS THAT CONTROLS IMAGE FORMING PROCESS BASED ON TEMPERATURE OF CONVEYING BELT

BACKGROUND OF THE INVENTION

1. Field of the Invention

The invention relates to an image forming apparatus.

2. Related Background Art

Hitherto, in an image forming apparatus, for example, a color printer, a copying apparatus, a facsimile apparatus, or the like, printing mechanisms of colors of black, yellow, magenta, and cyan are provided. Each printing mechanism constructs an ID (Image Drum) unit and has: an image forming unit for forming a toner image of the relevant color; a copy transfer member for sequentially laying the toner image of the color formed by the image forming unit and transferring onto a recording medium; and the like. In each image forming unit, a toner cartridge is detachably arranged into a main body of the image forming unit and toner of the color is supplied to the image forming unit from a supply port formed in a lower portion of each toner cartridge.

The recording media are picked up and fed one by one from a sheet enclosing cassette. The fed medium is attracted onto a conveying belt by an electrostatic force and conveyed. The toner images of the colors are sequentially laid and transferred onto the medium as mentioned above and a color toner image is formed thereon. The medium is subsequently peeled off from the conveying belt and conveyed to a fixing device. The color toner image is fixed by the fixing device, so that a color image is formed (for example, refer to JP-A-2000-19807).

However, in the above conventional image forming apparatus, when a temperature in the image forming apparatus rises because of an environmental change or an increase in the number of print copies which are continuously printed, that is, the number of continuous print copies, image quality deteriorates.

That is, when the temperature rises remarkably, flowability of the toner in each image forming unit deteriorates and an ability to convey the toner by a developing roller of a developing unit deteriorates. Thus, the toner is continuously agitated in the developing unit and aggregates, reproducibility of a halftone concentration in which a delicate color hue is required deteriorates, gamma characteristic deviates from an ideal characteristic, and smoothness of a continuous gradient change is extinguished.

A charge amount of the toner decreases in environmental conditions of high temperature and high humidity. If an image is formed by using the toner of a small charge amount, the toner is deposited onto a non-image forming area on the recording medium, so that a fog is formed. The toner is softened and slightly coagulated with an increase in temperature. Therefore, when the slightly coagulated toner is deposited onto a charging roller, a photosensitive drum, and the like, an electric potential on the surface of the photosensitive drum decreases and a fog is formed.

SUMMARY OF THE INVENTION

It is an object of the invention to solve the problems of the conventional image forming apparatus mentioned above and provide an image forming apparatus which can suppress an increase in internal temperature and improve image quality.

According to the first aspect of the invention, the above object is accomplished by an image forming apparatus comprising:

(a) an image forming unit which forms an electrostatic latent image onto a charged image holding material, deposits a developing material onto the electrostatic latent image, and forms a visible image;

(b) a belt arranged so as to run freely in contact with the image forming unit;

(c) a temperature detecting unit which detects a temperature of the belt; and (d) a control unit which controls an image forming process on the basis of the temperature detected by the temperature detecting unit.

Further, the image forming apparatus may comprises a fixing unit which fixes the visible image transferred from the image forming unit onto a recording medium which is conveyed by the belt. Wherein, the temperature detecting unit is arranged in a position where the surface temperature of the belt after the recording medium was separated is detected.

In the image forming apparatus, when the detection temperature by the temperature detecting unit is higher than a threshold value, the control unit temporarily stops the image forming process.

Further, in the image forming apparatus, either the detection temperature or the threshold value is corrected by a preset correction offset value.

Moreover, in the image forming apparatus, the correction offset value is set in correspondence to the detection temperature.

Furthermore, in the image forming apparatus, the control unit makes the control of the image forming process on the basis of the detection temperature by the temperature detecting unit after the elapse of a delay time from the start of running of the belt.

Further, in the image forming apparatus, the control unit makes the control of the image forming process on the basis of the detection temperature by the temperature detecting unit after a running distance of the belt became longer than a threshold value from the start of running of the belt.

Moreover, in the image forming apparatus, the control unit limits a fluctuation of the detection temperature when the fluctuation is large.

Furthermore, in the image forming apparatus, the control unit weights the detection temperature.

Further, in the image forming apparatus, the threshold value is changed when a time to temporarily stop the image forming process is equal to or longer than a set value.

Moreover, in the image forming apparatus, the control unit starts the image forming process when the detection temperature is lower than another threshold value which has been set to be lower than the threshold value after the image forming process was temporarily stopped.

Furthermore, in the image forming apparatus, the detection temperature is corrected by a temperature correction value which has been set in correspondence to a temperature of the image holding material.

Further, in the image forming apparatus, the detection temperature is corrected by a temperature correction value after the image forming process was temporarily stopped.

Moreover, in the image forming apparatus, the temperature correction value is changed in association with turn-off of a heater.

Furthermore, in the image forming apparatus, the threshold value is changed in accordance with an amount of image data to which the image process is being executed.

Further, in the image forming apparatus, when data for simplex exists in image data, the control unit preferentially forms an image with respect to an image forming job of the simplex data.

Moreover, in the image forming apparatus, the control unit reduces a conveying speed of a print medium when the detection temperature by the temperature detecting unit is higher than a threshold value.

Furthermore, in the image forming apparatus, the control unit lowers a control temperature of a fixing unit when the detection temperature by the temperature detecting unit is higher than a threshold value.

Further, in the image forming apparatus, the control unit widens a conveyance interval of a print medium when the detection temperature by the temperature detecting unit is higher than the threshold value.

Moreover, in the image forming apparatus, the control unit inhibits duplex printing when the detection temperature by the temperature detecting unit is higher than a threshold value.

According to the second aspect of the invention, there is provided another image forming apparatus comprising:

a temperature detecting unit which is provided in an apparatus main body and detects a temperature in the apparatus; and a control unit which controls an image forming process on the basis of the temperature detected by the temperature detecting unit.

In the another image forming apparatus, the temperature detecting unit is provided on a cover of the apparatus main body.

Further, in the image forming apparatus, the temperature detecting unit is provided near an image forming unit closest to a fixing unit.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings. In this case, although an example in which a printer is used as an image forming apparatus, a color image is formed by the printer, and printing is executed will be explained, the invention can be also applied to a copying apparatus, a facsimile apparatus, or the like.

Figure 1:
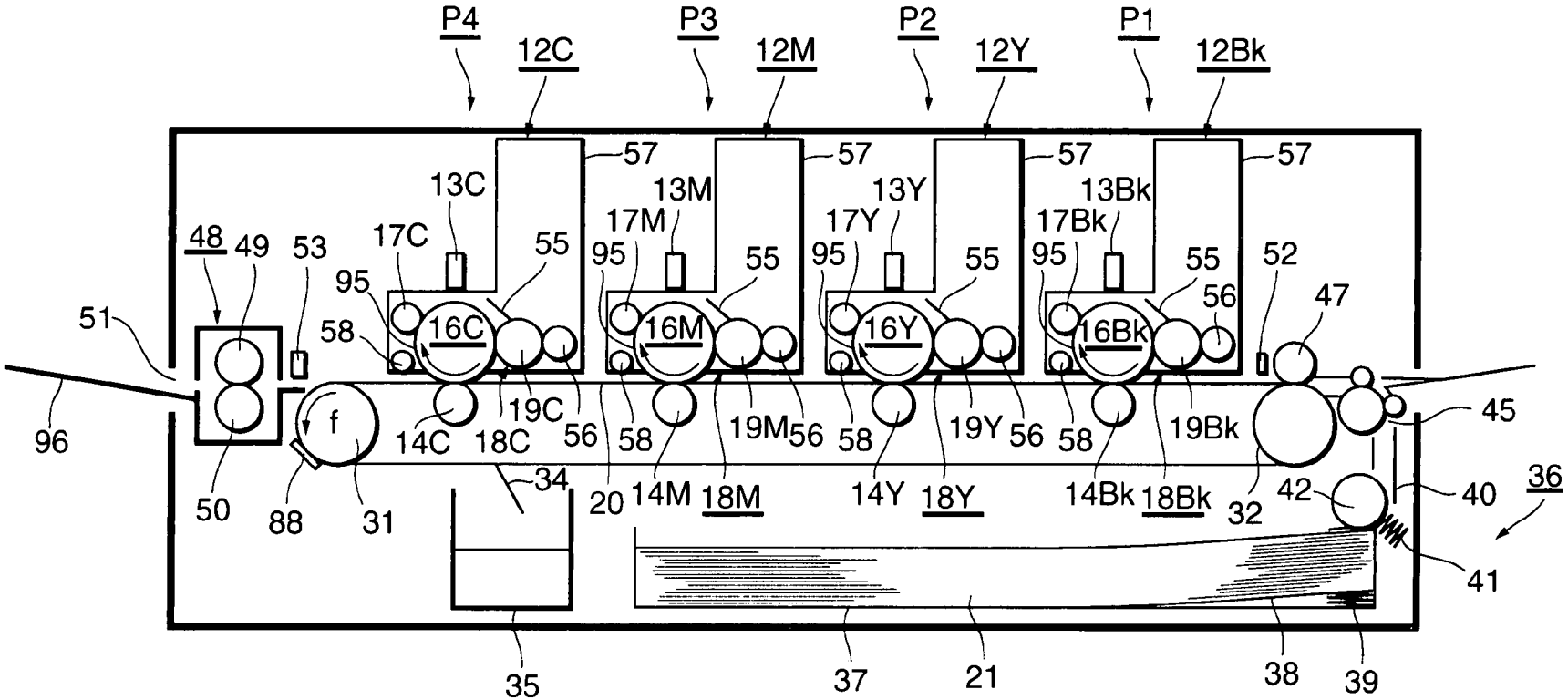
FIG. 1 is a schematic diagram of a printer in the first embodiment of the invention.
Figure 2:
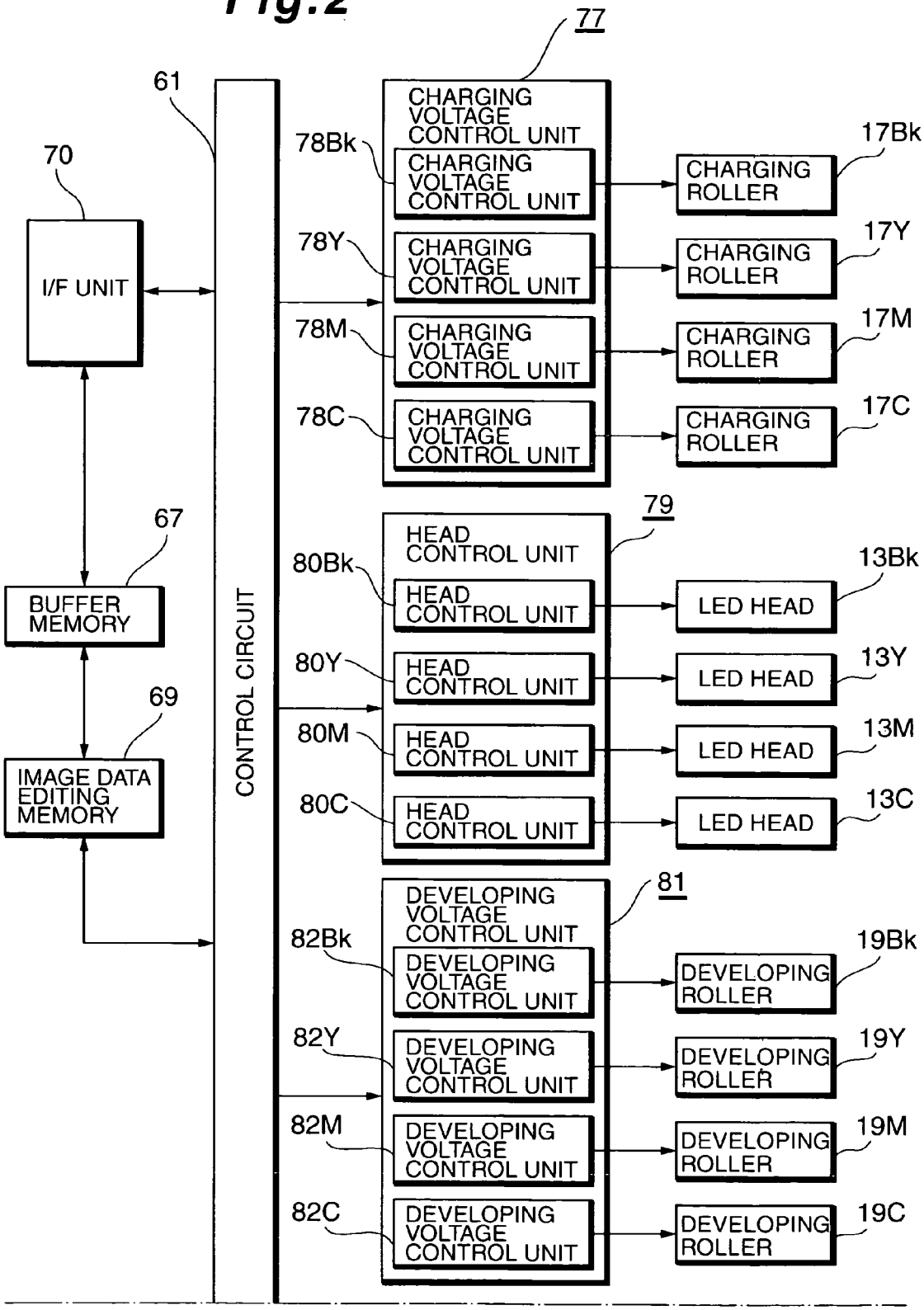
FIG. 2 is a first block diagram showing a control apparatus of the printer in the first embodiment of the invention.
Figure 3:
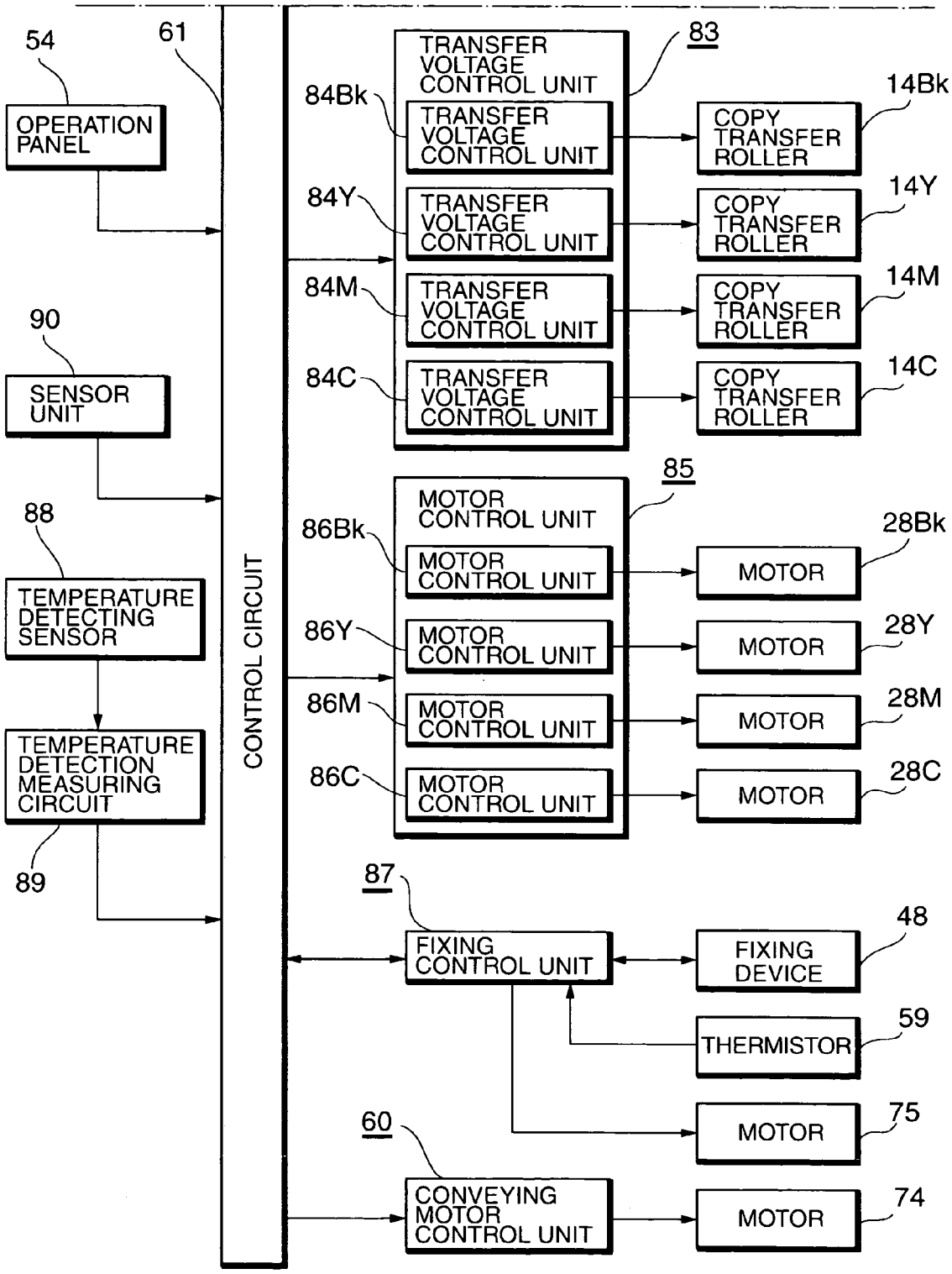
FIG. 3 is a second block diagram showing the control apparatus of the printer in the first embodiment of the invention.

FIG. 1 is a schematic diagram of a printer in the first embodiment of the invention. FIG. 2 is a first block diagram showing a control apparatus of the printer in the first embodiment of the invention. FIG. 3 is a second block diagram showing the control apparatus of the printer in the first embodiment of the invention.

In the diagram, first to fourth printing mechanisms P1 to P4 are arranged in order in a tandem form in the printer along the conveying direction of a recording medium 21. Each of the 1st to 4th printing mechanisms P1 to P4 is constructed by an LED printing mechanism of an electrophotographic type. First to fourth image forming mechanisms are constructed by the 1st to 4th printing mechanisms P1 to P4.

The first printing mechanism P1 comprises: an image forming unit 12Bk serving as an ID (Image Drum) unit of black; an LED head 13Bk for exposing the surface of a photosensitive drum 16Bk serving as an image holding material in accordance with image data; and a copy transfer roller 14Bk serving as a transfer member for transferring a toner image as a black visible image formed by the image forming unit 12Bk onto the recording medium 21 such as paper, OHP sheet, or the like.

The second printing mechanism P2 comprises: an image forming unit 12Y serving as an ID unit for yellow printing; an LED head 13Y for exposing the surface of a photosensitive drum 16Y serving as an image holding material in accordance with the image data; and a copy transfer roller 14Y serving as a transfer member for transferring a toner image as a yellow visible image formed by the image forming unit 12Y onto the recording medium 21.

The third printing mechanism P3 comprises: an image forming unit 12M serving as an ID unit for magenta printing; an LED head 13M for exposing the surface of a photosensitive drum 16M serving as an image holding material in accordance with the image data; and a copy transfer roller 14M serving as a transfer member for transferring a toner image as a magenta visible image formed by the image forming unit 12M onto the recording medium 21.

Further, the fourth printing mechanism P4 comprises: an image forming unit 12C serving as an ID unit for cyan printing; an LED head 13C for exposing the surface of a photosensitive drum 16C serving as an image holding material in accordance with the image data; and a copy transfer roller 14C serving as a transfer member for transferring a toner image as a cyan visible image formed by the image forming unit 12C onto the recording medium 21.

The image forming units 12Bk, 12Y, 12M, and 12C have the same structure and comprise: the photosensitive drums 16Bk, 16Y, 16M, and 16C which are rotated in the directions shown by arrows; charging rollers 17Bk, 17Y, 17M, and 17C for uniformly charging the surfaces of the photosensitive drums 16Bk, 16Y, 16M, and 16C; and developing units 18Bk, 18Y, 18M, and 18C, respectively. The developing units 18Bk, 18Y, 18M, and 18C have developing rollers 19Bk, 19Y, 19M, and 19C, respectively. Each of the developing rollers 19Bk, 19Y, 19M, and 19C is made of a semiconductive rubber material, and a developing blade 55 and a sponge roller 56 are come into pressure contact with each developing roller. A toner cartridge 57 for enclosing toner as a developing material of each color of one non-magnetic component is integratedly or detachably provided for each of the main bodies of the image forming units 12Bk, 12Y, 12M, and 12C. The toner of each color is supplied from the toner cartridge 57 to each of the developing units 18Bk, 18Y, 18M, and 18C.

A cleaning blade 95 is arranged so as to be come into pressure contact with each of the photosensitive drums 16Bk, 16Y, 16M, and 16C and scrapes off the toner remaining on the surface of each of the photosensitive drums 16Bk, 16Y, 16M, and 16C after the toner was transferred. The scraped toner is stored into a drain toner box (not shown) by a spiral screw 58.

Functions of the developing units 18Bk, 18Y, 18M, and 18C will now be described.

The toner supplied from the toner cartridges 57 is sent to the developing rollers 19Bk, 19Y, 19M, and 19C via the sponge rollers 56. A thickness of the toner layer on the surface of each of the developing rollers 19Bk, 19Y, 19M, and 19C is reduced by the developing blades 55 and the toner reaches a contact surface of each of the photosensitive drums 16Bk, 16Y, 16M, and 16C. When the toner layer is thinned, the toner is strongly rubbed by the developing rollers 19Bk, 19Y, 19M, and 19C and the developing blades 55 and charged. In the embodiment, the toner is charged to a negative polarity and inversion development is performed.

The LED heads 13Bk, 13Y, 13M, and 13C will now be described.

Each of the LED heads 13Bk, 13Y, 13M, and 13C comprises: an LED array (not shown); a drive IC (not shown) for driving the LED array; a board (not shown) on which the drive IC is mounted; a rod lens array (not shown) for converging light of the LED array; and the like. The LED heads 13Bk, 13Y, 13M, and 13C selectively allow LED elements of the LED array to emit the light in accordance with the image data, thereby forming electrostatic latent images onto the surfaces of the photosensitive drums 16Bk, 16Y, 16M, and 16C. The toner on the developing rollers 19Bk, 19Y, 19M, and 19C is adhered onto the electrostatic latent images by electrostatic forces, so that toner images are formed.

A conveying belt 20 as an endless belt is arranged so as to run freely in contact with the image forming units 12Bk, 12Y, 12M, and 12C. The conveying belt 20 is run in transfer portions between the photosensitive drums 16Bk, 16Y, 16M, and 16C and the copy transfer rollers 14Bk, 14Y, 14M, and 14C.

The conveying belt 20 is made of a semiconductive plastic film of a high resistance and stretched between a driving roller 31, a driven roller 32, and a tensile roller (not shown). A resistance value of the conveying belt 20 is set to a range where the recording medium 21 is attracted by the electrostatic force of the conveying belt 20 and, when the recording medium 21 is peeled off from the conveying belt 20, the static electricity remaining in the conveying belt 20 is naturally discharged.

The driving roller 31 is coupled with a motor 74 serving as driving means for running the belt, rotated in the direction of an arrow f by the motor 74, and makes the conveying belt 20 run.

An upper half portion of the conveying belt 20 is stretched so as to pass through the transfer portions of the 1st to 4th printing mechanisms P1 to P4. A front edge of a cleaning blade 34 is come into contact with a lower half portion of the conveying belt 20. The cleaning blade 34 is made of a flexible rubber material or a plastic material and scrapes off the toner remaining on the surface of the conveying belt 20 into a drain toner tank 35.

A paper feeding mechanism 36 is arranged on the lower right side of the printer. The paper feeding mechanism 36 comprises: a sheet enclosing cassette; a hopping mechanism; and a resist roller 45. The sheet enclosing cassette comprises a recording medium enclosing box 37, a push-up plate 38, and a pressing member 39. The hopping mechanism comprises a separating member 40, a spring 41, and a paper feed roller 42. The separating member 40 is come into pressure contact with the paper feed roller 42 by the spring 41.

In this case, the recording media 21 enclosed in the recording medium enclosing box 37 are come into pressure contact with the paper feed roller 42 via the push-up plate 38 by the pressing member 39. When a paper feed motor (not shown) is driven and the paper feed roller 42 is rotated, the recording media 21 are separated one by one by the separating member 40 which is in pressure contact with the paper feed roller 42 by the spring 41 and fed to the resist roller 45.

Subsequently, the separated recording medium 21 conveyed to an interval between an attracting roller 47 and the conveying belt 20. The attracting roller 47 is in pressure contact with the driven roller 32 via the conveying belt 20 and charges the recording medium 21 sent from the paper feeding mechanism 36, thereby allowing the medium to be attracted to the conveying belt 20 by the electrostatic force. For this purpose, the attracting roller 47 is made of a semiconductive rubber material of a high resistance. A photosensor 52 serving as a first recording medium detecting unit for detecting a front edge of the recording medium 21 is arranged between the attracting roller 47 and the image forming unit 12Bk. A photosensor 53 serving as a second recording medium detecting unit for detecting a rear edge of the recording medium 21 is arranged on the downstream side of the image forming unit 12C in the conveying direction of the recording medium 21.

A fixing device 48 serving as a fixing unit for fixing the toner image of each color transferred onto the recording medium 21 in each transfer portion of the 1st to 4th printing mechanisms P1 to P4 is arranged on the downstream side of the photosensor 53 in the conveying direction of the recording medium 21. The fixing device 48 has: a heating roller 49 for heating the toner on the recording medium 21; and a pressing roller 50 for pressing the recording medium 21 toward the heating roller 49.

The heating roller 49 is formed as follows. A core metal such as aluminum or the like is coated with an elastic material such as a silicone rubber or the like and the surface of the elastic material is coated with fluororesin for preventing an offset. The pressing roller 50 is formed by allowing a core metal such as aluminum or the like to be coated with an elastic material such as a silicone rubber or the like. A thermistor 59 is arranged so as to face the heating roller 49. A temperature of the heating roller 49 is detected by the thermistor 59. A heater (not shown) in the heating roller 49 can be on/off controlled in accordance with the detection temperature, that is, detection temperature so that the temperature of the heating roller 49 is equal to a predetermined fixing temperature.

Further, an ejection port 51 is arranged on the downstream side of the fixing device 48 in the conveying direction of the recording medium 21. An ejection stacker 96 is arranged outside of the ejection port 51. The recording medium 21 after a color image was formed and the printing was finished is ejected onto the ejection stacker 96 via the ejection port 51.

In FIGS. 2 and 3, reference numeral 61 denotes a control circuit as a control unit having a microprocessor, a ROM, a RAM, an input/output port, a timer, and the like (not shown). The control circuit 61 controls the whole printing operation of the printer so as to form a color image on the basis of print data and a control command which were received from an upper apparatus (not shown) such as a host computer via an interface unit (I/F unit) 70. The I/F unit 70 transmits information showing a status of the printer to the host computer, analyzes the control command received from the host computer, and records the received print data into a buffer memory 67 every color. The print data inputted via the I/F unit 70 is edited by the control circuit 61 and recorded as image data of the respective colors to be sent to the LED heads 13Bk, 13Y, 13M, and 13C into an image data editing memory 69.

Reference numeral 54 denotes an operation panel as an operating unit. The operation panel 54 has an LED (not shown) for displaying the status of the printer and a switch (not shown) which is used for the operator to input an instruction to the printer.

Reference numeral 90 denotes a sensor unit comprising sensors (not shown) for detecting a temperature and a humidity of each section in the printer and sensors (not shown) for detecting a concentration of the color image besides the photosensors 52 and 53, the thermistor 59, and the like. Detection outputs of those sensors of the sensor unit 90 are transmitted to the control circuit 61.

A charging voltage control unit 77, a head control unit 79, a developing voltage control unit 81, a transfer voltage control unit 83, a motor control unit 85, a fixing control unit 87, and a conveying motor control unit 60 are connected to the control circuit 61.

The charging voltage control unit 77 receives an instruction from the control circuit 61, applies voltages to the charging rollers 17Bk, 17Y, 17M, and 17C, and makes control so as to charge the surfaces of the photosensitive drums 16Bk, 16Y, 16M, and 16C, respectively. The charging voltage control unit 77 comprises charging voltage control units 78Bk, 78Y, 78M, and 78C which execute the control operation every color.

The head control unit 79 receives an instruction from the control circuit 61, receives the image data of each color recorded in the image data editing memory 69, sends the image data to the LED heads 13Bk, 13Y, 13M, and 13C, and selectively allows the LED elements of the LED arrays to emit the light, thereby forming electrostatic latent images onto the surfaces of the photosensitive drums 16Bk, 16Y, 16M, and 16C, respectively. The head control unit 79 comprises head control units 80Bk, 80Y, 80M, and 80C which execute the control operation every color.

The developing voltage control unit 81 receives an instruction from the control circuit 61, applies voltages to the developing rollers 19Bk, 19Y, 19M, and 19C, and allows the toner of the colors to be adhered onto the electrostatic latent images formed on the surfaces of the photosensitive drums 16Bk, 16Y, 16M, and 16C, thereby forming the toner images of the respective colors. The developing voltage control unit 81 comprises developing voltage control units 82Bk, 82Y, 82M, and 82C which execute the control operation every color.

The transfer voltage control unit 83 receives an instruction from the control circuit 61, applies voltages to the copy transfer rollers 14Bk, 14Y, 14M, and 14C, and transfers the toner images formed on the surfaces of the photosensitive drums 16Bk, 16Y, 16M, and 16C onto the recording medium 21. The transfer voltage control unit 83 has transfer voltage control units 84Bk, 84Y, 84M, and 84C which execute the control operation every color and sequentially transfer the toner images of the respective colors onto the recording medium 21.

The motor control unit 85 receives an instruction from the control circuit 61 and drives motors 28Bk, 28Y, 28M, and 28C for rotating the photosensitive drums 16Bk, 16Y, 16M, and 16C and the developing rollers 19Bk, 19Y, 19M, and 19C, respectively. The motor control unit 85 has motor control units 86Bk, 86Y, 86M, and 86C which execute the control operation every color.

The fixing control unit 87 receives an instruction from the control circuit 61 and applies a voltage to a heater built in the fixing device 48. The fixing control unit 87 on/off controls the heater on the basis of the detection temperature of the thermistor 59. When the temperature of the fixing device 48 is equal to the predetermined temperature, the fixing control unit 87 drives a motor 75, thereby rotating the heating roller 49 and the pressing roller 50.

The conveying motor control unit 60 drives the motor 74, thereby making the conveying belt 20 run.

The operation of the printer with the above structure will now be described.

When the control circuit 61 receives the print data and the control command transmitted from the host computer via the I/F unit 70, the control circuit 61 sends a predetermined instruction signal to the fixing control unit 87. The fixing control unit 87 reads out a temperature signal detected by the thermistor 59 and discriminates whether the temperature of the fixing device 48 lies within a temperature range where it can be used (hereinafter, referred to as an available temperature range) or not. If the temperature of the fixing device 48 is out of the available temperature range, the fixing control unit 87 turns off the heater, thereby heating the fixing device 48 up to the available temperature range. When the temperature of the fixing device 48 rises a predetermined temperature and enters the available temperature range, the fixing control unit 87 drives the motor 75, thereby rotating the heating roller 49 and the pressing roller 50.

Subsequently, the control circuit 61 sends a predetermined instruction signal to the motor control unit 85. The motor control unit 85 drives motors 28Bk, 28Y, 28M, and 28C, thereby rotating the photosensitive drums 16Bk, 16Y, 16M, and 16C and the developing rollers 19Bk, 19Y, 19M, and 19C, respectively. The control circuit 61 sends predetermined instruction signals to the charging voltage control unit 77, the developing voltage control unit 81, and the transfer voltage control unit 83. The charging voltage control unit 77, the developing voltage control unit 81, and the transfer voltage control unit 83 apply voltages to the LED heads 13Bk, 13Y, 13M, and 13C, the developing rollers 19Bk, 19Y, 19M, and 19C, and the copy transfer rollers 14Bk, 14Y, 14M, and 14C, respectively.

When a residual amount and a size of the recording media 21 set in the recording medium enclosing box 37 are detected by a medium residual amount sensor and a medium size sensor, the control circuit 61 sends a predetermined instruction signal to the conveying motor control unit 60 in order to convey the recording medium 21 in correspondence to the kind of medium. the conveying motor control unit 60 drives the motor 74 so as to rotate the driving roller 31 and starts the conveyance of the recording medium 21. In this case, the motor 74 can be bidirectionally driven. First, when the motor 74 is driven in the reverse direction, the paper feed roller 42 is rotated, the recording medium 21 is picked up from the recording medium enclosing box 37 and conveyed by a preset amount until the front edge of the recording medium 21 is detected by a medium inlet port sensor (not shown). Subsequently, when the motor 74 is driven in the forward direction, the resist roller 45 is rotated, so that the recording medium 21 is conveyed to the transfer portion of the 1st printing mechanism P1.

When the recording medium 21 reaches a predetermined position, the control circuit 61 reads out the image data from the image data editing memory 69 and sends it to the head control unit 79. When the image data of one line is received, the head control unit 79 sends the image data and a latch signal to each of the LED heads 13Bk, 13Y, 13M, and 13C, thereby allowing the image data to be held in the LED heads 13Bk, 13Y, 13M, and 13C. The head control unit 79 sends a print drive signal STB to each of the LED heads 13Bk, 13Y, 13M, and 13C, so that each of the LED heads 13Bk, 13Y, 13M, and 13C selectively lights on the LED elements of the LED array every line in accordance with the image data.

The LED heads 13Bk, 13Y, 13M, and 13C irradiates light to the photosensitive drums 16Bk, 16Y, 16M, and 16C which have been charged to the negative polarity and form dots of high electric potentials onto the surfaces of the photosensitive drums 16Bk, 16Y, 16M, and 16C, thereby forming electrostatic latent images. The toner which has been charged to the negative polarity is attracted to each dot by an electrical attracting force and a toner image of each color is formed. After that, the toner images are sent to the transfer portions of the 1st to 4th printing mechanisms P1 to P4. At this time, the control circuit 61 sends an instruction signal to the transfer voltage control unit 83. The transfer voltage control unit 83 applies a transfer voltage of the positive polarity to the copy transfer rollers 14Bk, 14Y, 14M, and 14C. Thus, the toner images of the respective colors are sequentially laid and transferred onto the recording medium 21 which passes through the transfer portions by the copy transfer rollers 14Bk, 14Y, 14M, and 14C and a color toner image is formed onto the recording medium 21.

The recording medium 21 on which the color toner image has been formed is sent to the fixing device 48. The color toner image is heated by the fixing device 48, pressed, and fixed onto the recording medium 21, so that a color image is formed. After that, the recording medium 21 is further conveyed, passes through a sheet ejection port sensor (not shown), and is ejected to the outside of the printer.

When the recording medium 21 passes through the sheet ejection port sensor, the control circuit 61 finishes the operation for applying the voltages to the LED heads 13Bk, 13Y, 13M, and 13C, the developing rollers 19Bk, 19Y, 19M, and 19C, the copy transfer rollers 14Bk, 14Y, 14M, and 14C, and the like and, at the same time, stops the driving of the motors 28Bk, 28Y, 28M, and 28C and the motors 74 and 75.

A number of drive members to execute a series of operations are arranged in the printer. Each drive member becomes a heat source and generates heat. Particularly, the heating roller 49 among the drive members is controlled at a high temperature over 150 [° C.] in order to fix the color toner image formed on the recording medium 21 and becomes a large heat source. The motors 28Bk, 28Y, 28M, 28C, 74, and 75 and the like also become heat sources upon driving.

Therefore, if an environment changes or the number of continuous print copies increases, an ambient temperature in the printer, particularly, an area between the fixing device 48 and the 4th printing mechanism P4 exceeds 50 [° C.] due to the heat generated from each heat source.

Generally, when the temperature rises remarkably, flowability of the toner in each of the image forming units 12Bk, 12Y, 12M, and 12C deteriorates and ability to convey the toner by the developing rollers 19Bk, 19Y, 19M, and 19C deteriorates. Thus, the toner is continuously agitated in the developing units 18Bk, 18Y, 18M, and 18C and aggregates, reproducibility of the halftone concentration in which a delicate color hue is required deteriorates, gamma characteristic deviates from an ideal characteristic, and smoothness of the continuous gradient change is extinguished.

A charge amount of the toner decreases in environmental conditions of high temperature and high humidity. If the toner of a small charge amount is used, the toner is deposited onto a non-image forming area on the recording medium 21, so that a fog is formed. The toner is softened and slightly coagulated with an increase in temperature. Therefore, when the slightly coagulated toner is deposited onto the charging rollers 17Bk, 17Y, 17M, and 17C, the photosensitive drums 16Bk, 16Y, 16M, and 16C, and the like, electric potentials on the surfaces of the photosensitive drums 16Bk, 16Y, 16M, and 16C decrease and a fog is formed.

Therefore, in the photosensitive drums 16Bk, 16Y, 16M, and 16C of the 1st to 4th printing mechanisms P1 to P4, it is desirable to detect the temperature of the toner or the surface temperatures of the photosensitive drums 16Bk, 16Y, 16M, and 16C and suppress an increase in toner temperature or surface temperatures of the photosensitive drums 16Bk, 16Y, 16M, and 16C. However, for example, it is difficult that the thermistors to detect the toner temperature or the surface temperatures of the photosensitive drums, 16Bk, 16Y, 16M, and 16C are arranged in the image forming units 12Bk, 12Y, 12M, and 12C. The surfaces of the photosensitive drums 16Bk, 16Y, 16M, and 16C are coated with thin films of a special photosensitive material and delicate photosensitive layers are formed on those surfaces. Therefore, if the thermistor is directly come into contact with those surfaces and the surface temperatures of the photosensitive drums 16Bk, 16Y, 16M, and 16C are detected, the surfaces of the photosensitive drums 16Bk, 16Y, 16M, and 16C are scratched and image forming processes are obstructed. Although there is a method of detecting the surface temperatures of the photosensitive drums 16Bk, 16Y, 16M, and 16C in a contactless manner, in such a case, not only costs of the sensors increase but also a space to attach the sensors cannot be assured.

In the embodiment, therefore, by detecting the surface temperature of the conveying belt 20 which is come into contact with the photosensitive drums 16Bk, 16Y, 16M, and 16C and heated to almost the same temperature, the surface temperatures of the photosensitive drums 16Bk, 16Y, 16M, and 16C are presumed and detected, and the printer is controlled on the basis of the detected surface temperatures of the photosensitive drums 16Bk, 16Y, 16M, and 16C.

For this purpose, a temperature detecting sensor 88 as a temperature detecting unit is arranged under the heating roller 49 at a position where it is not directly influenced by the heat of the heating roller 49 so as to be in contact with the conveying belt 20. The temperature detecting sensor 88 detects the surface temperature of the conveying belt 20 after the recording medium 21 was separated therefrom. Since the arranging position of the temperature detecting sensor 88 is a position near the photosensitive drum 16C on the downstream side of the photosensitive drum 16C in the running direction of the conveying belt 20, the surface temperature of the conveying belt 20 which passed through the photosensitive drum 16C and that of the photosensitive drum 16C are almost equal. Although the arranging position of the temperature detecting sensor 88 is a position where it faces the driving roller 31 via the conveying belt 20, since the driving roller 31 and the photosensitive drums 16Bk, 16Y, 16M, and 16C have shafts each of which is formed by a pipe made of aluminum and have substantially the same temperature characteristics, the temperature of the driving roller 31 and the surface temperatures of the photosensitive drums 16Bk, 16Y, 16M, and 16C are almost equal.

Since the temperature detecting sensor 88 faces the curved portion on the driving roller 31, the temperature detecting sensor 88 can be easily come into contact with the conveying belt 20.

A detection output of the temperature detecting sensor 88 is converted into a detection voltage by a temperature detection measuring circuit 89. The detection voltage is sent to the control circuit 61. Temperature detection processing means (not shown) of the control circuit 61 executes a temperature detecting process, reads the detection voltage, and converts it into the detection temperature of the conveying belt 20.

Figures 4, 5:
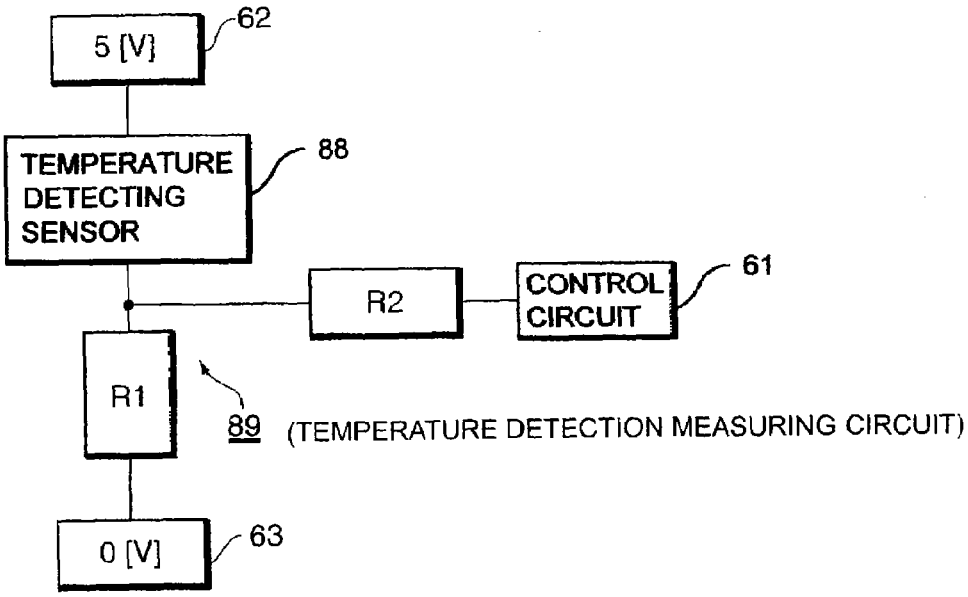
FIG. 4 is a block diagram of a conveying belt temperature detecting apparatus in the first embodiment of the invention.
FIG. 5 is a diagram showing a temperature table in the first embodiment of the invention.

FIG. 4 is a block diagram of a conveying belt temperature detecting apparatus in the first embodiment of the invention. FIG. 5 is a diagram showing a temperature table in the first embodiment of the invention.

In the diagram, reference numeral 62 denotes a power source system of 5[V] and 63 indicates a ground of 0[V]. The temperature detecting sensor 88 and a reference resistor R1 are serially connected between the power source system 62 and the ground 63. One end of an output resistor R2 is connected between the temperature detecting sensor 88 and the reference resistor R1 and the other end of the output resistor R2 is connected to the control circuit 61. The temperature detection measuring circuit 89 is constructed by the reference resistor R1 and the output resistor R2.

The temperature detecting sensor 88 is constructed by a thermistor. The thermistor has characteristics as shown in the temperature table in FIG. 5. The higher the detected temperature is, the smaller a resistance value of the thermistor is, so that a detection voltage which is outputted from the temperature detection measuring circuit 89 becomes high.

The operation of the printer with the above construction will now be described. In this case, when the printer executes the printing, image processing means (not shown) of the control circuit 61 executes the image process and edits the image data. The operation of the printer after the editing of the image data was finished will be described.

Figure 6:
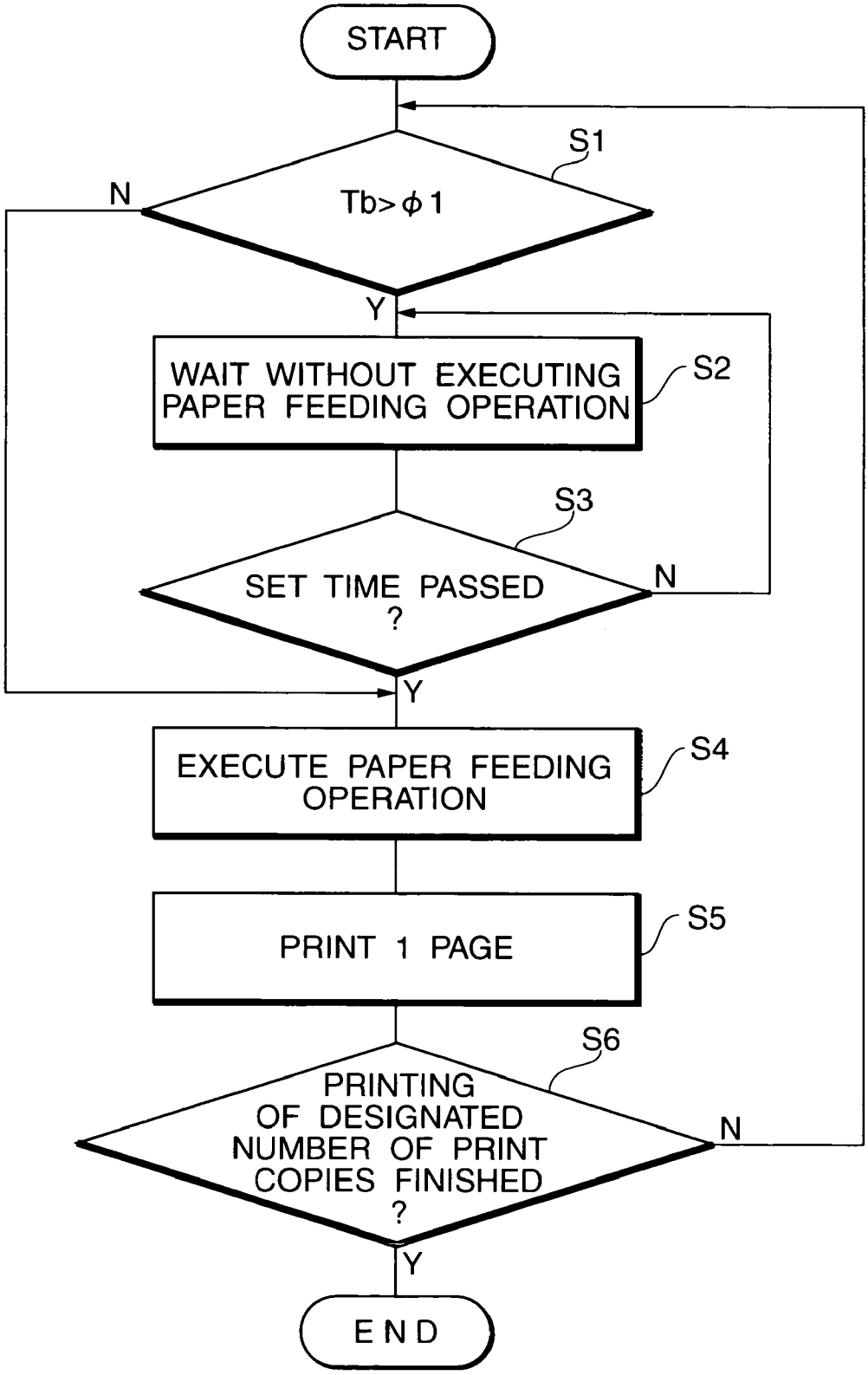
FIG. 6 is a flowchart showing the operation of the printer in the first embodiment of the invention.
Figure 7:
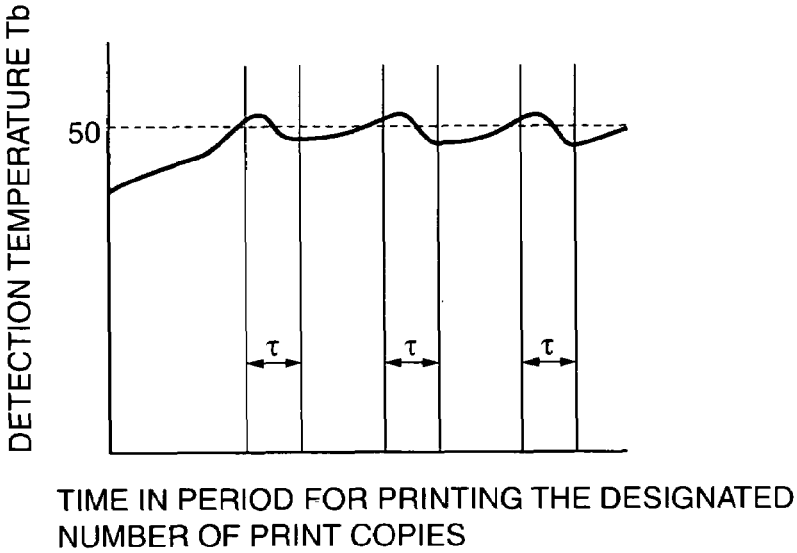
FIG. 7 is a waveform diagram showing the operation of the printer in the first embodiment of the invention.
Figure 8:
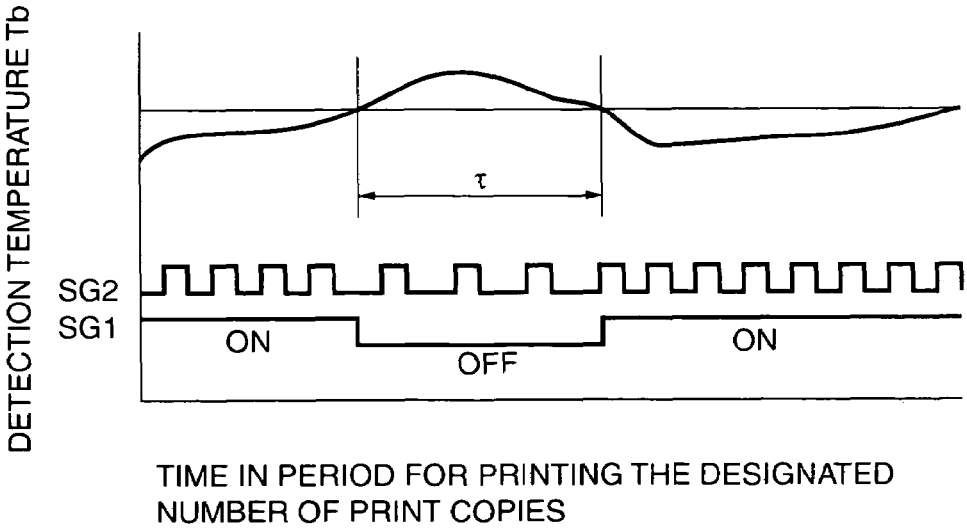
FIG. 8 is a first waveform diagram for explaining a standby mode in the first embodiment of the invention.
Figure 9:
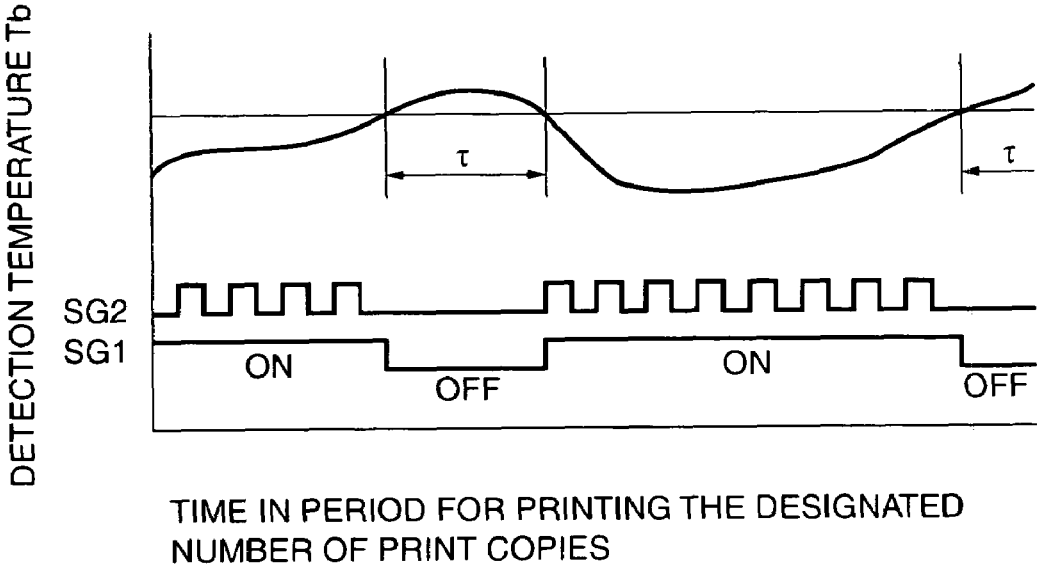
FIG. 9 is a second waveform diagram for explaining the standby mode in the first embodiment of the invention.

FIG. 6 is a flowchart showing the operation of the printer in the first embodiment of the invention. FIG. 7 is a waveform diagram showing the operation of the printer in the first embodiment of the invention. FIG. 8 is a first waveform diagram for explaining a standby mode in the first embodiment of the invention. FIG. 9 is a second waveform diagram for explaining the standby mode in the first embodiment of the invention. In FIG. 7, an axis of abscissa indicates a time for a period of time to print copies of the designated number and an axis of ordinate indicates a detection temperature Tb. In FIGS. 8 and 9, an axis of abscissa indicates a time for a period of time to print copies of the designated number and an axis of ordinate indicates the detection temperature Tb by the temperature detecting sensor 88, a fixing device motor control signal SG1, and a heater control signal SG2.

First, the temperature detection processing means reads out the detection voltage and converts it into a detection temperature showing the surface temperature of the conveying belt 20 (FIG. 1) with reference to the temperature table in FIG. 5 recorded in the ROM of the control circuit 61. Subsequently, temperature discrimination processing means (not shown) of the control circuit 61 executes a temperature discriminating process, thereby discriminating whether the detection temperature Tb is higher than a threshold value $\phi$1 (in the embodiment, 50 [° C.]) or not. If the detection temperature Tb is higher than the threshold value $\phi$1, standby mode setting processing means (not shown) of the control circuit 61 executes a standby mode setting process, does not execute the paper feeding operation as a recording medium supplying operation that is executed by the paper feeding mechanism 36, and waits for the start of the printing process as an image forming process until a set time $\tau$ (20 seconds in the embodiment) passes. By setting the printer into the standby mode as mentioned above, the printing process can be temporarily stopped.

When the temperature detection processing means discriminates whether the detection temperature Tb is higher than the threshold value $\phi$1 or not on the basis of the temperature table, whether the detection voltage is higher than 2.712[V] or not is discriminated. Although the threshold value $\phi$1 has been set to 50 [° C.] in the embodiment, various values can be used in dependence on characteristics of the toner that is used. The threshold values are previously obtained by experiments and set in consideration of the temperatures at which the flowability of the toner deteriorates, the charge amount increases, or the toner is softened. The set values are recorded into the ROM. Although the set time $\tau$ has been set to 20 seconds in the embodiment, it is a time necessary until the temperature over 50 [° C.] becomes lower than 50 [° C.]. The set times are different in dependence on the structure of the printer, the presence or absence of cooling means (for example, fan apparatus for cooling), and the like. An increase in temperature in the printer can be prevented by intermittently printing at an interval of the set time $\tau$.

When the surface temperature of the conveying belt 20 is lowered as mentioned above, the paper feeding operation is executed and the print processing means (not shown) of the control circuit 61 starts the printing process. When the continuous printing process is executed, the above operation is repeated as shown in FIG. 7 until the end of the printing of the designated number of print copies.

In the standby mode, the standby mode setting processing means does not put the recording medium 21 into the recording medium enclosing box 37 but puts it to a position where the image forming process can be immediately starts, for example, a standby position set just in front of the photosensor 52 where the front edge of the recording medium 21 reaches so as not to reduce a print throughput. The standby mode setting processing means lowers the set temperature of the fixing device 48 or turning off the heater of the fixing device 48, thereby lowering the temperatures of the photosensitive drums 16Bk, 16Y, 16M, and 16C and the temperature in the printer.

In the case of lowering the set temperature of the fixing device 48, the standby mode setting processing means turns off the fixing device motor control signal SG1 for the set time $\tau$, so that a time during which the heater control signal SG2 is OFF becomes long. In this case, since a power source of the heater continues to be on/off controlled for the set time $\tau$, the detection temperature Tb is lowered. However, the heater continues to be intermittently energized. Therefore, the temperature in the printer cannot be rapidly lowered. However, when the set time $\tau$ passes and the printing process is started, since the heater has been controlled at a temperature near the set temperature of the fixing device 48, the temperature of the fixing device 48 reaches the set temperature immediately. Consequently, the printing operation can be soon executed.

In the case of turning off the heater, as shown in FIG. 9, the standby mode setting processing means turns off the fixing device motor control signal SG1 for the set time $\tau$, so that the heater control signal SG2 is perfectly turned off. In this case, since the power source of the heater is OFF for the set time $\tau$, the temperature in the printer can be rapidly lowered. However, when the set time $\tau$ passes and the printing process is started, since the temperature of the heater is low, it takes a time until the temperature of the fixing device 48 reaches the set temperature. Consequently, the printing operation cannot be soon executed.

Either the mode for lowering the set temperature of the fixing device 48 or the mode for turning off the heater in the standby mode setting process is properly selected in accordance with a structural feature of the printer, characteristics of parts used, image quality to be realized, and the like.

The temperature of the conveying belt 20 is detected and when the detection temperature Tb is higher than the threshold value $\phi$1, the start of the printing process is waited as mentioned above. Therefore, the increase in surface temperatures of the photosensitive drums 16Bk, 16Y, 16M, and 16C and the increase in temperature in the printer can be suppressed.

Thus, since the flowability of the toner in each of the image forming units 12Bk, 12Y, 12M, and 12C does not deteriorate, the ability to convey the toner by the developing rollers 19Bk, 19Y, 19M, and 19C can be improved. Thus, since the toner is not continuously agitated in the developing units 18Bk, 18Y, 18M, and 18C and does not aggregate, the reproducibility of the halftone concentration can be improved. The gamma characteristic does not deviate from an ideal characteristic and the smoothness of the continuous gradient change is not extinguished.

Since the charge amount of the toner does not increases, a situation such that the toner is deposited onto the non-image forming area on the recording medium 21 and a fog is formed can be prevented. Since the toner is not slightly coagulated, the drop of the surface potentials of the photosensitive drums 16Bk, 16Y, 16M, and 16C can be prevented and it is possible to prevent a fog from being formed. The image quality can be consequently improved.

In the embodiment, since the temperature of the conveying belt is detected, not only the surfaces of the photosensitive drums 16Bk, 16Y, 16M, and 16C are not scratched but also almost the same temperature as the surface temperatures of the photosensitive drums 16Bk, 16Y, 16M, and 16C can be detected.

Since there is no need to detect the surface temperatures of the photosensitive drums 16Bk, 16Y, 16M, and 16C in a contactless manner, not only the costs of the temperature detecting sensor 88 can be reduced but also the space to attach the temperature detecting sensor 88 can be reduced.

The flowchart of FIG. 6 will now be described.

Step S1: Whether the detection temperature Tb is higher than a threshold value $\phi$1 or not is discriminated. If the detection temperature Tb is higher than the threshold value $\phi$1, step S2 follows. If the detection temperature Tb is equal to or lower than the threshold value $\phi$1, step S4 follows.

Step S2: The paper feeding operation is not executed but the printer enters a standby mode.

Step S3: Whether the set time τ has passed or not is discriminated. If the set time τ has passed, step S4 follows. If the set time τ does not pass, the processing routine is returned to step S2.

Step S4: The paper feeding operation is executed.

Step S5: The printing of one page is performed.

Step S6: Whether the printing of the designated number of print copies has been finished or not is discriminated. If the printing of the designated number of print copies has been finished, the processing routine is finished. If the printing of the designated number of print copies is not finished, the processing routine is returned to step S1.

The second embodiment will now be described.

Figure 10:
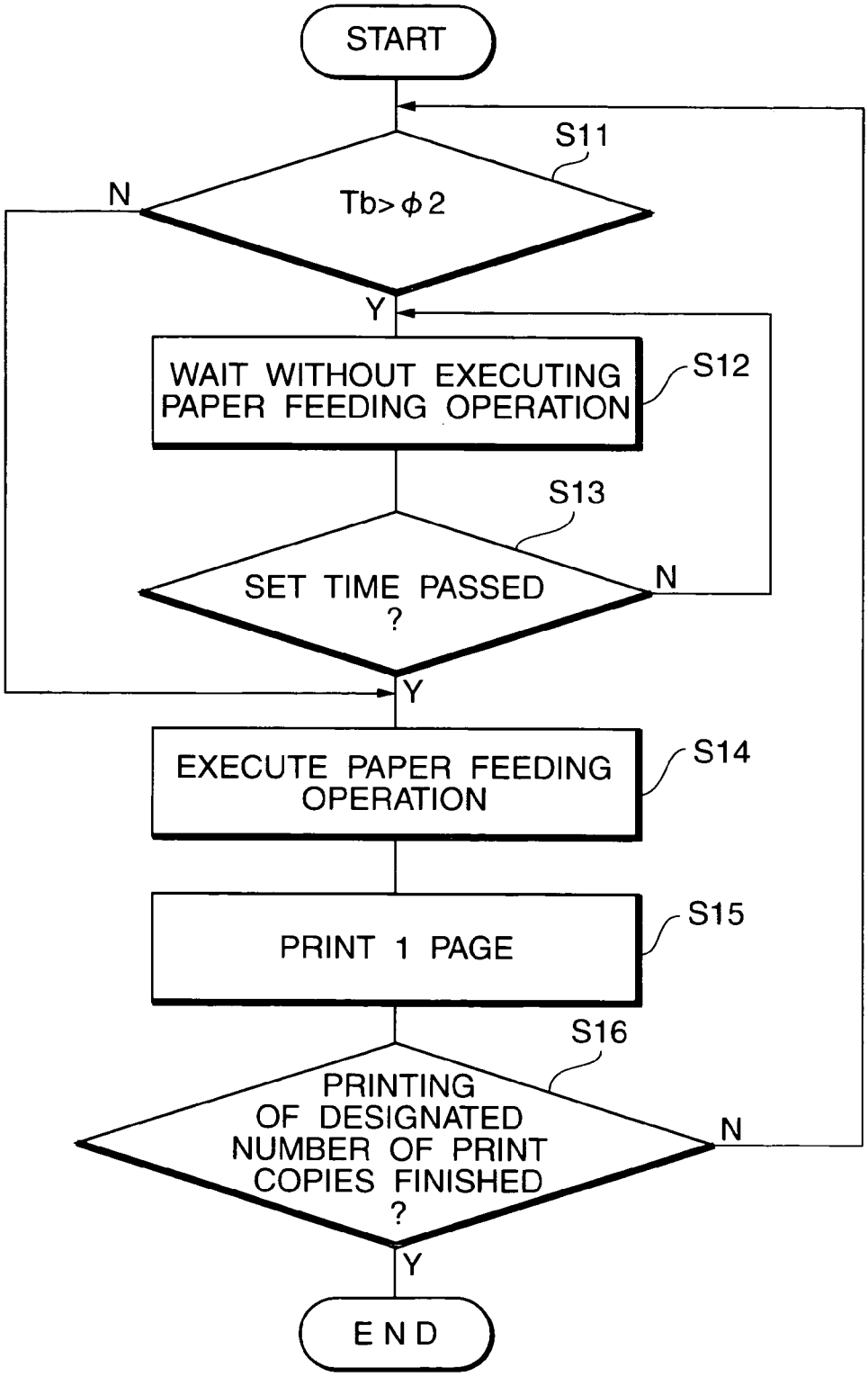
FIG. 10 is a flowchart showing the operation of a printer in the second embodiment of the invention.
Figure 11:
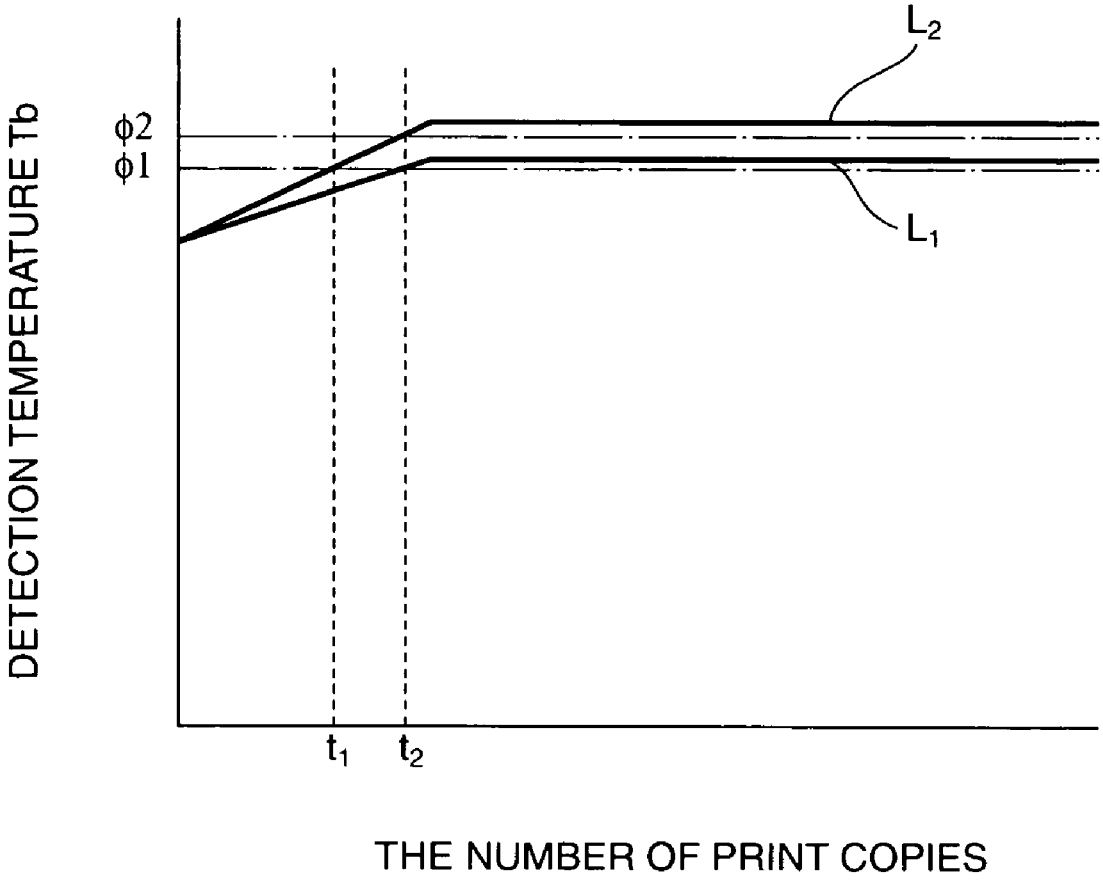
FIG. 11 is a waveform diagram showing the operation of the printer in the second embodiment of the invention.

FIG. 10 is a flowchart showing the operation of a printer in the second embodiment of the invention. FIG. 11 is a waveform diagram showing the operation of the printer in the second embodiment of the invention. In FIG. 11, an axis of abscissa indicates the number of print copies and an axis of ordinate shows the detection temperature Tb.

In the printer, as shown in FIG. 1, since the photosensitive drums 16Bk (FIG. 1), 16Y, 16M, and 16C as image holding materials and the temperature detecting sensor 88 as a temperature detecting unit are arranged so as to be away from each other, the surface temperatures of the photosensitive drums 16Bk, 16Y, 16M, and 16C and the detection temperature Tb do not perfectly coincide. Actually, the detection temperature Tb is higher than the temperatures of the photosensitive drums 16Bk, 16Y, 16M, and 16C by a few degrees (Δt [° C.]) due to the structure of the printer, the setting position of the cooling means (for example, fan apparatus for cooling), a structure of an exhaust duct, and the like.

That is, when the surface temperatures of the photosensitive drums 16Bk, 16Y, 16M, and 16C change as shown by a solid line L1 in FIG. 11 in association with an increase in number of print copies, the detection temperature Tb changes as shown by a solid line L2. Therefore, at timing t1 when the detection temperature Tb is higher than the threshold value ϕ1, the temperatures of the photosensitive drums 16Bk, 16Y, 16M, and 16C are lower than the threshold value ϕ1.

Therefore, the temperature discrimination processing means of the control circuit 61 executes the temperature discriminating process, corrects a threshold value ϕ2 by adding a predetermined offset value for correction (Δt [° C.]) thereto, and discriminates whether the detection temperature Tb is higher than the threshold value ϕ2 (ϕ2 >ϕ1) (in the embodiment, 50+Δt [° C.]) or not. If the detection temperature Tb is higher than the threshold value ϕ2, the standby mode setting processing means of the control circuit 61 executes the standby mode setting process, does not execute the paper feeding operation as a recording medium supplying operation by the paper feeding mechanism 36, and waits for the start of the printing process until the set time τ (20 seconds in the embodiment) passes.

When the offset value for correction is equal to 10 [° C.], the temperature detection processing means of the control circuit 61 discriminates whether the detection voltage is higher than 3.079[V] or not in order to discriminate whether the detection temperature Tb is higher than 60 [° C.] or not on the basis of the temperature table in FIG. 5.

In this case, as shown in FIG. 11, since the detection temperature Tb is higher than the threshold value ϕ2 at timing t2 when the surface temperatures of the photosensitive drums 16Bk, 16Y, 16M, and 16C are higher the threshold value ϕ1, the standby mode setting processing means can properly executes the standby mode setting process. A margin is also included in the threshold value ϕ2.

In this case, since it is sufficient to add the offset value for correction to the threshold value ϕ1, a temperature table similar to that in the first embodiment can be used. Therefore, the costs of the image forming apparatus can be reduced.

Since the threshold value is changed in dependence on the structure of the printer, the setting position of the cooling means, the structure of the exhaust duct, and the like, the standby mode setting process can be executed at a temperature near the temperatures of the photosensitive drums 16Bk, 16Y, 16M, and 16C as close as possible. Consequently, the image quality can be further improved.

Although the threshold value ϕ2 is corrected by adding the predetermined offset value for correction thereto in the embodiment, the detection temperature Tb can be corrected by subtracting the offset value for correction from the detection temperature Tb.

The flowchart of FIG. 10 will now be described.

Step S11: Whether the detection temperature Tb is higher than the threshold value ϕ2 or not is discriminated. If the detection temperature Tb is higher than the threshold value ϕ2, step S12 follows. If the detection temperature Tb is equal to or lower than the threshold value ϕ2, step S14 follows.

Step S12: The paper feeding operation is not executed but the printer enters the standby mode.

Step S13: Whether the set time τ has passed or not is discriminated. If the set time τ has passed, step S14 follows. If the set time τ does not pass, the processing routine is returned to step S12.

Step S14: The paper feeding operation is executed.

Step S15: The printing of one page is performed.

Step S16: Whether the printing of the designated number of print copies has been finished or not is discriminated. If the printing of the designated number of print copies has been finished, the processing routine is finished. If the printing of the designated number of print copies is not finished, the processing routine is returned to step S11.

The third embodiment of the invention in which the different offset value for correction is set every temperature will now be described.

Figure 12:
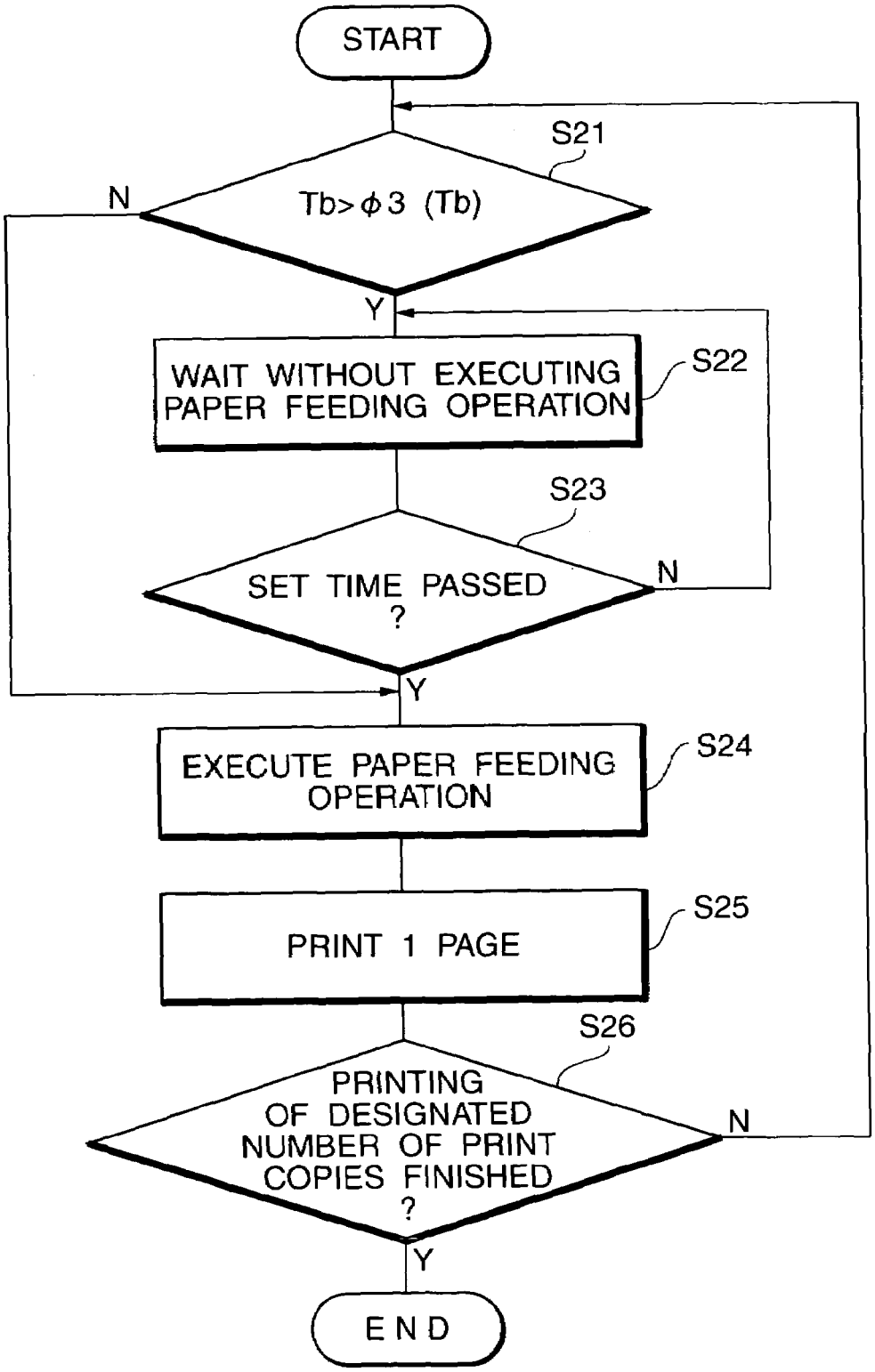
FIG. 12 is a flowchart showing the operation of a printer in the third embodiment of the invention.
Figure 13:
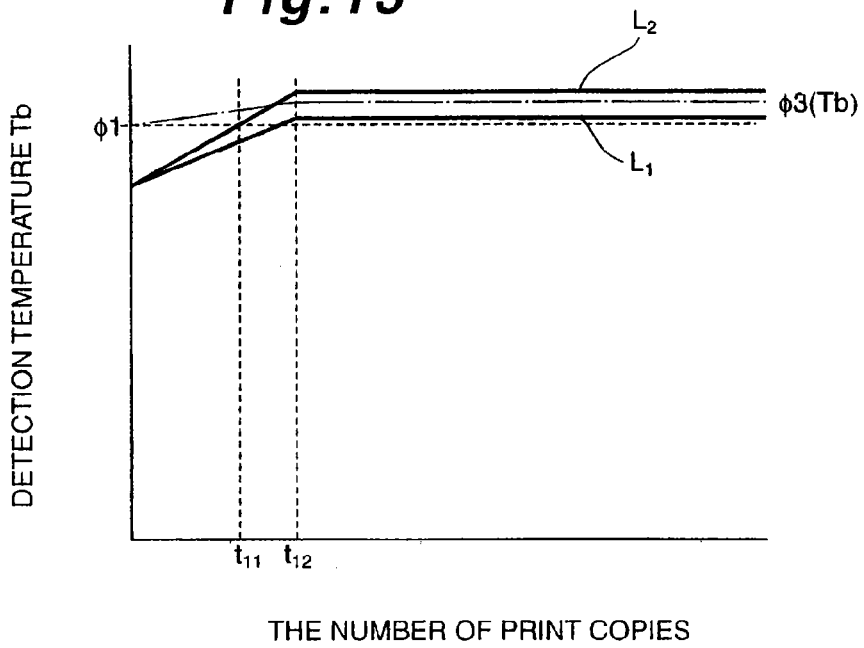
FIG. 13 is a waveform diagram showing the operation of the printer in the third embodiment of the invention.

FIG. 12 is a flowchart showing the operation of a printer in the third embodiment of the invention. FIG. 13 is a waveform diagram showing the operation of the printer in the third embodiment of the invention. In FIG. 13, an axis of abscissa indicates the number of print copies and an axis of ordinate shows the detection temperature Tb.

In an elevating area before the surface temperatures of the photosensitive drums 16Bk (FIG. 1), 16Y, 16M, and 16C as image holding materials and the detection temperature Tb are saturated, if the uniform offset value for correction is set, there is a case where the surface temperatures of the photosensitive drums 16Bk, 16Y, 16M, and 16C and the detection temperature Tb do not coincide. That is, when the printing is started and the control of the fixing device 48 as a fixing unit is started, since the arranging positions of the photosensitive drums 16Bk, 16Y, 16M, and 16C and the arranging position of the temperature detecting sensor 88 differ, the surface temperatures of the photosensitive drums 16Bk, 16Y, 16M, and 16C and the detection temperature Tb rise toward different saturation temperatures at different temperature gradients. Since the temperature discriminating process is executed in association with it, it is preferable to use the offset values for correction which have been set in correspondence to the temperatures of the photosensitive drums 16Bk, 16Y, 16M, and 16C and the detection temperature Tb.

That is, when the temperatures of the photosensitive drums 16Bk, 16Y, 16M, and 16C change as shown by the solid line L1 in FIG. 13 in association with an increase in number of print copies, the detection temperature Tb changes as shown by the solid line L2. Therefore, at timing t11 when the detection temperature Tb is higher than the threshold value ϕ1, the temperatures of the photosensitive drums 16Bk, 16Y, 16M, and 16C are lower than the threshold value ϕ1.

In the embodiment, the different offset value for correction Δt (Tb) is set every detection temperature Tb and a temperature table set every offset value for correction Δt (Tb) is recorded into the ROM. Therefore, a threshold value ϕ3 (Tb)

$$\phi 3(Tb)=\phi 1+\Delta t(Tb)$$

is changed in accordance with a change in detection temperature Tb.

The temperature of the conveying belt 20 as a belt and the temperature of the photosensitive drum 16C are preliminarily detected by experiments until each temperature is saturated, a difference between the detected temperatures is calculated, the difference is made to correspond to the temperature of the conveying belt 20, and the temperature table is formed. In this case, the offset value for correction Δt (Tb) is gradually increased and set to a predetermined value (maximum value) when the temperature of the conveying belt 20 reaches the saturation temperature. A margin is also included in the threshold value ϕ3 (Tb).

In this case, as shown in FIG. 13, since the detection temperature Tb is higher than the threshold value ϕ3 (Tb) at timing t12 when the temperatures of the photosensitive drums 16Bk, 16Y, 16M, and 16C are higher than the threshold value ϕ1, the standby mode setting processing means of the control circuit 61 can properly execute the standby mode setting process.

Since the threshold value ϕ3 (Tb) is changed in accordance with the change in temperatures of the photosensitive drums 16Bk, 16Y, 16M, and 16C and the change in detection temperature Tb as mentioned above, the standby mode setting process can be executed at a temperature near the temperatures of the photosensitive drums 16Bk, 16Y, 16M, and 16C as close as possible. Consequently, the image quality can be further improved.

Although the threshold value ϕ3 (Tb) is changed in correspondence to the detection temperature Tb in the embodiment, the detection temperature Tb can be changed in correspondence to the detection temperature Tb itself.

The flowchart of FIG. 12 will now be described.

Step S21: Whether the detection temperature Tb is higher than the threshold value ϕ3 (Tb) or not is discriminated. If the detection temperature Tb is higher than the threshold value ϕ3 (Tb), step S22 follows. If the detection temperature Tb is equal to or lower than the threshold value ϕ3 (Tb), step S24 follows.

Step S22: The paper feeding operation is not executed but the printer enters the standby mode.

Step S23: Whether the set time τ has passed or not is discriminated. If the set time τ has passed, step S24 follows. If the set time τ does not pass, the processing routine is returned to step S22.

Step S24: The paper feeding operation is executed.

Step S25: The printing of one page is performed.

Step S26: Whether the printing of the designated number of print copies has been finished or not is discriminated. If the printing of the designated number of print copies has been finished, the processing routine is finished. If the printing of the designated number of print copies is not finished, the processing routine is returned to step S21.

The fourth embodiment of the invention will now be described.

Figure 14:
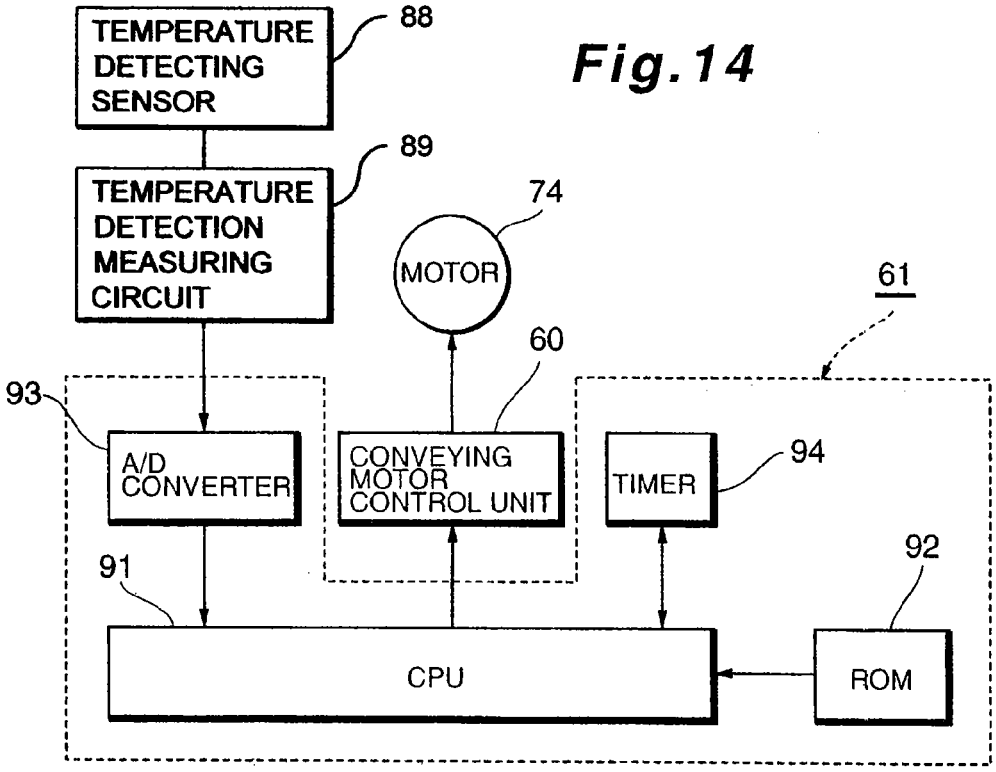
FIG. 14 is a block diagram showing a main section of a printer in the fourth embodiment of the invention.

FIG. 14 is a block diagram showing a main section of a printer in the fourth embodiment of the invention. In the diagram, reference numeral 60 denotes the conveying motor control unit 60; 61 the control circuit; 74 the motor as driving means for running the belt; 88 the temperature detecting sensor as a temperature detecting unit; and 89 the temperature detection measuring circuit. The control circuit 61 comprises: a CPU 91; a ROM 92 in which programs for executing various processes have been recorded; an A/D converter 93 as an A/D converting device for converting the analog detection voltage read out from the temperature detection measuring circuit 89 into a digital value; and a timer 94 as a timer device for measuring a movement amount of the conveying belt 20 (FIG. 1) as a belt or a drive time of the motor 74.

In the first to third embodiments, when the driving of the motor 74 is started and the running of the conveying belt 20 is started, a fluctuation occurs in the detection temperature Tb.

That is, in the printer with the above structure, when the temperature of the fixing device 48 as a fixing unit reaches a set temperature (100 [° C.] in the embodiment), the heating roller 49 is rotated. However, until the detection temperature Tb reaches a predetermined printable temperature, the conveying belt 20 is not run but stopped. For such a period of time, a portion of the conveying belt 20 from the photosensitive drum 16C to the position closest to the fixing device 48 receives the heat from the heating roller 49 and its temperature is raised. Moreover, since a specific heat of the conveying belt 20 is smaller than that of the photosensitive drum 16C, before the running of the conveying belt 20 is started, such a portion receives the heat from the heating roller 49 and its temperature rapidly rises.

On the other hand, since the specific heat of the photosensitive drum 16C is large, even if it receives the heat from the heating roller 49, its temperature does not rise rapidly. Therefore, when such a portion which has received the heat from the heating roller 49 reaches the temperature detecting sensor 88, the detection temperature Tb of the temperature detecting sensor 88 rapidly rises and reaches a first peak value within a few seconds. Since a temperature difference between such a portion and a portion which is in contact with the photosensitive drum 16C and never runs near the fixing device 48 is large, the fluctuation in the detection temperature Tb is extremely large until the conveying belt 20 makes a rotation.

Therefore, if the temperature discriminating process is executed just after the printing process is started, the detection temperature Tb becomes higher than the threshold values ϕ1, ϕ2, and ϕ3 (Tb) just after the start of the running of the conveying belt 20. Thus, the standby mode setting process is executed from the first page of the printing and the printer enters the standby mode.

To prevent it, in the embodiment, the temperature discriminating process is executed after the fluctuation in detection temperature Tb was settled.

Figure 15:
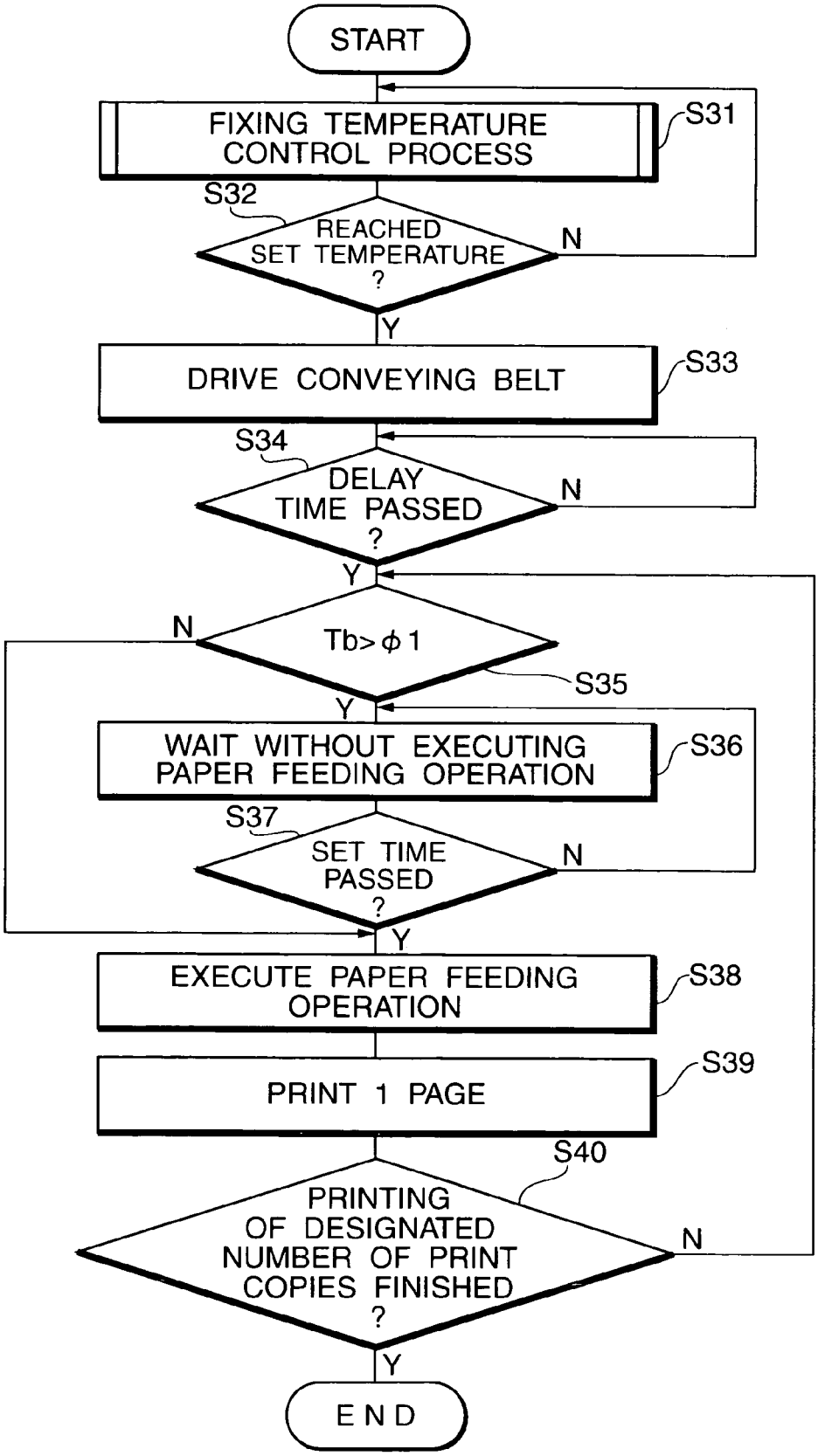
FIG. 15 is a flowchart showing the operation of the printer in the fourth embodiment of the invention.

FIG. 15 is a flowchart showing the operation of the printer in the fourth embodiment of the invention.

In this case, fixing temperature control processing means of the control circuit 61 executes a fixing temperature control process and continuously energizes the heater (not shown) until the temperature of the fixing device 48 (FIG. 1) reaches the set temperature. Then, because the time that the detection temperature Tb reaches the first peak is several seconds, the temperature discrimination processing means of the control circuit 61 executes the following temperature discriminating process. That is, after the conveying belt 20 starts to run; then the predetermined delay time (in the embodiment, 5 seconds in consideration of the margin) elapses; further when the temperature of the portion of the conveying belt 20, which is in contact with the temperature detecting sensor 88, becomes the lowest temperature, the temperature of the conveying belt 20 is detected. Then, whether the detection temperature Tb is higher than the threshold value $\phi$1 (although the threshold value $\phi$1 is used in the embodiment, the threshold value $\phi$2 or $\phi$3 (Tb) can be also used) or not is discriminated.

The delay time can be obtained by a method whereby the elapsed time from the start of the driving of the motor 74 is measured by the timer 94 (FIG. 14) or a method whereby an interruption is caused in the CPU 91 in correspondence to a rotating time of one line period of the motor 74 and a count value of the number of interruption times is measured. Although the delay time has been set to 5 seconds in the embodiment, it can be changed in accordance with the structure of the printer, materials of the component elements constructing the printer, and the like.

Since the temperature discriminating process is not executed until the elapse of the delay time after the start of the driving of the motor 74 as mentioned above, detecting precision of the detection temperature Tb can be raised. Therefore, it is possible to prevent the printer from entering the standby mode from the first page of the printing.

The flowchart of FIG. 15 will now be described.

Step S31: The fixing temperature control process is executed.

Step S32: Whether the temperature of the fixing device 48 has reached the set temperature or not is discriminated. If it has reached the set temperature, step S33 follows. If it does not reach the set temperature, the processing routine is returned to step S31.

Step S33: The conveying belt 20 is run.

Step S34: The apparatus waits until the delay time passes. When the delay time passes, step S35 follows.

Step S35: Whether the detection temperature Tb is higher than the threshold value $\phi$1 or not is discriminated. If the detection temperature Tb is higher than the threshold value $\phi$1, step S36 follows. If the detection temperature Tb is equal to or lower than the threshold value $\phi$1, step S38 follows.

Step S36: The paper feeding operation is not executed but the printer enters the standby mode.

Step S37: Whether the set time $\tau$ has passed or not is discriminated. If the set time $\tau$ has passed, step S38 follows. If the set time $\tau$ does not pass, the processing routine is returned to step S36.

Step S38: The paper feeding operation is executed.

Step S39: The printing of one page is performed.

Step S40: Whether the printing of the designated number of print copies has been finished or not is discriminated. If the printing of the designated number of print copies has been finished, the processing routine is finished. If the printing of the designated number of print copies is not finished, the processing routine is returned to step S35.

In the fourth embodiment, since the time necessary until the fluctuation in detection temperature Tb is perfectly settled is set as a delay time, the conveying belt 20 is run by almost the half round until the start of the temperature discriminating process. Therefore, the timing to start the printing process is delayed and the printing time becomes long.

The fifth embodiment of the invention in which the printing time can be shortened, therefore, will now be described.

Figure 16:
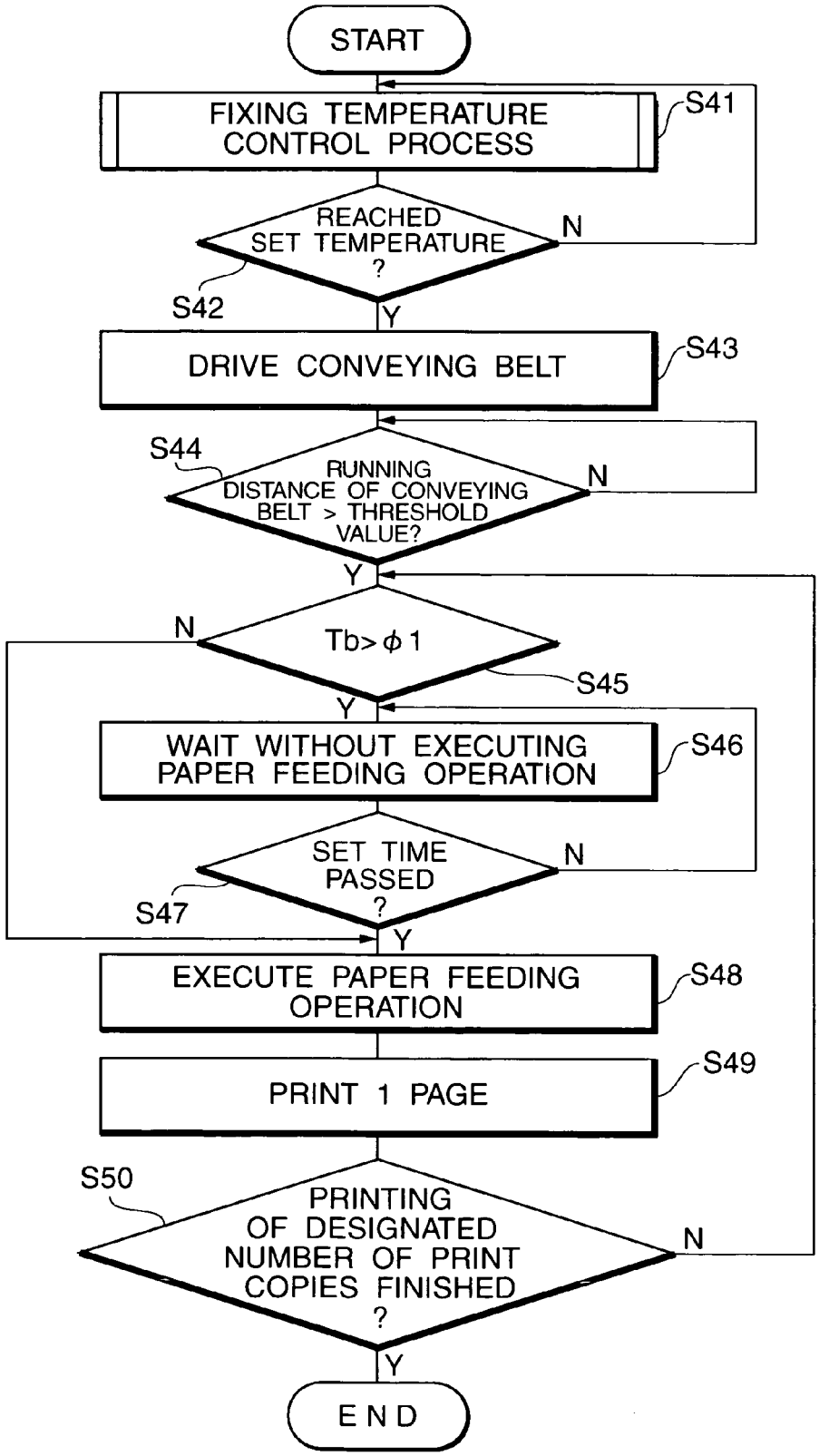
FIG. 16 is a flowchart showing the operation of a printer in the fifth embodiment of the invention.

FIG. 16 is a flowchart showing the operation of a printer in the fifth embodiment of the invention.

In this case, after the detection temperature Tb reached the first peak value; then when the temperature of the portion of the conveying belt 20 (FIG. 1) serving as a belt, which is contacted by the temperature detecting sensor 88 serving as a temperature detecting unit, almost becomes equal to the actual temperature of the photosensitive drum 16C, a predetermined point on the conveying belt 20, which serves as a start point of the temperature discriminating process, is found. Further, a running distance of the conveying belt 20, from that the conveying belt 20 starts to run to that the start point of the temperature discriminating process reaches the temperature detecting sensor 88, is set as a threshold value $\phi$ (in the embodiment, 80 to 120 [mm] in consideration of the margin).

Moreover, the start point of the temperature discriminating process is set to a position closest to the photosensitive drum 16C where while the heater of the fixing device 48 as a fixing unit is energized, the start point is not directly influenced by the heat from the heater on the upstream side of the photosensitive drum 16C in the conveying direction of the recording medium 21.

The fixing temperature control processing means of the control circuit 61 executes the fixing temperature control process and continuously energizes the heater until the temperature of the fixing device 48 reaches the set temperature. Subsequently, the temperature discrimination processing means of the control circuit 61 executes the temperature discriminating process. After the running of the conveying belt 20 was started, when the running distance is longer than the threshold value $\phi$ and the temperature of the portion of the conveying belt 20 which is come into contact with the temperature detecting sensor 88 is equal to the temperature of the photosensitive drum 16C, the temperature of the conveying belt 20 is detected. Whether the detection temperature Tb is higher than the threshold value $\phi$1 (although the threshold value $\phi$1 is used in the embodiment, the threshold value $\phi$2 or $\phi$3 (Tb) can be also used) or not is discriminated.

Since the temperature discriminating process is started when the temperature of the portion of the conveying belt 20 which is come into contact with the temperature detecting sensor 88 is equal to the temperature of the photosensitive drum 16C as mentioned above, the situation such that the conveying belt 20 is run by almost the half round for such a period of time is eliminated. Therefore, the timing to start the printing process is made early and the printing time can be shortened.

The flowchart of FIG. 16 will now be described.

Step S41: The fixing temperature control process is executed.

Step S42: Whether the temperature of the fixing device 48 has reached the set temperature or not is discriminated. If it has reached the set temperature, step S43 follows. If it does not reach the set temperature, the processing routine is returned to step S41.

Step S43: The conveying belt 20 is run.

Step S44: The apparatus waits until the running distance of the conveying belt 20 is longer than the threshold value ϕ. If the running distance of the conveying belt 20 is longer than the threshold value ϕ, step S45 follows.

Step S45: Whether the detection temperature Tb is higher than the threshold value ϕ1 or not is discriminated. If the detection temperature Tb is higher than the threshold value ϕ1, step S46 follows. If the detection temperature Tb is equal to or lower than the threshold value ϕ1, step S48 follows.

Step S46: The paper feeding operation is not executed but the printer enters the standby mode.

Step S47: Whether the set time τ has passed or not is discriminated. If the set time τ has passed, step S48 follows. If the set time τ does not pass, the processing routine is returned to step S46.

Step S48: The paper feeding operation is executed.

Step S49: The printing of one page is performed.

Step S50: Whether the printing of the designated number of print copies has been finished or not is discriminated. If the printing of the designated number of print copies has been finished, the processing routine is finished. If the printing of the designated number of print copies is not finished, the processing routine is returned to step S45.

In general, if the user tries to detect the temperature by the thermistor, not only there are a detection error of ± a few degrees but also noises of a degree similar to the detection error are generated in the temperature detection measuring circuit 89 (FIG. 3). Thus, the detection temperature Tb fluctuates at a high speed on the order of a few [nsec] to a few [msec].

On the other hand, since the temperatures of the photosensitive drums 16Bk, 16Y, 16M, and 16C as image holding materials do not actually suddenly change, for example, they change at an ordinary sampling period by using the timer, generally, on the order of a few [msec] and up to a few [sec]. Therefore, if the detection temperature Tb is detected at a short sampling period of a few [nsec] to a few [msec], there is a case where the errors increase and the temperature exceeds 10 [° C.]. Thus, the standby mode setting process cannot be accurately executed and the image quality deteriorates.

The sixth embodiment of the invention in which the fluctuation of the detection temperature Tb is suppressed, therefore, will now be described.

Figure 17:
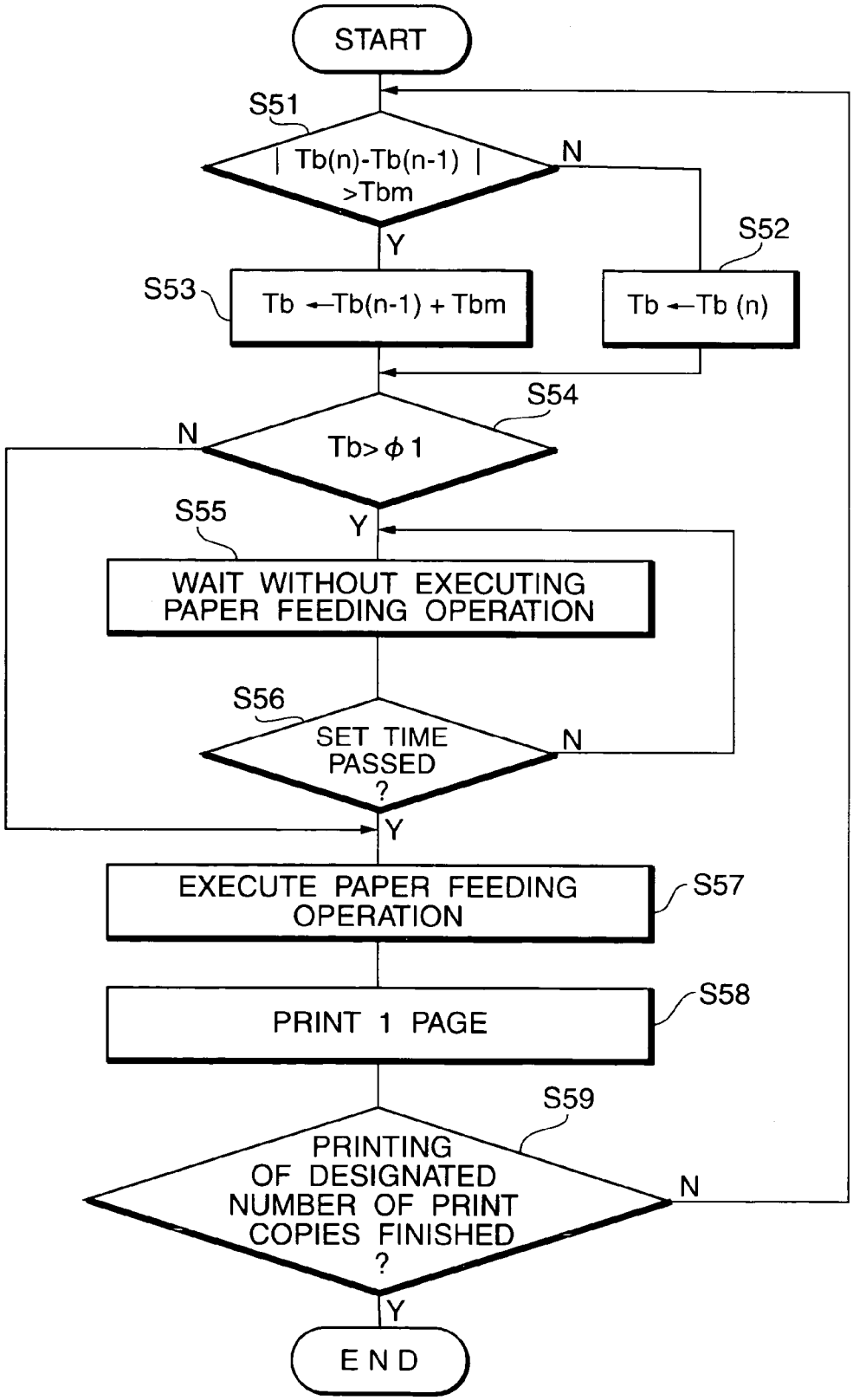
FIG. 17 is a flowchart showing the operation of a printer in the sixth embodiment of the invention.
Figure 18:
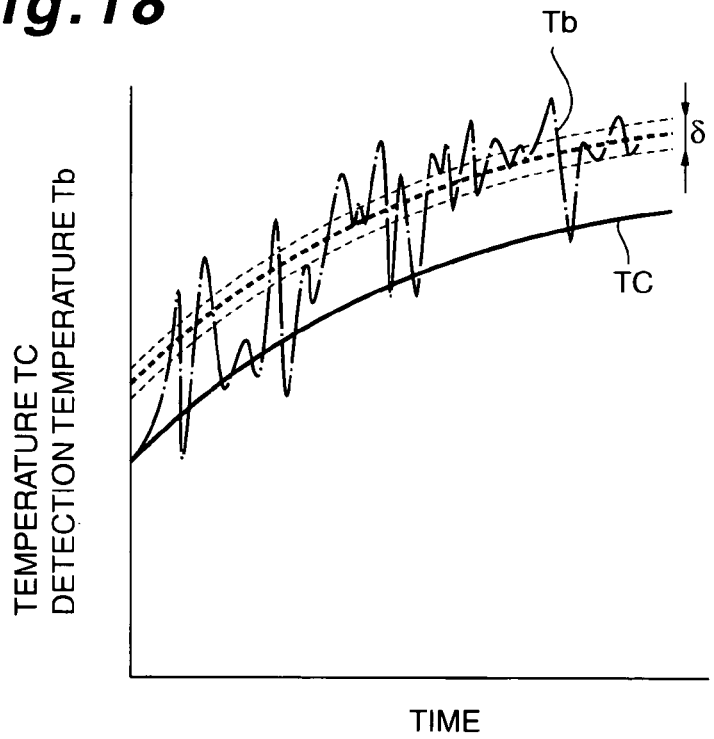
FIG. 18 is a waveform diagram of a temperature in the sixth embodiment of the invention.

FIG. 17 is a flowchart showing the operation of a printer in the sixth embodiment of the invention. FIG. 18 is a waveform diagram of a temperature in the sixth embodiment of the invention. In FIG. 18, an axis of abscissa indicates a time and an axis of ordinate shows a temperature.

In this case, in FIG. 18, TC denotes a temperature of the photosensitive drum 16C as an image holding material and Tb shows the detection temperature of the conveying belt 20 as a belt. On the basis of a prerequisite condition that the fluctuation of the temperature of the photosensitive drum 16C is small, the fluctuation amount of the detection temperature Tb is limited so that the detection temperature Tb changes within a range of a value δ at the same gradient as that of the temperature of the photosensitive drum 16C.

For this purpose, detection temperature limitation processing means (not shown) of the control circuit 61 executes a detection temperature limiting process and sets the sampling period to be long. When sampling values of the detection temperature Tb are assumed to be Tb(i) (i=1, 2, . . . , n−1, n, . . . ), whether an absolute value of a difference between the present sampling value Tb(n) and the previous sampling value Tb(n−1) is larger than a preset limit value Tbm or not is discriminated. If the absolute value is larger than the limit value Tbm, the detection temperature Tb is set to the value obtained by adding the limit value Tbm to the previous sampling value Tb(n−1). If the absolute value is equal to or smaller than the limit value Tbm, the detection temperature Tb is set to the present sampling value Tb(n).

Generally, the sampling period of the timer which is used for sampling is equal to about 100 [msec]. Assuming that the limit value of the change in detection temperature Tb in one sampling is equal to 0.1 [° C.], the detection temperature Tb rises by $$0.1[^\circ\ C.]\times 10=1[^\circ\ C.]$$

for 10 sampling times (100 [msec]×10=1 [sec]).

Actually, since the detection temperature Tb rises by about 20 [° C.] for about one hour, the limit value Tbm of the detection temperature Tb when the sampling period is set to 100 [msec] becomes as follows.

$$Tbm=(20[^\circ\ C.]/3600[sec])/10 \text{ times } ®0.00056[^\circ\ C.]$$

Although the limit value Tbm is a value at the time when the printing is continuously executed, since various cases are actually considered, it cannot be unconditionally fixed to such a value. Therefore, the limit value Tbm is set to a value which is larger than the above value by a predetermined value so that even if the detection temperature Tb changes suddenly, it is possible to cope with it.

Since the fluctuation amount of the detection temperature Tb is suppressed in accordance with the characteristics of the printer as mentioned above, the detection temperature Tb does not fluctuate more than it is needed. Therefore, a situation such that the standby mode is excessively and repetitively set in the standby mode setting process is eliminated. Thus, not only the printing time can be shortened but also a situation such that an uncomfortable feeling is given to the operator can be prevented.

The flowchart of FIG. 17 will now be described.

Step S51: Whether the absolute value of the difference between the present sampling value Tb(n) and the previous sampling value Tb(n−1) is larger than the limit value Tbm or not is discriminated. If the absolute value of the difference between the present sampling value Tb(n) and the previous sampling value Tb(n−1) is larger than the limit value Tbm, step S53 follows. If the absolute value of the difference between the present sampling value Tb(n) and the previous sampling value Tb(n−1) is equal to or smaller than the limit value Tbm, step S52 follows.

Step S52: The present sampling value Tb(n) is set into the detection temperature Tb.

Step S53: The value obtained by adding the limit value Tbm to the previous sampling value Tb(n−1) is set into the detection temperature Tb.

Step S54: Whether the detection temperature Tb is higher than the threshold value ϕ1 or not is discriminated. If the detection temperature Tb is higher than the threshold value ϕ1, step S55 follows. If the detection temperature Tb is equal to or lower than the threshold value ϕ1, step S57 follows.

Step S55: The paper feeding operation is not executed but the printer enters the standby mode.

Step S56: Whether the set time τ has passed or not is discriminated. If the set time τ has passed, step S57 follows. If the set time τ does not pass, the processing routine is returned to step S55.

Step S57: The paper feeding operation is executed.

Step S58: The printing of one page is performed.

Step S59: Whether the printing of the designated number of print copies has been finished or not is discriminated. If the printing of the designated number of print copies has been finished, the processing routine is finished. If the printing of the designated number of print copies is not finished, the processing routine is returned to step S51.

Since the sampling period is set to be long in the sixth embodiment, there is a case where a sudden temperature change is accidentally detected by the temperature detecting sensor 88 due to a temperature fluctuation occurring locally in the conveying belt 20, a variation in running state of the conveying belt 20, or the like. Thus, the detecting precision of the temperature detecting sensor 88 deteriorates.

The seventh embodiment in which the temperature of the conveying belt 20 is detected at a relatively short sampling period on the order of a few [msec] and predetermined weights are added to the past and present detection temperatures, thereby correcting the detection temperature Tb, therefore, will now be described.

In this case, the temperature is assumed to be the detection temperature Tb after the correction, and when the detection temperature Tb is determined, assuming that a weight of an influence which is exercised by the previous sampling value Tb(n−1) is set to A and a weight of an influence which is exercised by the present sampling value Tb(n) is set to B, the detection temperature Tb becomes as follows.

$$Tb=A\cdot Tb(n-1)+B\cdot Tb(n)$$

Figure 19:
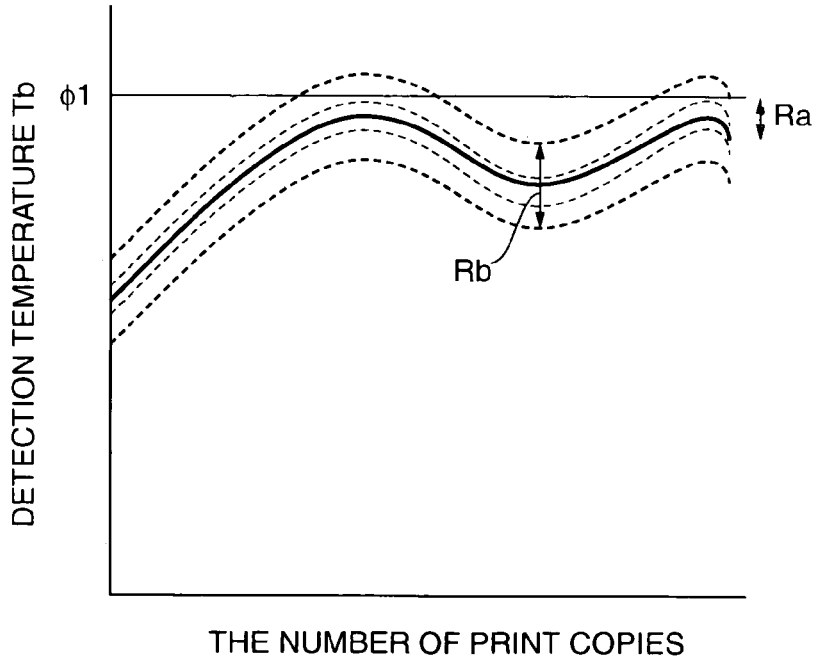
FIG. 19 is a diagram showing a fluctuation in detection temperature in the seventh embodiment of the invention.

FIG. 19 is a diagram showing a fluctuation in detection temperature in the seventh embodiment of the invention. In the diagram, an axis of abscissa denotes the number of print copies and an axis of ordinate indicates the detection temperature Tb and the temperature TC.

In the diagram, Ra denotes a fluctuation width of the detection temperature Tb when the weights A and B are set to

A=0.95

B=0.05 and Rb denotes a fluctuation width of the detection temperature Tb when the weights A and B are set to

A=0.90

B=0.10

The weights A and B

A=0.95

B=0.05 are values in which it is determined by experiments that while the standby mode setting process is executed, the detection temperature Tb is certainly equal to or smaller than the threshold value ϕ1 (or the threshold value ϕ2 or ϕ3 (Tb)). If the weights A and B are set to

A=0.90

B=0.10 or

A=0.80

B=0.20, while the standby mode setting process is executed, the detection temperature Tb becomes higher than the threshold values ϕ1, ϕ2, and ϕ3 (Tb). The weights A and B can be changed in accordance with the structure of the printer, materials of the component elements constructing the printer, and the like.

Since the fluctuation amount of the detection temperature Tb is suppressed in accordance with the characteristics of the printer, the detection temperature Tb does not fluctuate too much. Therefore, a situation such that the standby mode is excessively and repetitively set in the standby mode setting process is eliminated. Thus, not only the printing time can be shortened but also a situation such that an uncomfortable feeling is given to the operator can be prevented.

While the conveying belt 20 as a belt is stopped as mentioned above, the portion of the conveying belt 20 from the photosensitive drum 16C as an image holding material to a position closest to the fixing device 48 as a fixing unit receives the heat from the heating roller 49 and its temperature is raised. Moreover, since the specific heat of the conveying belt 20 is smaller than that of the photosensitive drum 16C, before the running of the conveying belt 20 is started, such a portion receives the heat from the heating roller 49 and its temperature rapidly rises. Thus, the detecting precision of the detection temperature Tb by the temperature detecting sensor 88 as a temperature detecting unit deteriorates.

The eighth embodiment in which in the case of executing the temperature discriminating process just after the running of the conveying belt 20 was started, the threshold value is set to be larger than that when the running of the conveying belt 20 is continued, therefore, will now be described.

Figure 20:
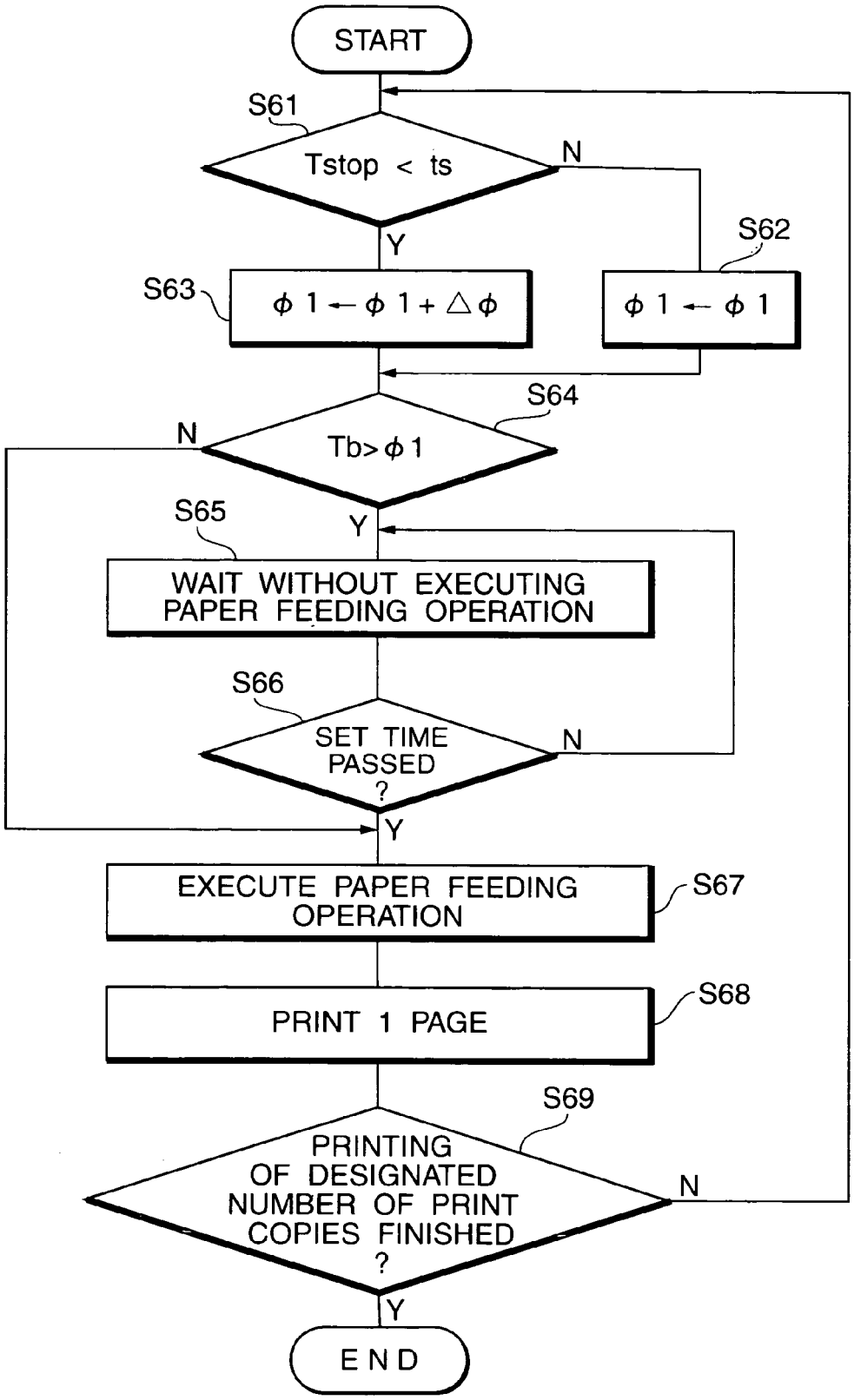
FIG. 20 is a flowchart showing the operation of a printer in the eighth embodiment of the invention.
Figure 21:
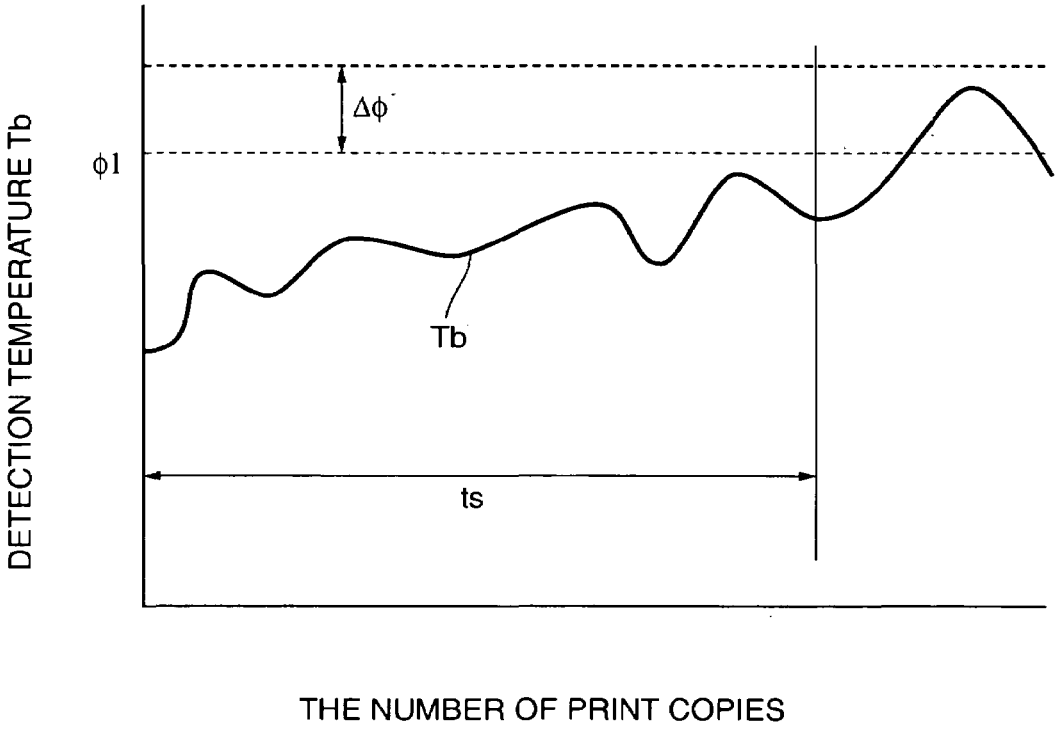
FIG. 21 is a waveform diagram of a temperature in the eighth embodiment of the invention.

FIG. 20 is a flowchart showing the operation of a printer in the eighth embodiment of the invention. FIG. 21 is a waveform diagram of a temperature in the eighth embodiment of the invention. In FIG. 21, an axis of abscissa indicates the number of print copies and an axis of ordinate shows the detection temperature Tb.

The detection temperature Tb is higher than the temperature of the photosensitive drum 16C (FIG. 1) as an image holding material, for example, within 30 seconds after the motor 74 was stopped.

The temperature discrimination processing means of the control circuit 61 executes the temperature discriminating process, starts the time counting operation of the timer 94 (FIG. 14) as a time counting member in association with the stop of the motor 74 as driving means for running the belt, and discriminates whether an elapsed time Tstop from the stop of the motor 74 is shorter than a set value ts or not. If the elapsed time Tstop is shorter than the set value ts, a value obtained by adding an adjustment value Δϕ (in the embodiment, 2 [° C.]) to the ordinary threshold value ϕ1 (in the embodiment, 50 [° C.]) is set to the threshold value ϕ1. If the elapsed time Tstop is equal to or larger than the set value ts, the threshold value ϕ1 is set to the threshold value ϕ1 and whether the detection temperature Tb is higher than the threshold value ϕ1 or not is discriminated. The set value ts and the adjustment value Δϕ are changed in accordance with the structure of the printer, materials of the component elements constructing the printer, and the like.

Since the threshold value ϕ1 is set to be high when the temperature discriminating process is executed just after the start of the running of the conveying belt 20 as a belt, a situation such that the standby mode is excessively and repetitively set in the standby mode setting process is eliminated. Thus, not only the printing time can be shortened but also a situation such that an uncomfortable feeling is given to the operator can be prevented.

The flowchart of FIG. 20 will now be described.

Step S61: Whether the elapsed time Tstop is shorter than the set value ts or not is discriminated. If the elapsed time Tstop is shorter than the set value ts, step S63 follows. If the elapsed time Tstop is equal to or larger than the set value ts, step S62 follows.

Step S62: The threshold value $\phi$1 is set into the threshold value $\phi$1.

Step S63: The value obtained by adding the adjustment value $\Delta\phi$ to the threshold value $\phi$1 is set into the threshold value $\phi$1.

Step S64: Whether the detection temperature Tb is higher than the threshold value $\phi$1 or not is discriminated. If the detection temperature Tb is higher than the threshold value $\phi$1, step S65 follows. If the detection temperature Tb is equal to or smaller than the threshold value $\phi$1, step S67 follows.

Step S65: The paper feeding operation is not executed but the printer enters the standby mode.

Step S66: Whether the set time $\tau$ has passed or not is discriminated. If the set time $\tau$ has passed, step S67 follows. If the set time $\tau$ does not pass, the processing routine is returned to step S65.

Step S67: The paper feeding operation is executed.

Step S68: The printing of one page is performed.

Step S69: Whether the printing of the designated number of print copies has been finished or not is discriminated. If the printing of the designated number of print copies has been finished, the processing routine is finished. If the printing of the designated number of print copies is not finished, the processing routine is returned to step S61.

The ninth embodiment of the invention will now be described.

Figure 22:
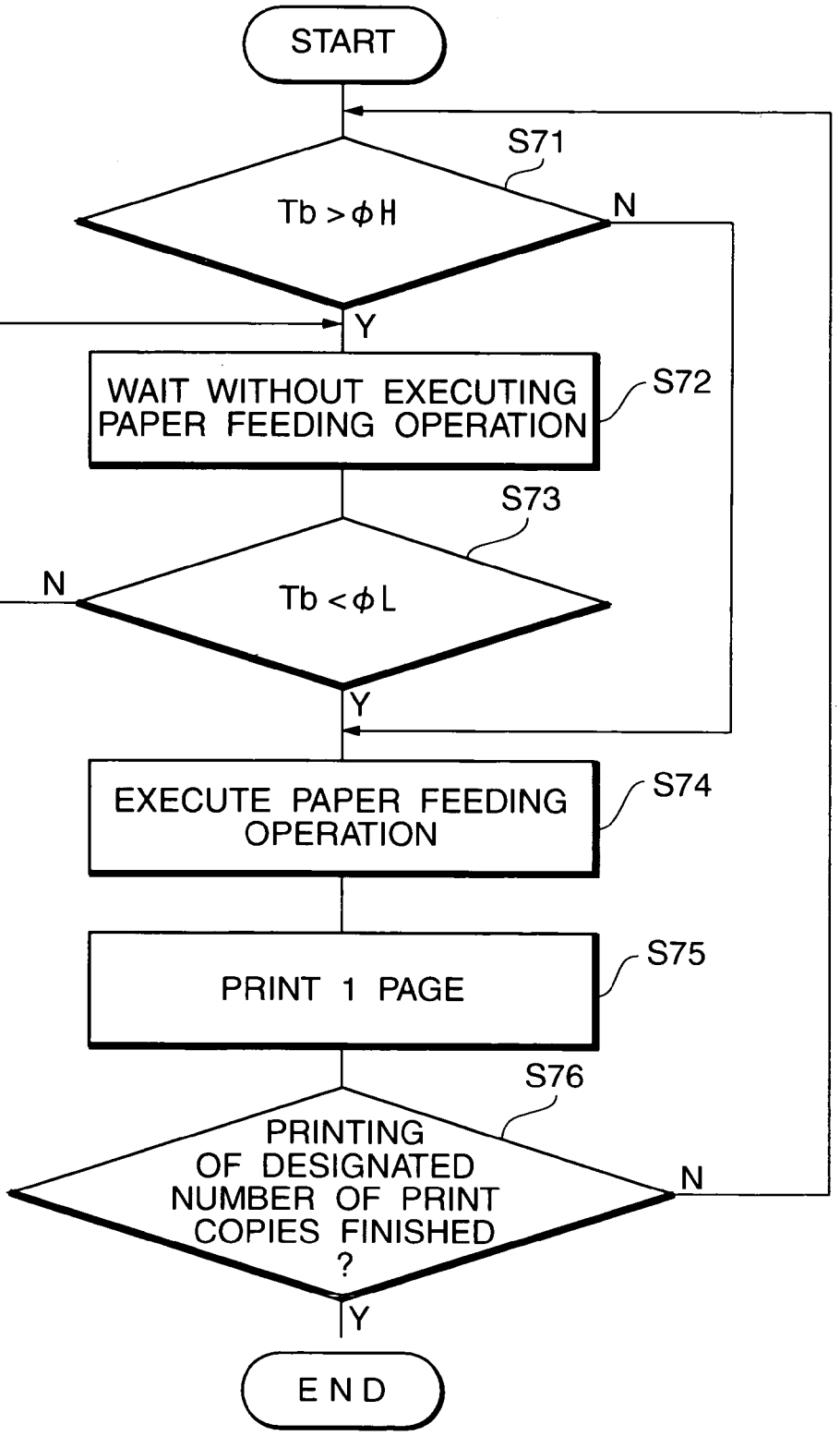
FIG. 22 is a flowchart showing the operation of a printer in the ninth embodiment of the invention.
Figure 23:
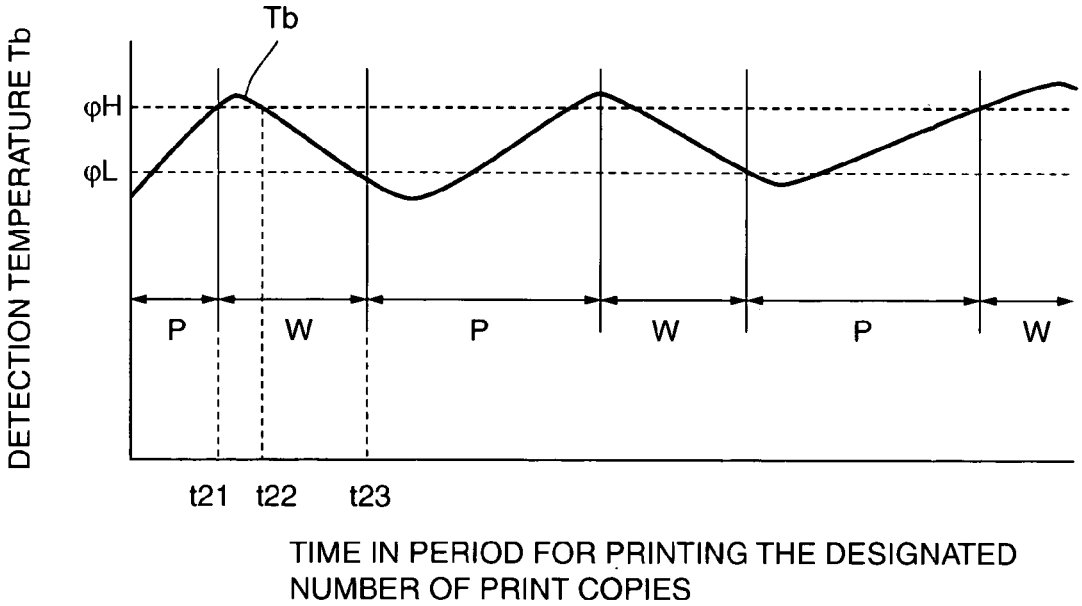
FIG. 23 is a waveform diagram of a temperature in the ninth embodiment of the invention.

FIG. 22 is a flowchart showing the operation of a printer in the ninth embodiment of the invention. FIG. 23 is a waveform diagram of a temperature in the ninth embodiment of the invention. In FIG. 23, an axis of abscissa indicates a time in a period for printing the designated number of print copies and an axis of ordinate shows the detection temperature Tb.

In this case, a threshold value $\phi$H to set the standby mode and a threshold value $\phi$L ($\phi L<\phi H$) to start the printing process are set. The temperature discrimination processing means of the control circuit 61 executes the temperature discriminating process. When the detection temperature Tb is higher than the threshold value $\phi$H, the standby mode setting processing means of the control circuit 61 executes the standby mode setting process, does not execute the paper feeding operation, and waits for the start of the printing process. The temperature discrimination processing means discriminates whether the detection temperature Tb is lower than the threshold value $\phi$L or not. When the detection temperature Tb is lower than the threshold value $\phi$L, the print processing means of the control circuit 61 starts the printing process and executes the printing operation.

Since the threshold value $\phi$H to set the standby mode is set to be high and the threshold value $\phi$L to start the printing process is set to be low as mentioned above, for example, as shown in FIG. 23, while the printing process (P) is executed, if the detection temperature Tb becomes higher than the threshold value $\phi$H at timing t21, the standby mode (W) is set. However, even if the detection temperature Tb immediately becomes equal to or lower than the threshold value $\phi$H at timing t22, the standby mode is maintained until the detection temperature Tb becomes lower than the threshold value $\phi$L at timing t23.

Therefore, a situation such that the standby mode is excessively and repetitively set in the standby mode setting process is eliminated. Thus, not only the printing time can be shortened but also a situation such that an uncomfortable feeling is given to the operator can be prevented.

The flowchart of FIG. 22 will now be described.

Step S71: Whether the detection temperature Tb is higher than the threshold value $\phi$H or not is discriminated. If the detection temperature Tb is higher than the threshold value $\phi$H, step S72 follows. If the detection temperature Tb is equal to or lower than the threshold value $\phi$H, step S74 follows.

Step S72: The paper feeding operation is not executed but the printer enters the standby mode.

Step S73: Whether the detection temperature Tb is lower than the threshold value $\phi$L or not is discriminated. If the detection temperature Tb is lower than the threshold value $\phi$L, step S74 follows. If the detection temperature Tb is equal to or higher than the threshold value $\phi$L, the processing routine is returned to step S72.

Step S74: The paper feeding operation is executed.

Step S75: The printing of one page is performed.

Step S76: Whether the printing of the designated number of print copies has been finished or not is discriminated. If the printing of the designated number of print copies has been finished, the processing routine is finished. If the printing of the designated number of print copies is not finished, the processing routine is returned to step S71.

The tenth embodiment of the invention will now be described.

Figure 24:
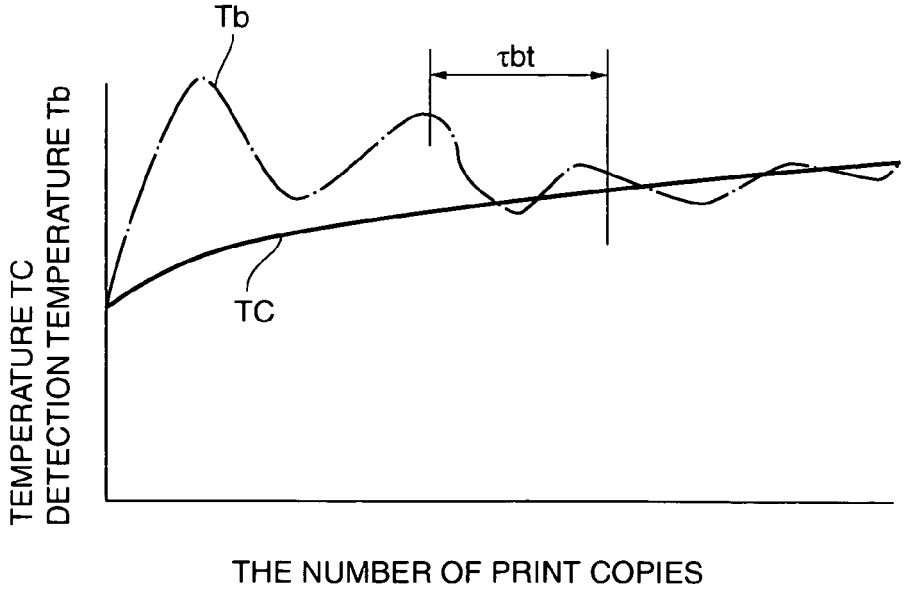
FIG. 24 is a waveform diagram of a temperature in the tenth embodiment of the invention.
Figure 25:
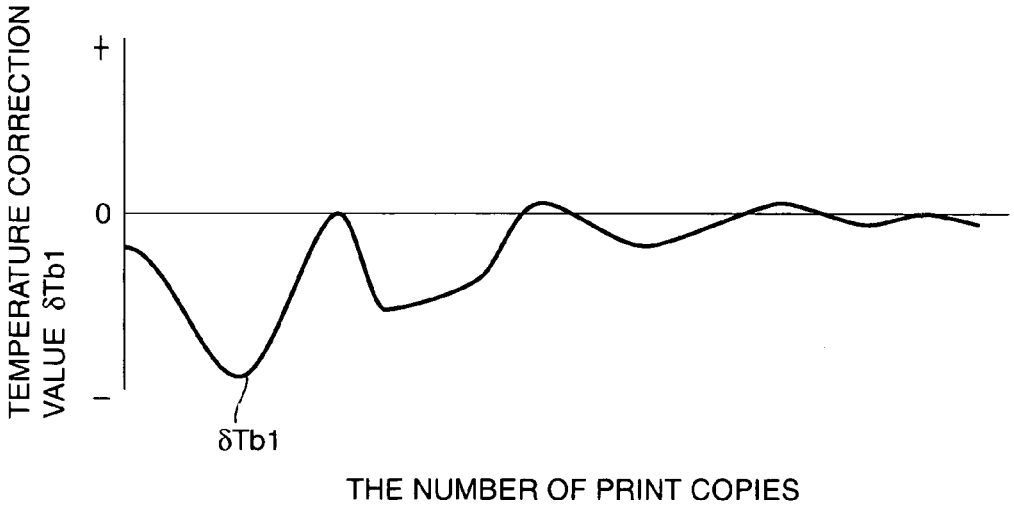
FIG. 25 is a diagram showing a temperature correction value table in the tenth embodiment of the invention.

FIG. 24 is a waveform diagram of a temperature in the 10th embodiment of the invention. FIG. 25 is a diagram showing a temperature correction value table in the 10th embodiment of the invention. In FIG. 24, an axis of abscissa indicates the number of print copies and an axis of ordinate shows the detection temperature Tb and the temperature TC.

In this case, the temperature TC of the photosensitive drum 16C (FIG. 1) as an image holding material is used as a reference and a temperature correction value $\delta$Tb1 shown in FIG. 25 is set on the basis of a difference between the detection temperature Tb and the temperature TC. The temperature discrimination processing means of the control circuit 61 executes the temperature discriminating process. When the temperature of the conveying belt 20 as a belt is detected by the temperature detecting sensor 88 as a temperature detecting unit, the value obtained by adding the temperature correction value $\delta$Tb1 to the detection temperature Tb is corrected as a detection temperature Tb. Whether the detection temperature Tb obtained after the correction is higher than the threshold value or not is discriminated.

In FIG. 24, $\tau$bt denotes a running period of one circumference of the conveying belt 20 and the temperature correction value $\tau$Tb1 is set in correspondence to the detection temperature Tb which fluctuates in association with the running of the conveying belt 20. That is, the temperature correction value $\delta$Tb1 is set as follows.

$$\delta Tb1 = TC - Tb$$

When the conveying belt 20 is repetitively run, the detection temperature Tb fluctuates while repeating the up/down motion every running period $\tau$bt of the conveying belt 20. The conveying belt 20 and the photosensitive drum 16C gradually become familiar with the atmosphere of the printer. The difference between the detection temperature Tb and the temperature TC decreases. When the conveying belt 20 is run by four rounds, the detection temperature Tb and the temperature TC almost become equal. Therefore, the temperature correction value δTb1 is also changed in correspondence to such a difference. When the conveying belt 20 is run by four rounds, the temperature correction value δTb1 is set to almost zero (0).

Since the temperature correction value δTb1 is set on the basis of the difference between the detection temperature Tb and the temperature TC and the detection temperature Tb is corrected as mentioned above, the fluctuation of the detection temperature Tb accompanied with the running of the conveying belt 20 can be set off. Therefore, a situation such that the standby mode is excessively and repetitively set in the standby mode setting process is eliminated.

Thus, not only the printing time can be shortened but also a situation such that an uncomfortable feeling is given to the operator can be prevented.

The 11th embodiment of the invention will now be described.

Figure 26:
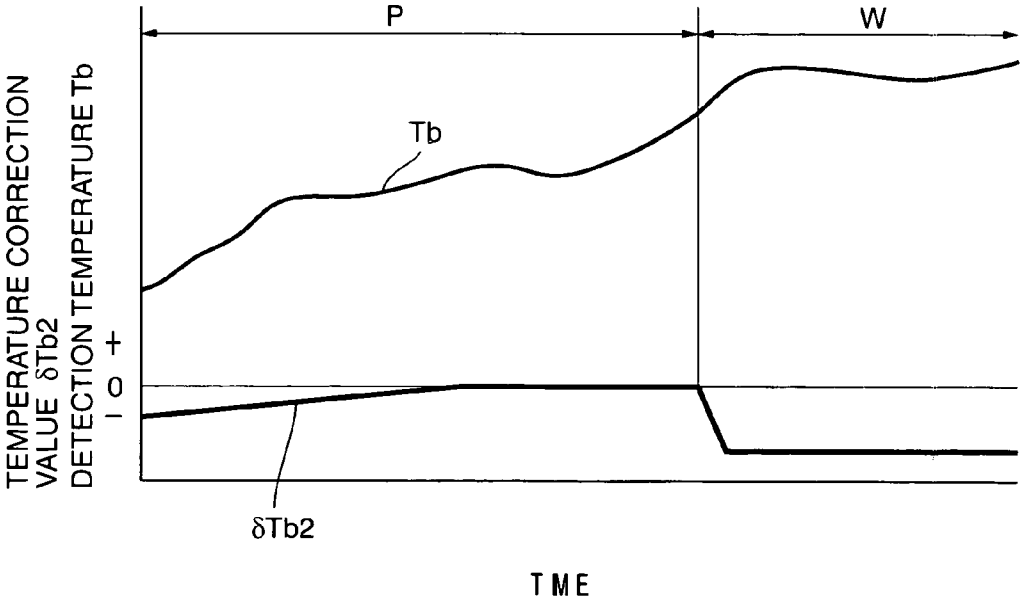
FIG. 26 is a time chart showing an example of a detection temperature and a temperature correction value in the 11th embodiment of the invention.
Figure 27:
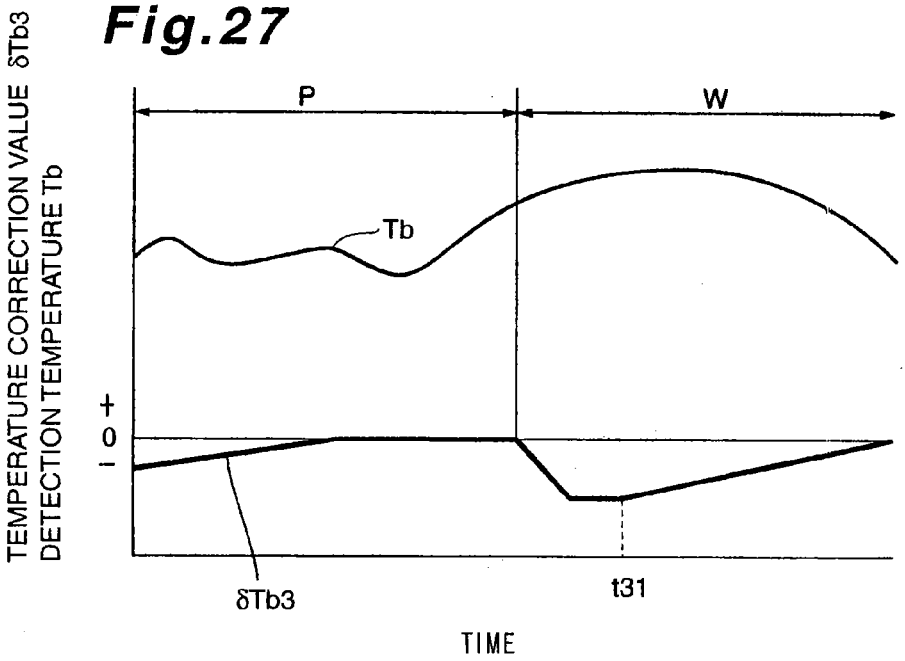
FIG. 27 is a time chart showing another example of a detection temperature and a temperature correction value in the 11th embodiment of the invention.

FIG. 26 is a time chart showing an example of a detection temperature and a temperature correction value in the 11th embodiment of the invention. FIG. 27 is a time chart showing another example of a detection temperature and a temperature correction value in the 11th embodiment of the invention.

In this case, the detection temperature Tb is corrected not only when the running of the conveying belt 20 (FIG. 1) as a belt is started but also when the running of the conveying belt 20 is stopped.

Generally, when the printing is continuously executed for a long time in the printing process (P), since the detection temperature Tb and the temperature of the photosensitive drum 16C as an image holding material are almost equal, a temperature correction value δTb2 is set to an almost zero. When the printing process is finished, the driving of the motor 74 (FIG. 3) as driving means for running the belt is stopped, the conveyance of the conveying belt 20 is also stopped, and the printer enters the standby mode (W), heat exchange between the conveying belt 20 and the portion of a low temperature is momentarily stopped. Therefore, as shown in FIG. 26, the temperature of the conveying belt 20 rises suddenly. After that, almost the same value is held for a little while and an almost constant temperature difference is maintained between the detection temperature Tb and the temperature of the photosensitive drum 16C.

The temperature discrimination processing means of the control circuit 61 executes the temperature discriminating process. When the printer enters the standby mode, the temperature correction value δTb2 is increased in the negative direction. The temperature is corrected by setting the value obtained by adding the temperature correction value δTb2 to the detection temperature Tb into a detection temperature Tb. Whether the detection temperature Tb obtained after the correction is higher than the threshold value or not is discriminated.

Therefore, a situation such that the standby mode is excessively and repetitively set in the standby mode setting process is eliminated. Thus, not only the printing time can be shortened but also a situation such that an uncomfortable feeling is given to the operator can be prevented.

Generally, when the time during which the stop state of the printer continues is long, the printer enters the power saving mode and the heater is turned off. Therefore, the temperature in the printer is lowered and the detection temperature Tb and the temperature of the photosensitive drum 16C finally become equal.

In the printer which enters the power saving mode, therefore, as shown in FIG. 27, when the heater is turned off at timing t31, a temperature correction value δTb3 is gradually decreased in the negative direction and set to zero at a point of time when the detection temperature Tb and the temperature of the photosensitive drum 16C become equal.

Since the detection temperature Tb is also corrected when the printer enters the standby mode after the end of the printing process as mentioned above, even in the case where the number of print copies per job is small, the printing process is finished in a short time, and the apparatus repetitively enters the standby mode, the standby mode setting process can be properly executed. Therefore, not only the time during which the standby mode is continued can be shortened but also the image quality can be improved.

The 12th embodiment will now be described.

Figure 28:
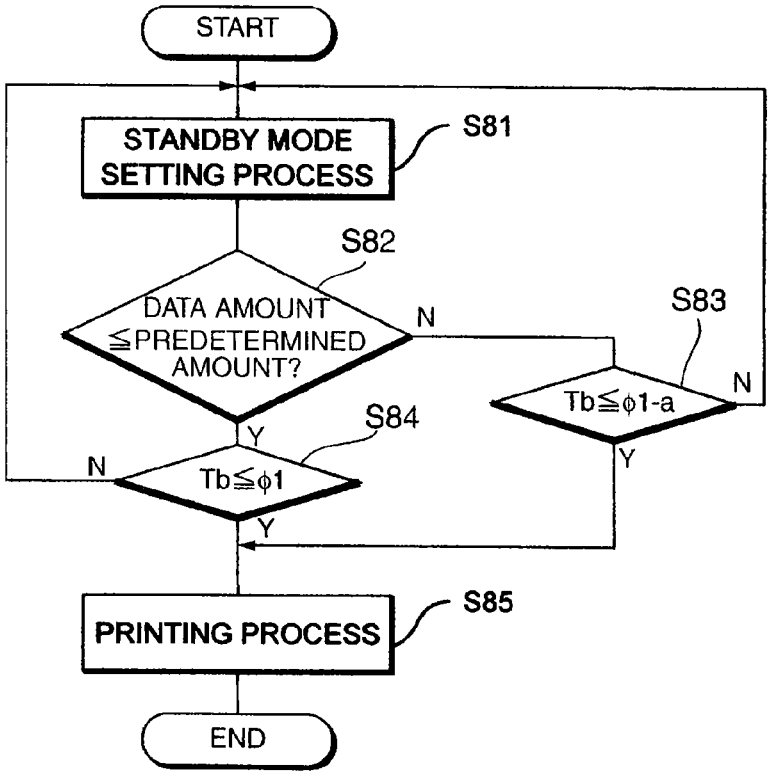
FIG. 28 is a flowchart showing the operation of a printer in the 12th embodiment of the invention.
Figure 29:
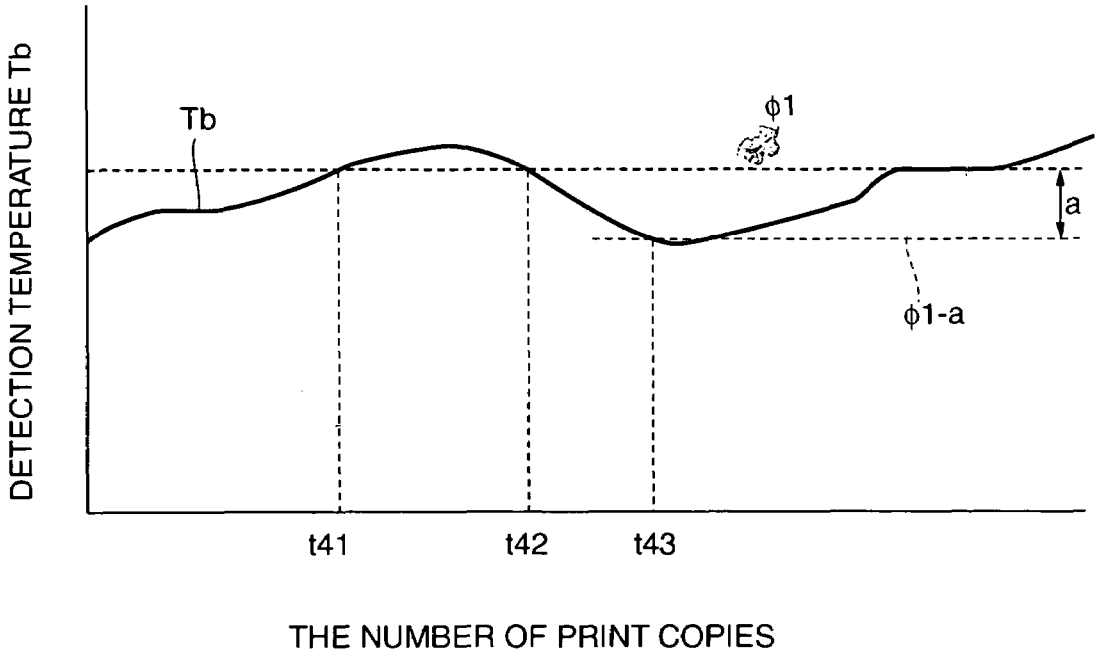
FIG. 29 is a waveform diagram of a temperature in the 12th embodiment of the invention.

FIG. 28 is a flowchart showing the operation of a printer in the 12th embodiment of the invention. FIG. 29 is a waveform diagram of a temperature in the 12th embodiment of the invention. In FIG. 29, an axis of abscissa indicates the number of print copies and an axis of ordinate shows the detection temperature Tb.

While the standby mode setting processing means (not shown) of the control circuit 61 is executing the standby mode setting process, the image processing means of the control circuit 61 executes the image process and edits the image data for printing the next page.

The temperature discrimination processing means of the control circuit 61 executes the temperature discriminating process and discriminates whether an amount of edited image data is equal to or less than a predetermined amount or not. If the data amount is equal to or less than the predetermined amount, whether the detection temperature Tb is equal to or lower than the threshold value φ1 (in the embodiment, 50 [° C.]) or not is discriminated. If the detection temperature Tb is equal to or lower than the threshold value φ1, the print processing means of the control circuit 61 starts the printing process and executes the printing operation of the next page.

If the data amount is larger than the predetermined amount, the temperature discrimination processing means discriminates whether the detection temperature Tb is equal to or lower than the value (φ1−a) obtained by subtracting an adjustment value (a) from the threshold value φ1 or not. If the detection temperature Tb is equal to or lower than the value (φ1−a), the print processing means starts the printing process and executes the printing operation of the next page.

Although the two threshold values are selected in dependence on whether the data amount is equal to or less than the predetermined amount or not, the threshold value can be changed step by step in accordance with the data amount.

For example, as shown in FIG. 29, when the detection temperature Tb is higher than the threshold value φ1 at timing t41, the standby mode setting processing means of the control circuit 61 executes the standby mode setting process and sets the printer into the standby mode. Subsequently, the temperature discrimination processing means discriminates whether the data amount of the edited image data is equal to or less than the predetermined amount or not. If the data amount is equal to or less than the predetermined amount, whether the detection temperature Tb is equal to or lower than the threshold value φ1 or not is discriminated. Therefore, if the detection temperature Tb is equal to or lower than the threshold value φ1 at timing t42, the print processing means starts the printing process. If the data amount is larger than the predetermined amount, whether the detection temperature Tb is equal to or lower than the value (ϕ1−a) or not is discriminated. Therefore, the print processing means does not start the printing process until the detection temperature Tb becomes equal to or lower than the value (ϕ1−a) at timing t43.

As mentioned above, if an amount of data to which the image process is being executed is small, the image process is started when the detection temperature Tb becomes equal to or lower than the threshold value ϕ1. On the contrary, if the data amount is large, since the printing process is not started until the detection temperature Tb becomes equal to or lower than the value (ϕ1−a). Therefore, it is possible to prevent a situation such that when the data amount is large, the detection temperature Tb rises in a short time and the printer enters the standby mode after the start of the printing process.

Therefore, the print throughput can be improved. Since the threshold value is set to a plurality of values in correspondence to the amount of data to which the image process is being executed, the standby mode setting process can be properly executed. Thus, a situation such that the influence by the heat remains in the subsequent printing process can be eliminated.

The flowchart of FIG. 28 will now be described.

Step S81: The standby mode setting process is executed.

Step S82: Whether the data amount is equal to or less than the predetermined amount or not is discriminated. If the data amount is equal to or less than the predetermined amount, step S84 follows. If the data amount is larger than the predetermined amount, step S83 follows.

Step S83: Whether the detection temperature Tb is equal to or lower than the value (ϕ1−a) or not is discriminated. If the detection temperature Tb is equal to or lower than the value (ϕ1−a), step S85 follows. If the detection temperature Tb is higher than the value (ϕ1−a), the processing routine is returned to step S81.

Step S84: Whether the detection temperature Tb is equal to or lower than the threshold value ϕ1 or not is discriminated. If the detection temperature Tb is equal to or lower than the threshold value ϕ1, step S85 follows. If the detection temperature Tb is higher than the threshold value ϕ1, the processing routine is returned to step S81.

Step S85: The printing process is executed and the processing routine is finished.

The 13th embodiment will now be described.

Figure 30:
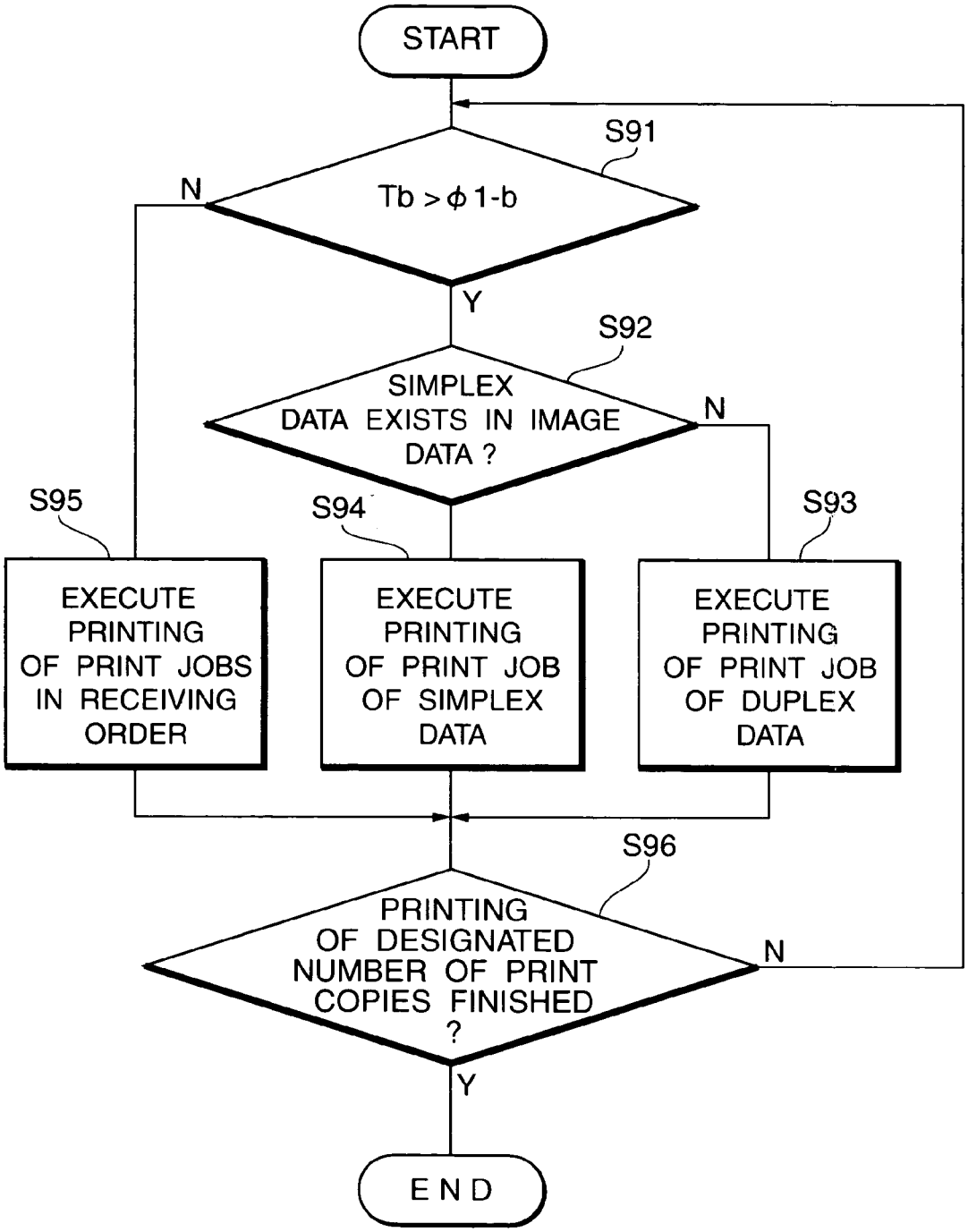
FIG. 30 is a flowchart showing the operation of a printer in the 13th embodiment of the invention.
Figure 31:
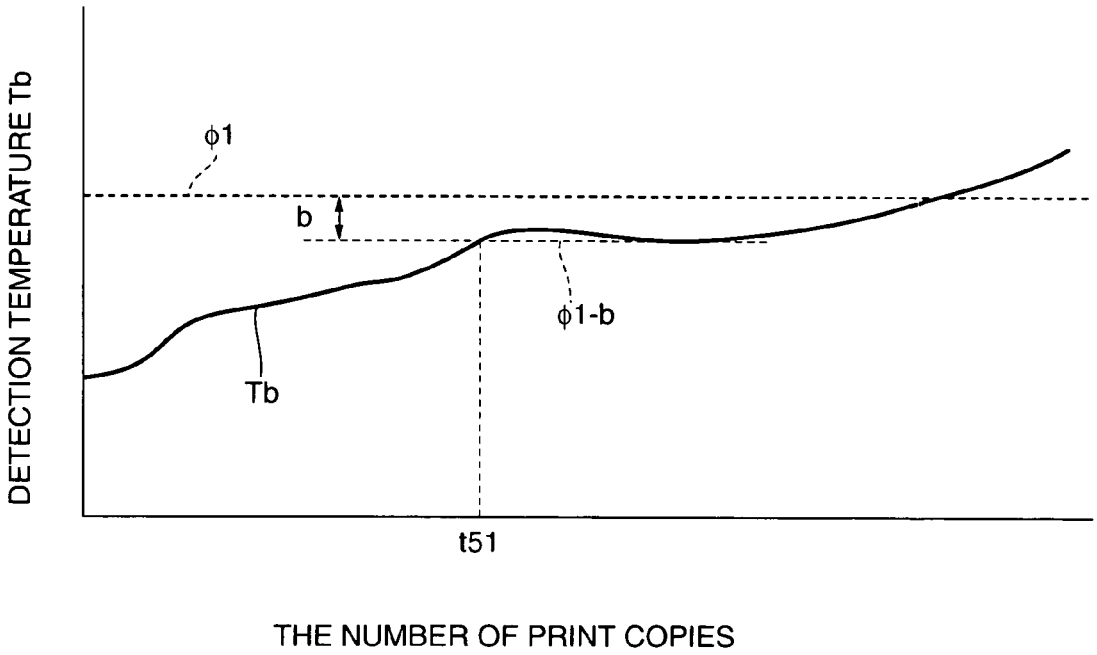
FIG. 31 is a waveform diagram of a temperature in the 13th embodiment of the invention.

FIG. 30 is a flowchart showing the operation of a printer in the 13th embodiment of the invention. FIG. 31 is a waveform diagram of a temperature in the 13th embodiment of the invention. In FIG. 31, an axis of abscissa indicates the number of print copies and an axis of ordinate shows the temperature.

In the ordinary continuous printing, the image data includes data for simplex for executing the one-side printing (simplex printing) and data for duplex for executing the both-side printing (duplex printing). Whether the printing is executed in accordance with the simplex data or the printing is executed in accordance with the duplex data exerts a large influence on the temperatures of the photosensitive drums 16Bk (FIG. 1), 16Y, 16M, and 16C as image holding materials.

That is, in the case of performing the simplex printing, the recording medium 21 which passed through the fixing device 48 as a fixing unit is ejected as it is to the outside of the printer and does not pass through the transfer portions of the 1st to 4th printing mechanisms P1 to P4 again. Therefore, the temperatures of the photosensitive drums 16Bk, 16Y, 16M, and 16C do not rise suddenly. On the other hand, in the case of performing the duplex printing, the recording medium 21 which passed through the fixing device 48 and in which the printing to one side has been finished is reversed in order to print to the other side and passes through the transfer portions of the 1st to 4th printing mechanisms P1 to P4 again. Therefore, since the recording medium 21 which holds the heat in association with the passage through the fixing device 48 passes through the transfer portions, the heat of the recording medium 21 is directly transferred to the photosensitive drums 16Bk, 16Y, 16M, and 16C and the temperatures of the photosensitive drums 16Bk, 16Y, 16M, and 16C rise suddenly.

In the embodiment, therefore, the temperature discrimination processing means of the control circuit 61 executes the temperature discriminating process. While the continuous printing is being executed, the temperature of the conveying belt 20 as a belt rises gradually. Whether the detection temperature Tb is higher than a value (ϕ1−b) obtained by subtracting an adjustment value (b) from the threshold value ϕ1 (in the embodiment, 50 [° C.]) or not is discriminated. If the detection temperature Tb is higher than the value (ϕ1−b), whether the simplex data exists in the image data or not is discriminated.

If the simplex data exists in the image data, the print processing means of the control circuit 61 executes the printing process and preferentially prints a print job as an image forming job of the simplex data. If the detection temperature Tb is equal to or lower than the value (ϕ1−b), the print processing means sequentially prints print jobs which are received from the host computer.

Therefore, as shown in FIG. 31, when the detection temperature Tb becomes higher than the value (ϕ1−b) at timing t51 while the continuous printing is executed, the printing is preferentially executed with respect to the print job of the simplex data. Thus, the sudden increase in temperatures of the photosensitive drums 16Bk, 16Y, 16M, and 16C can be prevented and many jobs can be printed.

Although the temperatures of the photosensitive drums 16Bk, 16Y, 16M, and 16C rise gradually while the print job of the simplex data is preferentially printed, if the number of print jobs is small, the printing can be performed with respect to all of the print jobs. Although the print job of the duplex data is printed after the printing with respect to the print job of the simplex data was finished, if the data amount of the print job of the duplex data is small, the printing can be finished with respect to all of the print jobs before the detection temperature Tb becomes equal to the threshold value ϕ1.

Since the printing is preferentially executed with respect to the print job of the simplex data when the simplex data and the duplex data are included in the image data as mentioned above, not only there is no need to set the printer in the standby mode for a long time but also the printing can be efficiently executed with respect to each print job. Thus, working efficiency of the printer can be improved.

The flowchart of FIG. 30 will now be described.

Step S91: Whether the detection temperature Tb is higher than the value (ϕ1−b) or not is discriminated. If the detection temperature Tb is higher than the value (ϕ1−b), step S92 follows. If the detection temperature Tb is equal to or lower than the value (ϕ1−b), step S95 follows.

Step S92: Whether the simplex data exists in the image data or not is discriminated. If the simplex data exists in the image data, step S94 follows. If the simplex data does not exist in the image data, step S93 follows.

Step S93: The printing is executed with respect to the print job of the duplex data.

Step S94: The printing is executed with respect to the print job of the simplex data.

Step S95: The printing is executed with respect to the print jobs in receiving order.

Step S96: Whether the printing of the designated number of print copies has been finished or not is discriminated. If the printing of the designated number of print copies has been finished, the processing routine is finished. If the printing of the designated number of print copies is not finished, the processing routine is returned to step S91.

Although the above embodiments have been described with respect to the color printer as an image forming apparatus, the invention can be also applied to a monochromatic printer.

The present invention is not limited to the foregoing embodiments but many modifications and variations are possible within the spirit and scope of the appended claims of the invention and they are not excluded from the scope of the invention.

As described in detail above, according to the invention, there is provided the image forming apparatus comprising: the image forming unit which forms the electrostatic latent image onto the charged image holding material, deposits the developing material onto the electrostatic latent image, and forms the visible image; the belt arranged so as to run freely in contact with the image forming unit; the temperature detecting unit which detects the temperature of the belt; and the control unit which controls the image forming process on the basis of the temperature detected by the temperature detecting unit.

In this case, since the temperature of the belt is detected and the printing process is controlled on the basis of the detection temperature, an increase in temperature of the image holding material and an increase in temperature in the image forming apparatus can be suppressed.

Therefore, since the flowability of the developing material in each image forming unit does not deteriorate, the image quality can be improved.

Since the temperature of the belt is detected, the surface of the image holding material is not scratched. Since there is no need to detect the temperatures in a contactless manner, not only the costs of the temperature detecting unit can be reduced but also the space necessary to attach the temperature detecting unit can be reduced.

(Embodiment 14)

Figure 32:
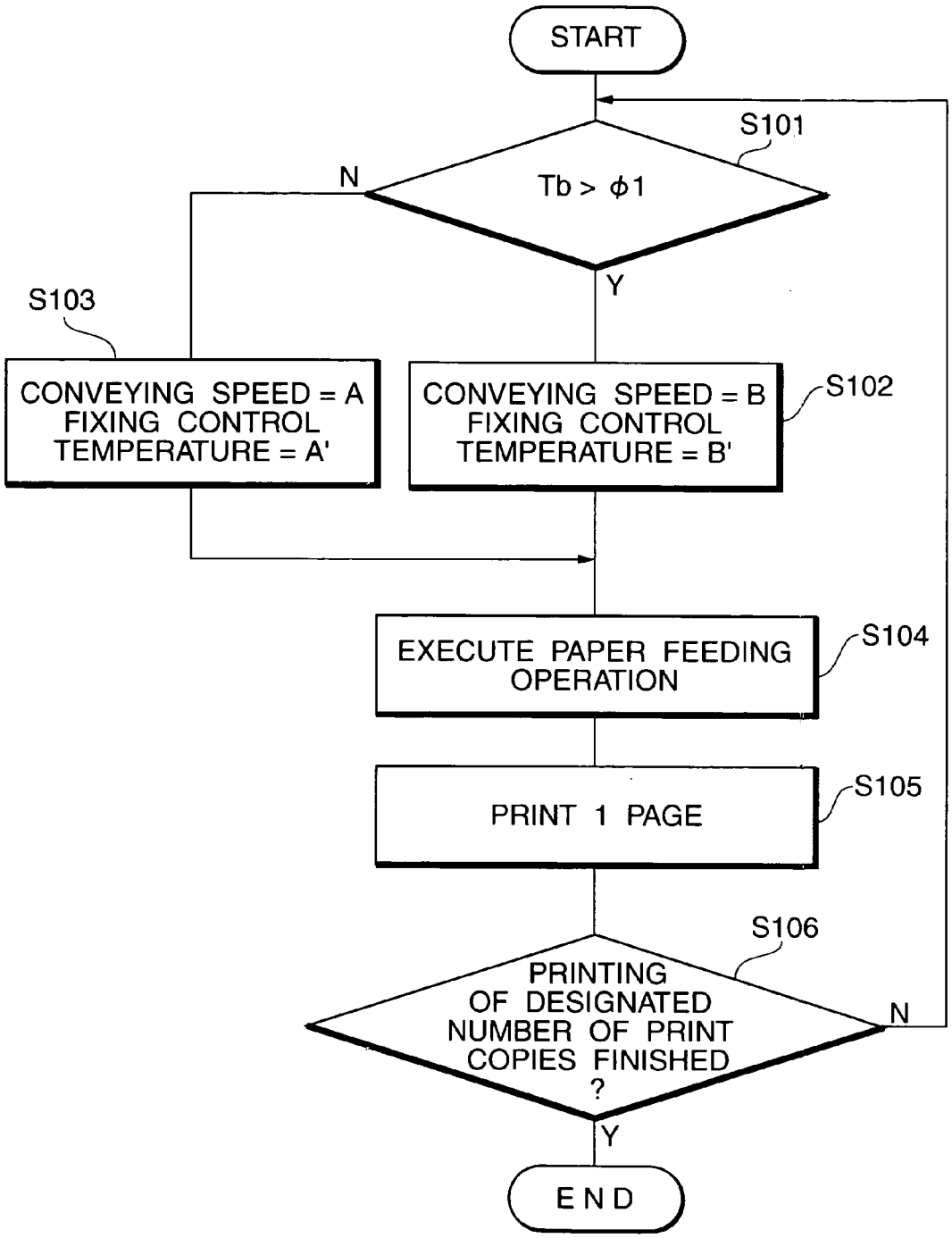
FIG. 32 is a flowchart showing the operation of a printer in the 14th embodiment of the invention.
Figure 33:
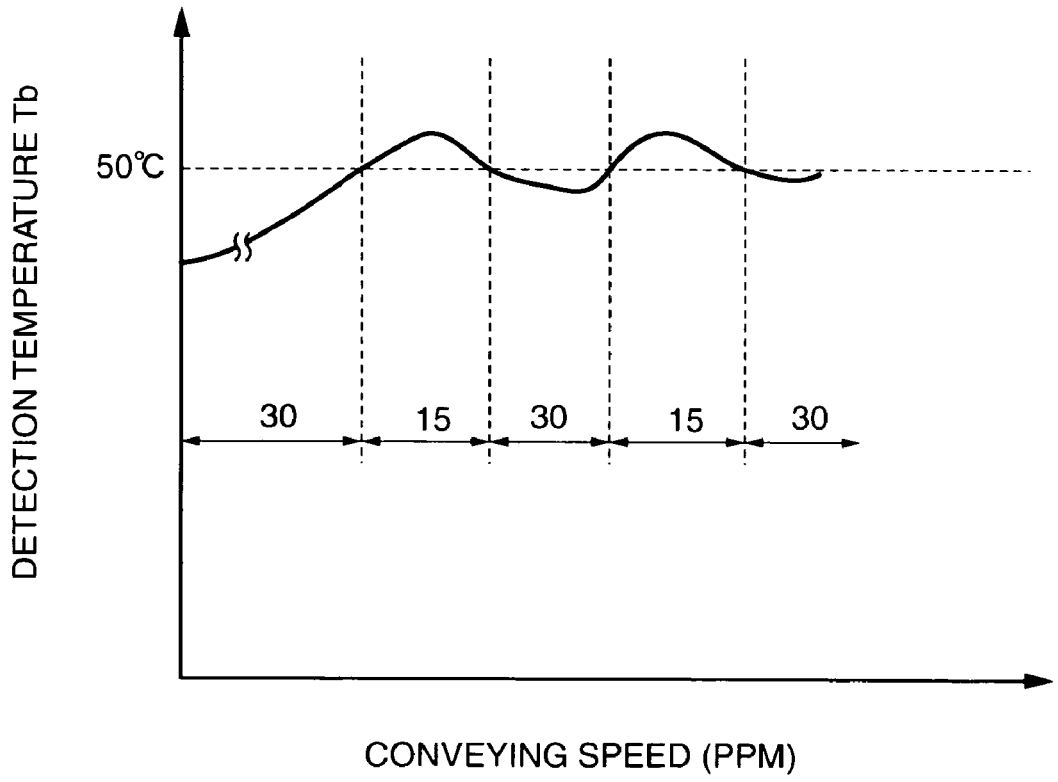
FIG. 33 is a timing chart showing a relation between a detection temperature and a conveying speed (PPM) in the 14th embodiment of the invention.
Figure 34:
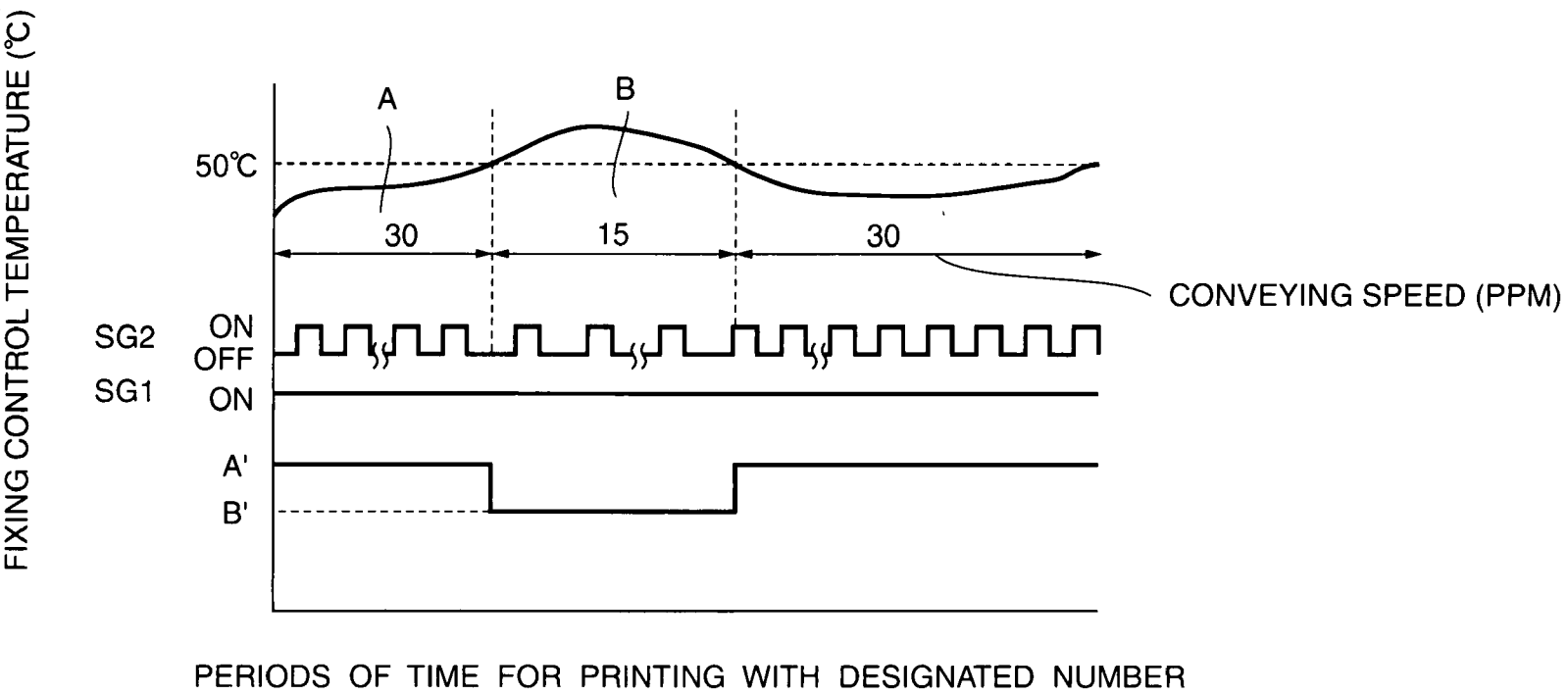
FIG. 34 is a timing chart showing a change in conveying speed to the detection temperature by a relation between a control signal and a control temperature in the 14th embodiment of the invention.

FIG. 32 is a flowchart showing the operation of a printer in the 14th embodiment of the invention. FIG. 33 is a waveform diagram showing the operation of the printer in the 14th embodiment of the invention. FIG. 34 is a waveform diagram for explaining a state where a conveying speed and a fixing control temperature are changed in the 14th embodiment of the invention. In FIG. 33, an axis of abscissa indicates a period of time for printing the designated number of print copies and an axis of ordinate shows the detection temperature Tb. In FIG. 34, an axis of abscissa indicates a period of time for printing the designated number of print copies and an axis of ordinate shows the detection temperature Tb, the fixing device motor control signal SG1, the heater control signal SG2, and the fixing control temperature.

First, the temperature detection processing means reads out the detection voltage and converts it into the detection temperature showing the surface temperature of the conveying belt 20 (FIG. 1) with reference to the temperature table of FIG. 5 recorded in the ROM of the control circuit 61. Subsequently, the temperature discrimination processing means (not shown) of the control circuit 61 executes the temperature discriminating process and discriminates whether the detection temperature Tb is higher than the threshold value $\phi$1 or not. If the detection temperature Tb is higher than the threshold value $\phi$1, conveying speed/fixing control temperature change processing means (not shown) of the control circuit 61 changes set information of the conveying speed and the fixing control temperature. The subsequent printing is performed on the basis of the changed set information. For example, the conveying speed is changed from 30 PPM (Pages Per Minute) to 15 PPM and the fixing control temperature is changed from 180° C. to 150° C. By reducing the conveying speed, even if the fixing control temperature is lowered, no problem occurs in the fixing ability. On the contrary, since the conveying speed is reduced, a friction opportunity of the photosensitive material and the print medium decreases and the generation of frictional heat can be suppressed. Since the fixing control temperature setting can be lowered, an increase in temperature in the apparatus due to the fixing device can be suppressed. Therefore, the temperature in the apparatus can be suppressed as a whole and the detection temperature Tb can be lowered. Further, since the print processing operation is not stopped, the throughput of the apparatus is not largely reduced. Since the apparatus is not stopped, the user does not misunderstand the stop of the apparatus as a failure.

As mentioned above, when the surface temperature of the conveying belt 20 is lowered, the conveying speed is reset to 30 PPM and the fixing control temperature is reset to 180° C. The subsequent printing is performed on the basis of the reset set information. If the continuous printing process is executed, the above operation is repeated as shown in FIG. 32 until the printing of the designated number of print copies is finished.

The flowchart of FIG. 32 will now be described.

Step S101: Whether the detection temperature Tb is higher than the threshold value $\phi$1 or not is discriminated. If the detection temperature Tb is higher than the threshold value $\phi$1, step S102 follows. If the detection temperature Tb is equal to or lower than the threshold value $\phi$1, step S103 follows.

Step S102: The conveying speed is changed to B (for example, 15 PPM) and the fixing control temperature is changed to B' (for example, 150° C.).

Step S103: The conveying speed is changed to A (for example, 30 PPM) and the fixing control temperature is changed to A' (for example, 180° C.).

Step S104: The paper feeding operation is executed on the basis of the set conveying speed and the set fixing control temperature.

Step S105: The printing of one page is executed on the basis of the set conveying speed and the set fixing control temperature.

Step S106: Whether the printing of the designated number of print copies has been finished or not is discriminated. If the printing of the designated number of print copies has been finished, the processing routine is finished. If the printing of the designated number of print copies is not finished, the processing routine is returned to step S101.

(Embodiment 15)

Figure 35:
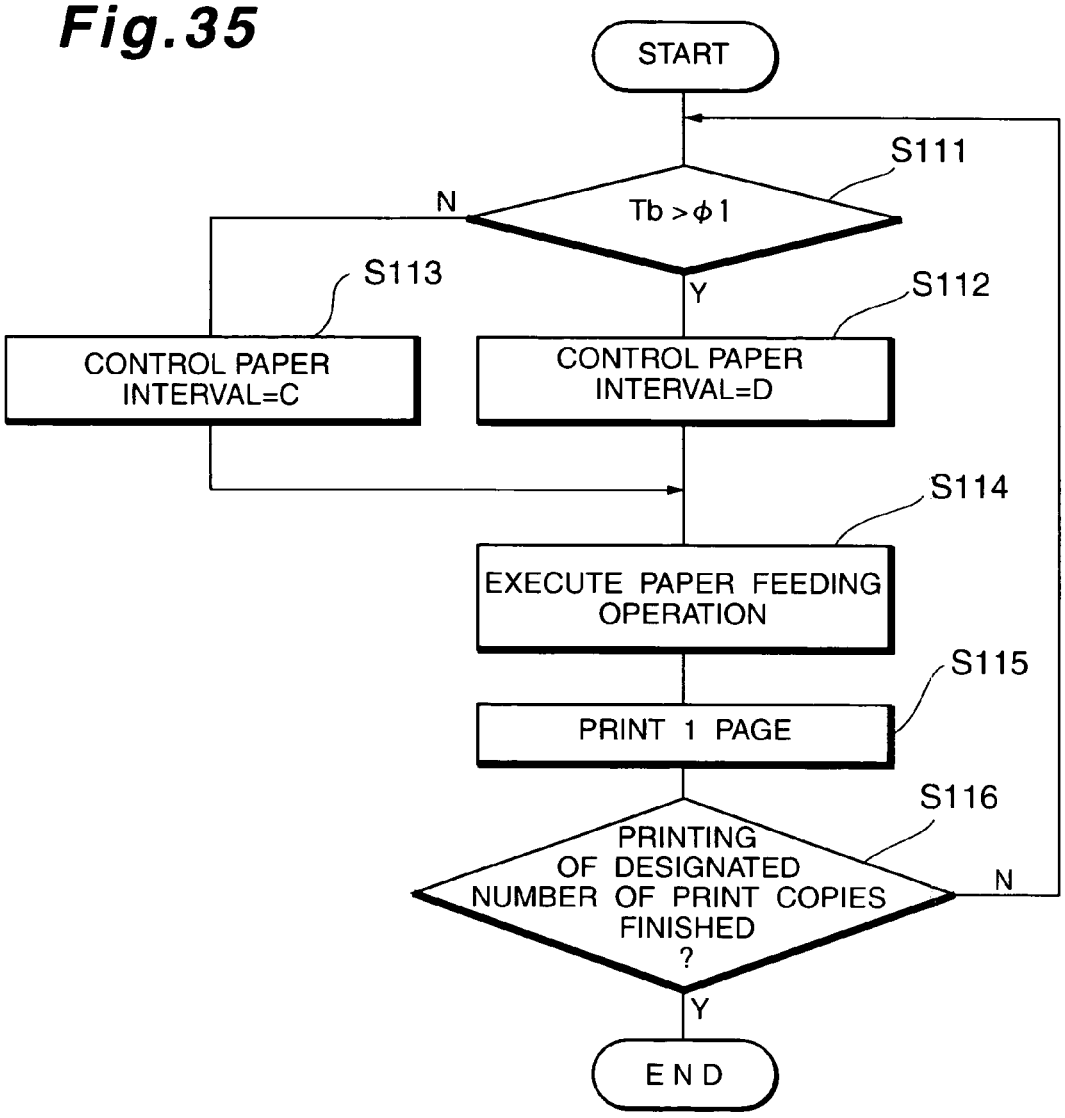
FIG. 35 is a flowchart showing the operation of a printer in the 15th embodiment of the invention.
Figure 36:
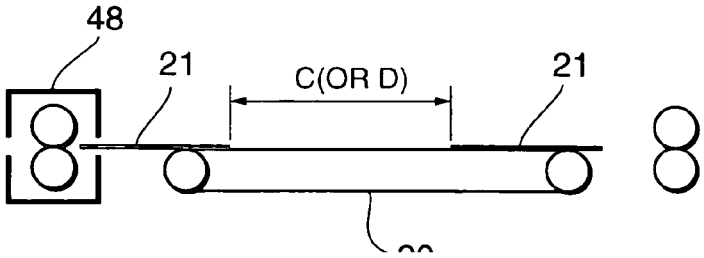
FIG. 36 is an explanatory diagram of an interval between paper in the 15th embodiment of the invention.

FIG. 35 is a flowchart showing the operation of a printer in the 15th embodiment of the invention. FIG. 36 is a schematic diagram of the printer for explaining an interval between paper in the 15th embodiment of the invention.

Figure 37:
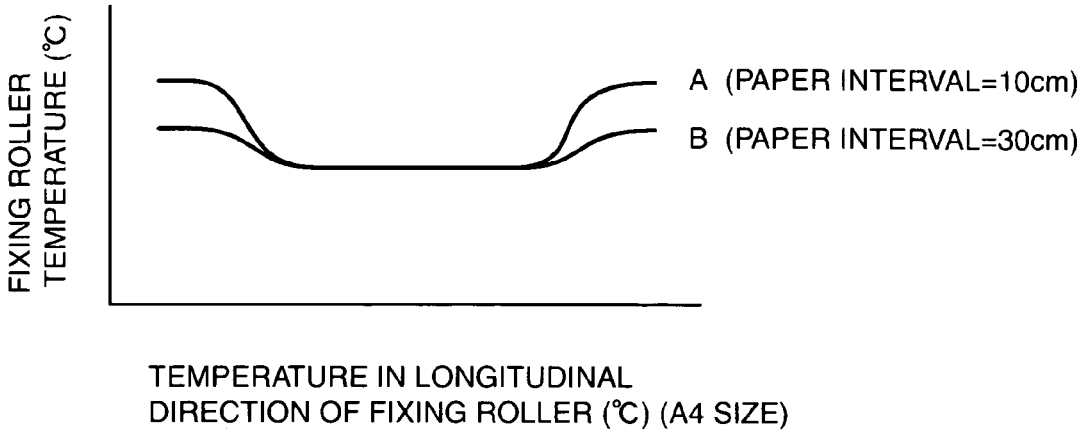
FIG. 37 is a diagram showing temperature distribution in the longitudinal direction of a fixing roller in the 15th embodiment of the invention.

FIG. 37 is a temperature distribution diagram in the longitudinal direction of a fixing roller in the 15th embodiment of the invention. In FIG. 37, an axis of abscissa indicates the position in the longitudinal direction of the fixing roller and an axis of ordinate shows the fixing roller temperature at such a position.

First, the temperature detection processing means reads out the detection voltage and converts it into the detection temperature showing the surface temperature of the conveying belt 20 (FIG. 1) with reference to the temperature table of FIG. 5 recorded in the ROM of the control circuit 61. Subsequently, the temperature discrimination processing means (not shown) of the control circuit 61 executes the temperature discriminating process and discriminates whether the detection temperature Tb is higher than the threshold value $\phi$1 or not. If the detection temperature Tb is higher than the threshold value $\phi$1, paper interval change processing means (not shown) of the control circuit 61 changes set information of a conveyance interval of each print medium at the time of conveying the print medium as shown in FIG. 36. The subsequent printing is performed on the basis of the changed set information. For example, an interval between the paper is changed from 10 cm to 30 cm. By widening the interval between the paper, the increase in temperature of the fixing device can be suppressed. That is, as shown in FIG. 37, for example, if the interval between the paper is narrow, the print media of the A4 size are successively conveyed, so that the heat in the A4-conveying area of the fixing roller is taken away. When the decrease in temperature of the fixing roller is detected by a temperature detecting unit provided in the print medium conveying range in the fixing roller in a contactless manner, the heater is turned on to keep the fixing roller in the fixing control temperature. Thus, the temperature rises in the fixing roller area out of the A4 size where no heat is taken away (A in FIG. 37). However, by widening the interval between the paper, a frequency of the phenomenon such that the heat is taken away decreases and the number of heater control times also decreases. Thus, the temperature difference at the position in the longitudinal direction of the fixing roller is extinguished and the increase in temperature in the fixing roller area out of the A4 size can be also suppressed (B in FIG. 37). Therefore, the temperature in the apparatus can be suppressed as a whole and the detection temperature Tb can be lowered. Further, since the print processing operation is not stopped, the throughput of the apparatus is not largely reduced. Since the apparatus is not stopped, the user does not misunderstand the stop of the apparatus as a failure.

As mentioned above, when the surface temperature of the conveying belt 20 is lowered, the paper interval set information is reset to 10 cm. The subsequent printing is performed on the basis of the reset set information. If the continuous printing process is executed, the above operation is repeated as shown in FIG. 35 until the printing of the designated number of print copies is finished.

The flowchart of FIG. 35 will now be described.

Step S111: Whether the detection temperature Tb is higher than the threshold value $\phi$1 or not is discriminated. If the detection temperature Tb is higher than the threshold value $\phi$1, step S112 follows. If the detection temperature Tb is equal to or lower than the threshold value $\phi$1, step S113 follows.

Step S112: The interval between the paper is changed to D (for example, 30 cm).

Step S113: The interval between the paper is changed to C (for example, 10 cm).

Step S114: The paper feeding operation is executed on the basis of the set paper interval information.

Step S115: The printing of one page is executed on the basis of the set paper interval information.

Step S116: Whether the printing of the designated number of print copies has been finished or not is discriminated. If the printing of the designated number of print copies has been finished, the processing routine is finished. If the printing of the designated number of print copies is not finished, the processing routine is returned to step S111.

(Embodiment 16)

Figure 38:
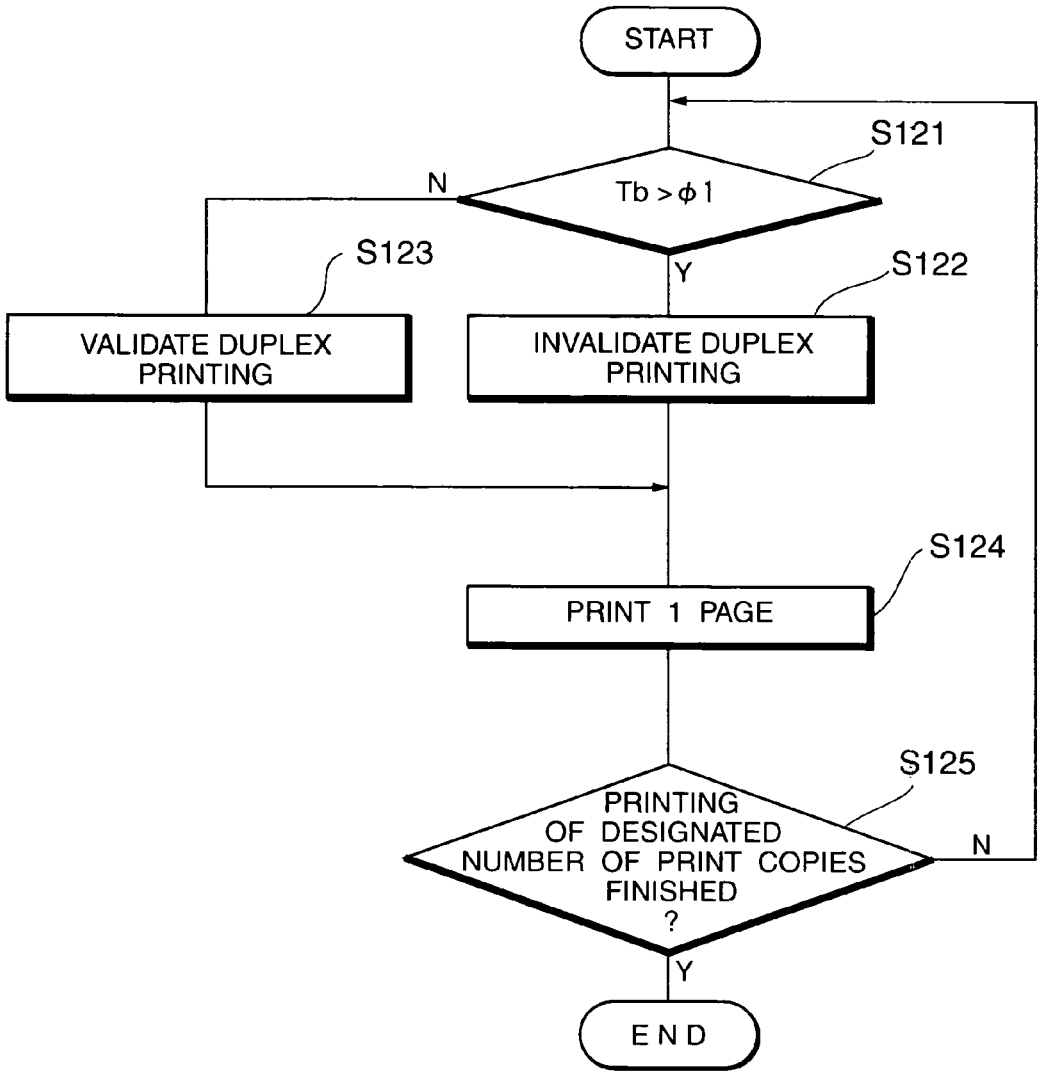
FIG. 38 is a flowchart showing the operation of a printer in the 16th embodiment of the invention.
Figure 39:
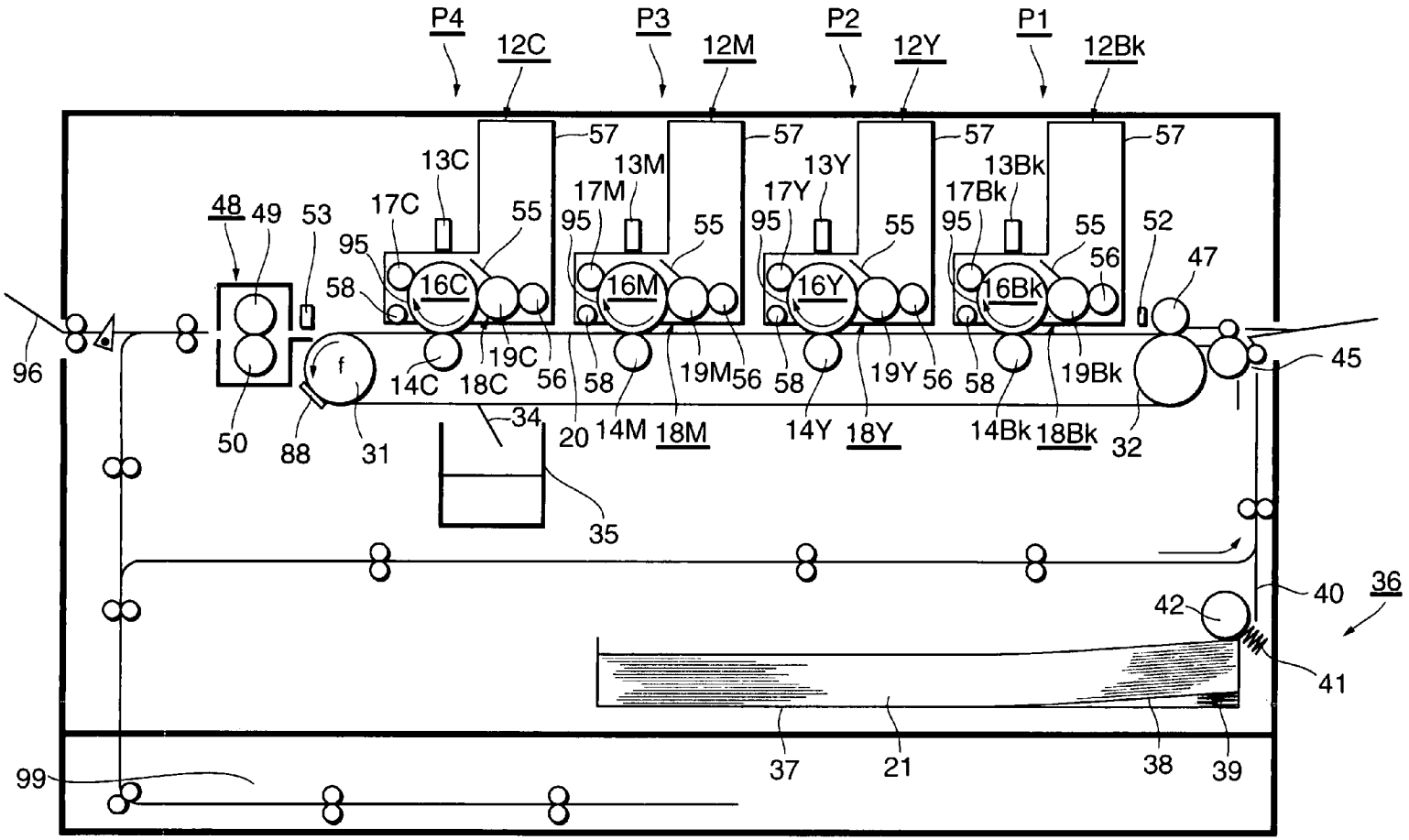
FIG. 39 is a schematic diagram of the printer in the 16th embodiment of the invention.

FIG. 38 is a flowchart showing the operation of a printer in the 16th embodiment of the invention. FIG. 39 is a schematic diagram of the printer in the 16th embodiment of the invention.

First, the temperature detection processing means reads out the detection voltage and converts it into the detection temperature showing the surface temperature of the conveying belt 20 (FIG. 1) with reference to the temperature table of FIG. 5 recorded in the ROM of the control circuit 61. Subsequently, the temperature discrimination processing means (not shown) of the control circuit 61 executes the temperature discriminating process and discriminates whether the detection temperature Tb is higher than the threshold value $\phi$1 or not. If the detection temperature Tb is higher than the threshold value $\phi$1, duplex printing limitation processing means (not shown) of the control circuit 61 inhibits the duplex printing and executes the processes in the simplex printing mode. This is because if the duplex printing is performed, the print medium which has passed through the fixing unit once and has been warmed is held in the apparatus (the duplex printing is performed as shown in FIG. 39 and the print medium is held in a reversing unit 99). Therefore, the temperature in the apparatus rises by the held warmed print medium. However, by inhibiting the duplex printing and performing the simplex printing, the warmed print medium is immediately ejected to the outside of the apparatus and the increase in temperature in the apparatus can be suppressed. Therefore, the temperature in the apparatus can be suppressed as a whole and the detection temperature Tb can be lowered. Further, since the print processing operation is not stopped, the throughput of the apparatus is not largely reduced. Since the apparatus is not stopped, the user does not misunderstand the stop of the apparatus as a failure.

As mentioned above, when the surface temperature of the conveying belt 20 is lowered, the duplex printing is validated again. If the continuous printing process is executed, the above operation is repeated as shown in FIG. 38 until the printing of the designated number of print copies is finished.

The flowchart of FIG. 38 will now be described.

Step S121: Whether the detection temperature Tb is higher than the threshold value $\phi$1 or not is discriminated. If the detection temperature Tb is higher than the threshold value $\phi$1, step S122 follows. If the detection temperature Tb is equal to or lower than the threshold value $\phi$1, step S123 follows.

Step S122: The duplex printing information of the print set information is changed to "invalid".

Step S123: The duplex printing information of the print set information is changed to "valid".

Step S124: The printing of one page is executed on the basis of the set print set information.

Step S125: Whether the printing of the designated number of print copies has been finished or not is discriminated. If the printing of the designated number of print copies has been finished, the processing routine is finished. If the printing of the designated number of print copies is not finished, the processing routine is returned to step S121.

(Embodiment 17)

Figure 41:
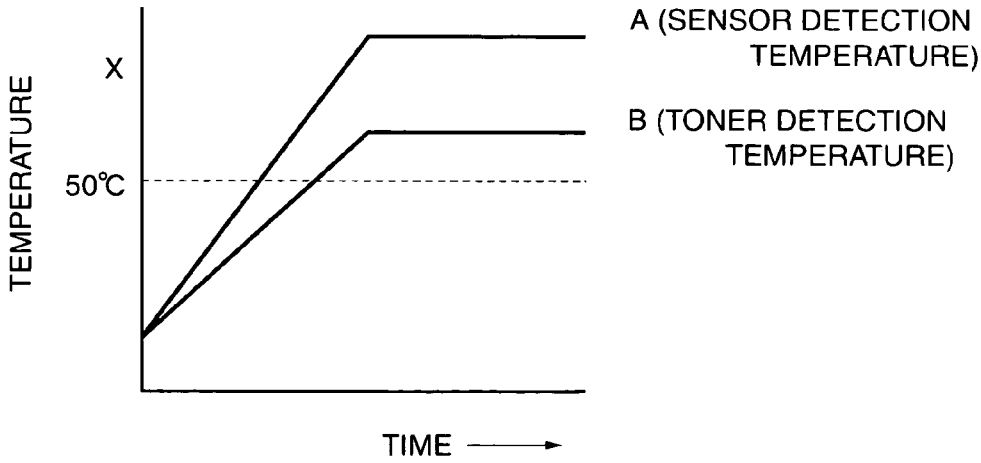
FIG. 41 is a diagram showing a relation between a sensor detection temperature and a toner temperature in the 17th embodiment of the invention.
Figure 40:
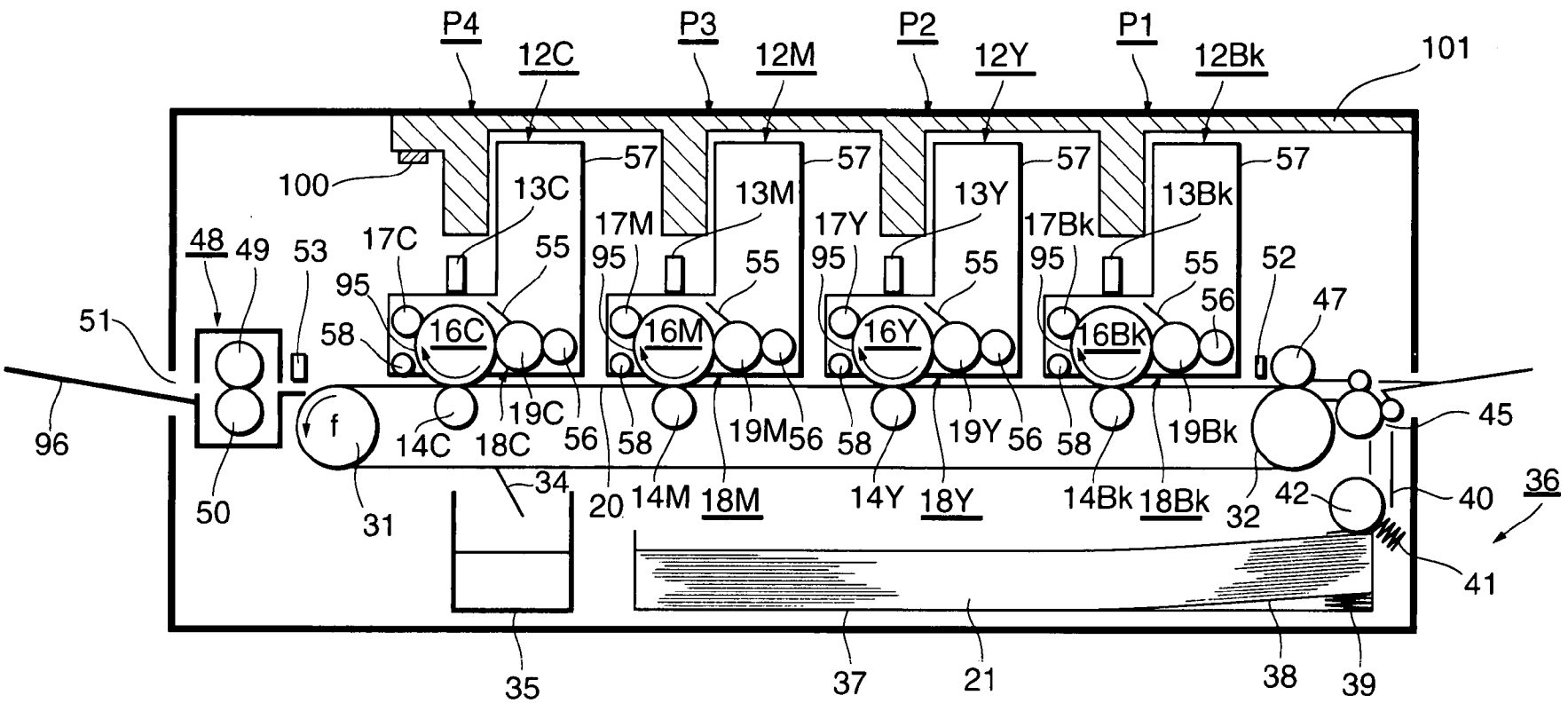
FIG. 40 is a schematic diagram of a printer in the 17th embodiment of the invention.

FIG. 40 is a schematic diagram of a printer in the 17th embodiment of the invention. FIG. 41 is a diagram showing a relation between a detection temperature of a temperature detecting sensor and a toner temperature in the image forming unit in the 17th embodiment of the invention. In FIG. 41, an axis of abscissa indicates the time and an axis of ordinate shows the temperature.

In the embodiment, a temperature detecting sensor 100 is provided on the back surface of a printer cover 101 near the image forming unit closest to the fixing unit. By detecting the temperature in the apparatus, a temperature of the toner in the image forming unit is presumed. The relation between the detection temperature in the position of the temperature detecting sensor and the toner temperature in the image forming unit is preliminarily obtained by experiments, set as temperature related table data, and recorded in the ROM. For example, there is a relation as shown in FIG. 41.

As mentioned above, not only the temperature of the belt is detected but also the temperature detecting sensor of another portion of the apparatus is provided and the toner temperature can be presumed from the detection temperature. Therefore, a degree of freedom increases in designing of the apparatus. By providing the temperature detecting unit for the apparatus main body instead of the inside of the image forming unit, a unit price of the image forming unit as consumables can be reduced.

What is claimed is:

1. An image forming apparatus comprising:

(a) an image forming unit which forms an electrostatic latent image onto a charged image holding material, deposits a developing material onto said electrostatic latent image, and forms a visible image;

(b) a belt arranged so as to run freely in contact with said image forming unit;

(c) a temperature detecting unit which detects a temperature of said belt; and (d) a control unit which controls an image forming process on the basis of the temperature detected by said temperature detecting unit, wherein the control unit (i) reduces a conveying speed of a print medium when the temperature detected by the temperature detecting unit is higher than a threshold value, and (ii) lowers a control temperature of a fixing unit when the temperature detected by the temperature detecting unit is higher than a threshold value.

2. The image forming apparatus according to claim 1, further comprising:

(e) a fixing unit which fixes the visible image transferred from said image forming unit onto a recording medium which is conveyed by said belt, wherein said temperature detecting unit is arranged in a position where the surface temperature of the belt after the recording medium was separated is detected.

3. The image forming apparatus according to claim 1, wherein when the detection temperature by said temperature detecting unit is higher than a threshold value, said control unit temporarily stops the image forming process.

4. The image forming apparatus according to claim 3, wherein either said detection temperature or said threshold value is corrected by a preset correction offset value.

5. The image forming apparatus according to claim 4, wherein said correction offset value is set in correspondence to the detection temperature.

6. The image forming apparatus according to claim 1, wherein said control unit makes the control of the image forming process on the basis of the detection temperature by said temperature detecting unit after the elapse of a delay time from the start of running of the belt.

7. The image forming apparatus according to claim 1, wherein said control unit makes the control of the image forming process on the basis of the detection temperature by said temperature detecting unit after a running distance of the belt became longer than a threshold value from the start of running of the belt.

8. The image forming apparatus according to claim 1, wherein said control unit limits a fluctuation of the detection temperature when said fluctuation is large.

9. The image forming apparatus according to claim 1, wherein said control unit weights the detection temperature.

10. The image forming apparatus according to claim 3, wherein said threshold value is changed when a time to temporarily stop said image forming process is equal to or longer than a set value.

11. The image forming apparatus according to claim 3, wherein said control unit starts said image forming process when the detection temperature is lower than another threshold value which has been set to be lower than said threshold value after said image forming process was temporarily stopped.

12. The image forming apparatus according to claim 1, wherein said detection temperature is corrected by a temperature correction value which has been set in correspondence to a temperature of said image holding material.

13. The image forming apparatus according to claim 1, wherein said detection temperature is corrected by a temperature correction value after said image forming process was temporarily stopped.

14. The image forming apparatus according to claim 13, wherein said temperature correction value is changed in association with turn-off of a heater.

15. The image forming apparatus according to claim 3, wherein said threshold value is changed in accordance with an amount of image data to which the image process is being executed.

16. The image forming apparatus according to claim 1, wherein when data for simplex exists in image data, said control unit preferentially forms an image with respect to an image forming job of said simplex data.

17. The image forming apparatus according to claim 1, wherein said control unit widens a conveyance interval of a print medium when the detection temperature by said temperature detecting unit is higher than the threshold value.

18. The image forming apparatus according to claim 1, wherein said control unit inhibits duplex printing when the detection temperature by said temperature detecting unit is higher than a threshold value.

19. An image forming apparatus comprising:

(a) an image forming section including at least one photosensitive drum that forms an image on a recording medium;

(b) a fixing unit including a heating roller that fixes the image on the recording medium;

(c) a conveying belt that conveys the recording medium;

(d) a driving roller that drives the conveying belt, the driving roller being located between the image forming section and the fixing unit;

(e) a temperature sensor that detects a temperature of the photosensitive drum, the temperature sensor being placed near the driving roller; and (f) a control unit that controls an image forming process on the basis of the detected temperature, the control unit executing a standby mode setting process when the detected temperature is greater than a predetermined threshold value, the standby mode setting process turning off a heater of said heating roller.

20. The apparatus of claim 19 wherein the temperature sensor faces the driving roller.

21. The apparatus of claim 19 wherein the temperature sensor is in contact with the conveying belt.

22. The apparatus of claim 19 wherein the temperature sensor detects the temperature of the conveying belt, wherein the temperature of the conveying belt is substantially equal to the temperature of the photosensitive drum.

23. The apparatus of claim 19 wherein the temperature sensor detects the surface temperature of the conveying belt after the recording medium becomes separated therefrom, wherein the surface temperature of the conveying belt is substantially equal to the temperature of the photosensitive drum.

24. The apparatus of claim 19 wherein the temperature sensor is lower than the fixing unit.

25. The apparatus of claim 19 wherein the standby mode setting process stops the image forming process.

26. The apparatus of claim 19 wherein the standby mode setting process reduces a set temperature of the fixing unit.

27. The apparatus of claim 19 wherein the image forming section has at least one image forming unit.

28. The apparatus of claim 19 wherein the control unit delays control of the image forming process on the basis of the detected temperature until after the elapse of a delay time from the start of running of the conveying belt.

29. The apparatus of claim 19 wherein the control unit delays control of the image forming process on the basis of the detected temperature until after a running distance of the conveying belt becomes longer than a threshold value from the start of running of the conveying belt.

30. The apparatus of claim 19 wherein the control unit limits a fluctuation of the detected temperature when the fluctuation is large.

31. The apparatus of claim 19 wherein the control unit weights the detected temperature.

32. The apparatus of claim 19 wherein the control unit reduces a conveying speed of the recording medium when the detected temperature is higher than a threshold value.

33. The apparatus of claim 19 wherein the fixing unit has a control temperature, and the control unit lowers the control temperature when the detected temperature is higher than a threshold value.

34. The apparatus of claim 19 wherein there is a predetermined conveyance interval between successive recording media, and the control unit widens the conveyance interval when the detected temperature is higher than a threshold value.

35. The apparatus of claim 19 wherein the image forming apparatus includes duplex printing capability, and the control unit inhibits duplex printing when the detected temperature is higher than a threshold value.

* * * * *